US010789899B2

(12) United States Patent
Ikeda et al.

(10) Patent No.: US 10,789,899 B2
(45) Date of Patent: Sep. 29, 2020

(54) DISPLAY DEVICE

(71) Applicant: Japan Display Inc., Tokyo (JP)

(72) Inventors: Kojiro Ikeda, Tokyo (JP); Masaaki Kabe, Tokyo (JP); Jin Ota, Tokyo (JP)

(73) Assignee: Japan Display Inc., Tokyo (JP)

( * ) Notice: Subject to any disclaimer, the term of this patent is extended or adjusted under 35 U.S.C. 154(b) by 65 days.

(21) Appl. No.: 15/957,336

(22) Filed: Apr. 19, 2018

(65) Prior Publication Data

US 2018/0315384 A1 Nov. 1, 2018

(30) Foreign Application Priority Data

May 1, 2017 (JP) ..... 2017-091363

(51) Int. Cl.
*G09G 3/36* (2006.01)
*G09G 3/00* (2006.01)

(52) U.S. Cl.
CPC ..... *G09G 3/3607* (2013.01); *G09G 3/007* (2013.01); *G09G 3/3614* (2013.01); *G09G 3/3648* (2013.01); *G09G 2300/0452* (2013.01); *G09G 2320/0209* (2013.01)

(58) Field of Classification Search
CPC ... G09G 2300/0452; G09G 2320/0209; G09G 3/007; G09G 3/3607; G09G 3/3614; G09G 3/3648
See application file for complete search history.

(56) References Cited

U.S. PATENT DOCUMENTS 8,354,989 B2 1/2013 Oh et al.
9,837,012 B2 12/2017 Ikeda et al.
2008/0278466 A1* 11/2008 Joo ..... G09G 3/3614 345/205
2009/0207110 A1* 8/2009 Lee ..... G09G 3/2022 345/82
2013/0027437 A1* 1/2013 Gu ..... G09G 3/3607 345/690
2013/0141314 A1* 6/2013 Ka ..... G09G 3/006 345/55

(Continued)

FOREIGN PATENT DOCUMENTS

JP 2015-230343 A 12/2015
JP 2016-206243 A 12/2016
WO 2005079167 A2 9/2005

*Primary Examiner* — Kenneth Bukowski
(74) *Attorney, Agent, or Firm* — K&L Gates LLP

(57) ABSTRACT

According to an aspect, a display device includes an image display panel including: sub-pixel rows, in each of which sub-pixels for displaying different colors are periodically arrayed in a first direction, are regularly arranged in a second direction different from the first direction; signal lines in parallel to sub-pixel columns in which the sub-pixels are successively arranged in the second direction; and scan lines that sequentially select each sub-pixel row. Each of m (integer ≥2) selector signals selects n (integer ≥1) pairs of the signal lines each supplied with two signals each having a mutually reverse polarity, within a period during which each sub-pixel row is selected by a corresponding scan line, and a sum of potential changes of the n pairs of the signal lines selected by each selector signal is substantially zero when each sub-pixel row is sequentially selected by the corresponding scan line.

5 Claims, 68 Drawing Sheets

(56) References Cited

U.S. PATENT DOCUMENTS

| | | | | |
|---|---|---|---|---|
| 2013/0222216 | A1* | 8/2013 | Park | G09G 3/3614 345/55 |
| 2014/0118657 | A1* | 5/2014 | Duan | G02F 1/136286 349/46 |
| 2014/0198135 | A1* | 7/2014 | Eom | G09G 3/3275 345/690 |
| 2015/0138055 | A1* | 5/2015 | Kitani | G09G 3/3607 345/88 |
| 2015/0348489 | A1* | 12/2015 | Kabe | G09G 3/3696 345/206 |
| 2016/0078836 | A1* | 3/2016 | Kim | G09G 3/3688 345/209 |
| 2016/0189640 | A1* | 6/2016 | Guo | G09G 3/3688 345/694 |

* cited by examiner

FIG.10

| | | Gate N-1→Gate N | | Gate N→Gate N+1 | |
|---|---|---|---|---|---|
| SEL1 | DTL1 | -V | -2V | +V | +2V |
| | DTL2 | -V | | +V | |
| SEL2 | DTL3 | ≈ 0 | +V | ≈ 0 | -V |
| | DTL4 | +V | | -V | |
| SEL3 | DTL5 | +V | +V | -V | -V |
| | DTL6 | ≈ 0 | | ≈ 0 | |

FIG.11

| | | Gate N-1→Gate N | | Gate N→Gate N+1 | |
|---|---|---|---|---|---|
| SEL1 | DTL1 | -V | ≈ 0 | +V | ≈ 0 |
| | DTL4 | +V | | -V | |
| SEL2 | DTL2 | -V | ≈ 0 | +V | ≈ 0 |
| | DTL5 | +V | | -V | |
| SEL3 | DTL3 | ≈ 0 | ≈ 0 | ≈ 0 | ≈ 0 |
| | DTL6 | ≈ 0 | | ≈ 0 | |

FIG.14

| | | Gate N-1→Gate N | | Gate N→Gate N+1 | |
|---|---|---|---|---|---|
| SEL1 | DTL1 | +V | ≈ 0 | -V | ≈ 0 |
| | DTL4 | -V | | +V | |
| SEL2 | DTL2 | ≈ 0 | ≈ 0 | ≈ 0 | ≈ 0 |
| | DTL5 | ≈ 0 | | ≈ 0 | |
| SEL3 | DTL3 | -V | ≈ 0 | +V | ≈ 0 |
| | DTL6 | +V | | -V | |

FIG.16

| | | Gate N-1→Gate N | |
|---|---|---|---|
| SEL1 | DTL1 | ≈ 0 | ≈ 0 |
| | DTL4 | ≈ 0 | |
| SEL2 | DTL2 | +V | ≈ 0 |
| | DTL5 | -V | |
| SEL3 | DTL3 | +V | ≈ 0 |
| | DTL6 | -V | |

FIG.18

| | | Gate N-1→Gate N | |
|---|---|---|---|
| SEL1 | DTL1 | ≈ 0 | ≈ 0 |
| | DTL4 | ≈ 0 | |
| SEL2 | DTL2 | -V | ≈ 0 |
| | DTL5 | +V | |
| SEL3 | DTL3 | -V | ≈ 0 |
| | DTL6 | +V | |

FIG.20

| | | Gate N-1→Gate N | |
|---|---|---|---|
| SEL1 | DTL1 | -V | ≈ 0 |
| | DTL4 | +V | |
| SEL2 | DTL2 | ≈ 0 | ≈ 0 |
| | DTL5 | ≈ 0 | |
| SEL3 | DTL3 | +V | ≈ 0 |
| | DTL6 | -V | |

FIG.22

| | | Gate N-1→Gate N | |
|---|---|---|---|
| SEL1 | DTL1 | +V | ≈ 0 |
| | DTL4 | -V | |
| SEL2 | DTL2 | +V | ≈ 0 |
| | DTL5 | -V | |
| SEL3 | DTL3 | ≈ 0 | ≈ 0 |
| | DTL6 | ≈ 0 | |

FIG.25

| | | Gate N-1→Gate N | |
|---|---|---|---|
| SEL1 | DTL1 | ≈ 0 | ≈ 0 |
| | DTL4 | ≈ 0 | |
| SEL2 | DTL2 | ≈ 0 | ≈ 0 |
| | DTL5 | ≈ 0 | |
| SEL3 | DTL3 | ≈ 0 | ≈ 0 |
| | DTL6 | ≈ 0 | |

FIG.27

| | | Gate N-1→Gate N | |
|---|---|---|---|
| SEL1 | DTL1 | ≈ 0 | ≈ 0 |
| | DTL4 | ≈ 0 | |
| SEL2 | DTL2 | ≈ 0 | ≈ 0 |
| | DTL5 | ≈ 0 | |
| SEL3 | DTL3 | ≈ 0 | ≈ 0 |
| | DTL6 | ≈ 0 | |

FIG.31

| | | Gate N-1→Gate N | | Gate N→Gate N+1 | |
|---|---|---|---|---|---|
| SEL1 | DTL1 | +V | ≈ 0 | -V | ≈ 0 |
| | DTL6 | +V | | -V | |
| | DTL9 | -V | | +V | |
| | DTL10 | -V | | +V | |
| SEL2 | DTL4 | -V | ≈ 0 | +V | ≈ 0 |
| | DTL5 | ≈ 0 | | ≈ 0 | |
| | DTL7 | +V | | -V | |
| | DTL8 | ≈ 0 | | ≈ 0 | |
| SEL3 | DTL2 | ≈ 0 | ≈ 0 | ≈ 0 | ≈ 0 |
| | DTL3 | -V | | +V | |
| | DTL11 | ≈ 0 | | ≈ 0 | |
| | DTL12 | +V | | -V | |

FIG.33

| | | Gate N-1→Gate N | |
|---|---|---|---|
| SEL1 | DTL1 | -V | ≈ 0 |
| | DTL6 | ≈ 0 | |
| | DTL9 | ≈ 0 | |
| | DTL10 | +V | |
| SEL2 | DTL4 | +V | ≈ 0 |
| | DTL5 | +V | |
| | DTL7 | -V | |
| | DTL8 | -V | |
| SEL3 | DTL2 | -V | ≈ 0 |
| | DTL3 | ≈ 0 | |
| | DTL11 | +V | |
| | DTL12 | ≈ 0 | |

FIG.35

| | | Gate N-1→Gate N | |
|---|---|---|---|
| SEL1 | DTL1 | ≈ 0 | ≈ 0 |
| | DTL6 | -V | |
| | DTL9 | +V | |
| | DTL10 | ≈ 0 | |
| SEL2 | DTL4 | ≈ 0 | ≈ 0 |
| | DTL5 | -V | |
| | DTL7 | ≈ 0 | |
| | DTL8 | +V | |
| SEL3 | DTL2 | +V | ≈ 0 |
| | DTL3 | +V | |
| | DTL11 | -V | |
| | DTL12 | -V | |

FIG.38

| | | Gate N-1→Gate N | |
|---|---|---|---|
| SEL1 | DTL1 | ≈ 0 | ≈ 0 |
| | DTL6 | ≈ 0 | |
| | DTL9 | ≈ 0 | |
| | DTL10 | ≈ 0 | |
| | DTL14 | ≈ 0 | |
| | DTL17 | ≈ 0 | |
| SEL2 | DTL2 | ≈ 0 | ≈ 0 |
| | DTL5 | ≈ 0 | |
| | DTL7 | ≈ 0 | |
| | DTL12 | ≈ 0 | |
| | DTL15 | ≈ 0 | |
| | DTL16 | ≈ 0 | |
| SEL3 | DTL3 | ≈ 0 | ≈ 0 |
| | DTL4 | ≈ 0 | |
| | DTL8 | ≈ 0 | |
| | DTL11 | ≈ 0 | |
| | DTL13 | ≈ 0 | |
| | DTL18 | ≈ 0 | |

FIG.41

| | | Gate N-1→Gate N | |
|---|---|---|---|
| SEL1 | DTL1 | -V | ≈ 0 |
| | DTL2 | ≈ 0 | |
| | DTL7 | +V | |
| | DTL8 | ≈ 0 | |
| SEL2 | DTL3 | -V | ≈ 0 |
| | DTL4 | -V | |
| | DTL9 | +V | |
| | DTL10 | +V | |
| SEL3 | DTL5 | ≈ 0 | ≈ 0 |
| | DTL6 | -V | |
| | DTL11 | ≈ 0 | |
| | DTL12 | +V | |

FIG.43

| | | Gate N-1→Gate N | |
|---|---|---|---|
| SEL1 | DTL1 | +V | ≈ 0 |
| | DTL2 | +V | |
| | DTL7 | -V | |
| | DTL8 | -V | |
| SEL2 | DTL3 | ≈ 0 | ≈ 0 |
| | DTL4 | +V | |
| | DTL9 | ≈ 0 | |
| | DTL10 | -V | |
| SEL3 | DTL5 | -V | ≈ 0 |
| | DTL6 | ≈ 0 | |
| | DTL11 | +V | |
| | DTL12 | ≈ 0 | |

FIG.45

| | | Gate N-1→Gate N | |
|---|---|---|---|
| SEL1 | DTL1 | ≈ 0 | ≈ 0 |
| | DTL2 | -V | |
| | DTL7 | ≈ 0 | |
| | DTL8 | +V | |
| SEL2 | DTL3 | ≈ 0 | ≈ 0 |
| | DTL4 | ≈ 0 | |
| | DTL9 | ≈ 0 | |
| | DTL10 | ≈ 0 | |
| SEL3 | DTL5 | ≈ 0 | ≈ 0 |
| | DTL6 | +V | |
| | DTL11 | ≈ 0 | |
| | DTL12 | -V | |

FIG.48

| | | Gate N→Gate N+1 | |
|---|---|---|---|
| SEL1 | DTL1 | +V | ≈ 0 |
| | DTL6 | -V | |
| | DTL7 | -V | |
| | DTL12 | +V | |
| SEL2 | DTL2 | ≈ 0 | ≈ 0 |
| | DTL3 | +V | |
| | DTL8 | ≈ 0 | |
| | DTL9 | -V | |
| SEL3 | DTL4 | -V | ≈ 0 |
| | DTL5 | ≈ 0 | |
| | DTL10 | +V | |
| | DTL11 | ≈ 0 | |

FIG.50

| | | Gate N→Gate N+1 | |
|---|---|---|---|
| SEL1 | DTL1 | -V | ≈ 0 |
| | DTL6 | ≈ 0 | |
| | DTL7 | +V | |
| | DTL12 | ≈ 0 | |
| SEL2 | DTL2 | +V | ≈ 0 |
| | DTL3 | ≈ 0 | |
| | DTL8 | -V | |
| | DTL9 | ≈ 0 | |
| SEL3 | DTL4 | +V | ≈ 0 |
| | DTL5 | +V | |
| | DTL10 | -V | |
| | DTL11 | -V | |

FIG.52

| | | Gate N→Gate N+1 | |
|---|---|---|---|
| SEL1 | DTL1 | ≈ 0 | ≈ 0 |
| | DTL6 | +V | |
| | DTL7 | ≈ 0 | |
| | DTL12 | -V | |
| SEL2 | DTL2 | -V | ≈ 0 |
| | DTL3 | ≈ 0 | |
| | DTL8 | +V | |
| | DTL9 | ≈ 0 | |
| SEL3 | DTL4 | ≈ 0 | ≈ 0 |
| | DTL5 | ≈ 0 | |
| | DTL10 | ≈ 0 | |
| | DTL11 | ≈ 0 | |

FIG.55

| | | Gate N-1→Gate N | |
|---|---|---|---|
| SEL1 | DTL1 | ≈ 0 | ≈ 0 |
| | DTL3 | +V | |
| | DTL7 | -V | |
| | DTL8 | -V | |
| | DTL13 | ≈ 0 | |
| | DTL15 | -V | |
| | DTL19 | +V | |
| | DTL20 | +V | |
| SEL2 | DTL2 | ≈ 0 | ≈ 0 |
| | DTL5 | ≈ 0 | |
| | DTL9 | ≈ 0 | |
| | DTL11 | +V | |
| | DTL14 | ≈ 0 | |
| | DTL17 | ≈ 0 | |
| | DTL21 | ≈ 0 | |
| | DTL23 | -V | |
| SEL3 | DTL4 | +V | ≈ 0 |
| | DTL6 | ≈ 0 | |
| | DTL10 | ≈ 0 | |
| | DTL12 | -V | |
| | DTL16 | -V | |
| | DTL18 | ≈ 0 | |
| | DTL22 | ≈ 0 | |
| | DTL24 | +V | |

FIG.57

| | | Gate N-1→Gate N | |
|---|---|---|---|
| SEL1 | DTL1 | +V | ≈ 0 |
| | DTL3 | ≈ 0 | |
| | DTL7 | ≈ 0 | |
| | DTL8 | +V | |
| | DTL13 | -V | |
| | DTL15 | ≈ 0 | |
| | DTL19 | ≈ 0 | |
| | DTL20 | -V | |
| SEL2 | DTL2 | ≈ 0 | ≈ 0 |
| | DTL5 | -V | |
| | DTL9 | +V | |
| | DTL11 | ≈ 0 | |
| | DTL14 | ≈ 0 | |
| | DTL17 | +V | |
| | DTL21 | -V | |
| | DTL23 | ≈ 0 | |
| SEL3 | DTL4 | -V | ≈ 0 |
| | DTL6 | ≈ 0 | |
| | DTL10 | ≈ 0 | |
| | DTL12 | +V | |
| | DTL16 | +V | |
| | DTL18 | ≈ 0 | |
| | DTL22 | ≈ 0 | |
| | DTL24 | -V | |

FIG.59

| | | Gate N-1→Gate N | |
|---|---|---|---|
| SEL1 | DTL1 | -V | ≈ 0 |
| | DTL3 | ≈ 0 | |
| | DTL7 | ≈ 0 | |
| | DTL8 | ≈ 0 | |
| | DTL13 | +V | |
| | DTL15 | ≈ 0 | |
| | DTL19 | ≈ 0 | |
| | DTL20 | ≈ 0 | |
| SEL2 | DTL2 | +V | ≈ 0 |
| | DTL5 | +V | |
| | DTL9 | -V | |
| | DTL11 | ≈ 0 | |
| | DTL14 | -V | |
| | DTL17 | -V | |
| | DTL21 | +V | |
| | DTL23 | ≈ 0 | |
| SEL3 | DTL4 | ≈ 0 | ≈ 0 |
| | DTL6 | -V | |
| | DTL10 | +V | |
| | DTL12 | ≈ 0 | |
| | DTL16 | ≈ 0 | |
| | DTL18 | +V | |
| | DTL22 | -V | |
| | DTL24 | ≈ 0 | |

FIG.63

| | | Gate N-1→Gate N | | GateN→GateN+1 | |
|---|---|---|---|---|---|
| SEL1 | DTL1 | -V | ≈ 0 | ≈ 0 | ≈ 0 |
| | DTL2 | ≈ 0 | | ≈ 0 | |
| | DTL7 | +V | | -V | |
| | DTL8 | ≈ 0 | | -V | |
| | DTL13 | +V | | ≈ 0 | |
| | DTL14 | ≈ 0 | | ≈ 0 | |
| | DTL19 | -V | | +V | |
| | DTL20 | ≈ 0 | | +V | |
| SEL2 | DTL3 | -V | ≈ 0 | +V | ≈ 0 |
| | DTL4 | ≈ 0 | | +V | |
| | DTL9 | -V | | ≈ 0 | |
| | DTL10 | ≈ 0 | | ≈ 0 | |
| | DTL15 | +V | | -V | |
| | DTL16 | ≈ 0 | | -V | |
| | DTL21 | +V | | ≈ 0 | |
| | DTL22 | ≈ 0 | | ≈ 0 | |
| SEL3 | DTL5 | +V | ≈ 0 | ≈ 0 | ≈ 0 |
| | DTL6 | ≈ 0 | | ≈ 0 | |
| | DTL11 | -V | | +V | |
| | DTL12 | ≈ 0 | | +V | |
| | DTL17 | -V | | ≈ 0 | |
| | DTL18 | ≈ 0 | | ≈ 0 | |
| | DTL23 | +V | | -V | |
| | DTL24 | ≈ 0 | | -V | |

FIG.66

| | | Gate N-1→Gate N | | Gate N→Gate N+1 | |
|---|---|---|---|---|---|
| SEL1 | DTL1 | ≈ 0 | ≈ 0 | +V | ≈ 0 |
| | DTL2 | +V | | ≈ 0 | |
| | DTL7 | ≈ 0 | | ≈ 0 | |
| | DTL8 | -V | | +V | |
| | DTL13 | ≈ 0 | | -V | |
| | DTL14 | -V | | ≈ 0 | |
| | DTL19 | ≈ 0 | | ≈ 0 | |
| | DTL20 | +V | | -V | |
| SEL2 | DTL3 | ≈ 0 | ≈ 0 | ≈ 0 | ≈ 0 |
| | DTL4 | +V | | -V | |
| | DTL9 | ≈ 0 | | +V | |
| | DTL10 | +V | | ≈ 0 | |
| | DTL15 | ≈0 | | ≈ 0 | |
| | DTL16 | -V | | +V | |
| | DTL21 | ≈ 0 | | -V | |
| | DTL22 | -V | | ≈ 0 | |
| SEL3 | DTL5 | ≈ 0 | ≈ 0 | -V | ≈ 0 |
| | DTL6 | -V | | ≈ 0 | |
| | DTL11 | ≈ 0 | | ≈ 0 | |
| | DTL12 | | | -V | |
| | DTL17 | ≈ 0 | | +V | |
| | DTL18 | +V | | ≈ 0 | |
| | DTL23 | ≈ 0 | | ≈ 0 | |
| | DTL24 | -V | | +V | |

FIG.69

| | | Gate N-1→Gate N | | Gate N→Gate N+1 | |
|---|---|---|---|---|---|
| SEL1 | DTL1 | +V | ≈ 0 | -V | ≈ 0 |
| | DTL2 | ≈ 0 | | -V | |
| | DTL7 | -V | | ≈ 0 | |
| | DTL8 | ≈ 0 | | ≈ 0 | |
| | DTL13 | -V | | +V | |
| | DTL14 | ≈ 0 | | +V | |
| | DTL19 | +V | | ≈ 0 | |
| | DTL20 | ≈ 0 | | ≈ 0 | |
| SEL2 | DTL3 | +V | ≈ 0 | ≈ 0 | ≈ 0 |
| | DTL4 | ≈ 0 | | ≈ 0 | |
| | DTL9 | +V | | -V | |
| | DTL10 | ≈ 0 | | -V | |
| | DTL15 | -V | | ≈ 0 | |
| | DTL16 | ≈ 0 | | ≈ 0 | |
| | DTL21 | -V | | +V | |
| | DTL22 | ≈ 0 | | +V | |
| SEL3 | DTL5 | -V | ≈ 0 | +V | ≈ 0 |
| | DTL6 | ≈ 0 | | +V | |
| | DTL11 | +V | | ≈ 0 | |
| | DTL12 | ≈ 0 | | ≈ 0 | |
| | DTL17 | +V | | -V | |
| | DTL18 | ≈ 0 | | -V | |
| | DTL23 | -V | | ≈ 0 | |
| | DTL24 | ≈ 0 | | ≈ 0 | |

DISPLAY DEVICE

CROSS-REFERENCE TO RELATED APPLICATIONS

This application claims priority from Japanese Application No. 2017-091363, filed on May 1, 2017, the contents of which are incorporated by reference herein in its entirety.

BACKGROUND

Technical Field

The present disclosure relates to a display device.

Description of the Related Art

Recent years have seen growing demands for display devices for use in, for example, mobile devices, such as mobile phones and electronic paper. In such a display device, each pixel includes a plurality of sub-pixels, which emit light of different colors. The display device makes the pixel display various colors by switching on and off display of the sub-pixels. Such display devices have been improved year after year in display characteristics, such as resolution and luminance.

Typically, in such a display device, each pixel is constituted by sub-pixels of red, green, and blue, or by adding a white sub-pixel to the red, green, and blue sub-pixels. Brightness and colors are expressed by controlling each pixel. Meanwhile, Japanese Patent Application Laid-open Publication No. 2016-206243 discloses a technique of performing display drive by independently controlling the output of the sub-pixels.

In a display device that performs the display drive by independently controlling the output of the sub-pixels, a color array of the sub-pixels (hereinafter, also called a pixel array) differs row by row, in some cases. When the display drive is performed in such a display device, deterioration in display quality, or so-called crosstalk, may occur depending on the driving order of the pixels. For example, when a single-colored window image is displayed at a central part of an image display panel, regions on both sides of the single-colored window image are brightened (or darkened).

For the foregoing reasons, there is a need for a display device that prevents the deterioration in display quality caused by the crosstalk.

SUMMARY

According to an aspect of the present disclosure, a display device includes an image display panel, the image display panel including: a plurality of sub-pixel rows, in each of which a plurality of sub-pixels to display respective different colors are periodically arrayed in a first direction, are regularly arranged in a second direction different from the first direction; a plurality of signal lines in parallel to a plurality of sub-pixel columns in which the sub-pixels are successively arranged in the second direction; and a plurality of scan lines that sequentially select each of the sub-pixel rows. Each of m (where m is an integer of two or greater) selector signals selects n (where n is an integer of one or greater) pairs of the signal lines, each pair supplied with two signals each having a mutually reverse polarity, within a period during which each of the sub-pixel rows is selected by corresponding one of the scan lines, and a sum of potential changes of the n pairs of the signal lines selected by each of the selector signals is substantially zero when each of the sub-pixel rows is sequentially selected by the corresponding scan line.

BRIEF DESCRIPTION OF THE DRAWINGS

FIG. 10 is a table indicating potential changes of respective signal lines when the window display illustrated in FIG. 4 is made in the second primary color (green) in the comparative example illustrated in FIG. 3;

FIG. 11 is a table indicating the potential changes of the respective signal lines when the window display illustrated in FIG. 4 is made in the second primary color (green) in the example illustrated in FIG. 7;

FIG. 14 is a table indicating the potential changes of the respective signal lines when the window display illustrated in FIG. 4 is made in the first primary color (red) in the example illustrated in FIG. 7;

FIG. 16 is a table indicating the potential changes of the respective signal lines when the window display illustrated in FIG. 4 is made in the third primary color (blue) in the example illustrated in FIG. 7;

FIG. 18 is a diagram illustrating a list of the potential changes of the respective signal lines when the window display illustrated in FIG. 4 is made in yellow in the example illustrated in FIG. 7;

FIG. 20 is a table indicating the potential changes of the respective signal lines when the window display illustrated in FIG. 4 is made in cyan in the example illustrated in FIG. 7;

FIG. 22 is a table indicating the potential changes of the respective signal lines when the window display illustrated in FIG. 4 is made in magenta in the example illustrated in FIG. 7;

FIG. 25 is a table indicating the potential changes of the respective signal lines when the window display illustrated in FIG. 4 is made in the first primary color (red) in the first modification illustrated in FIG. 23;

FIG. 27 is a table indicating the potential changes of the respective signal lines when the window display illustrated in FIG. 4 is made in the second primary color (green) in the first modification illustrated in FIG. 23;

FIG. 31 is a table indicating the potential changes of the respective signal lines when the window display illustrated in FIG. 4 is made in the first primary color (red) in the second modification illustrated in FIG. 28;

FIG. 33 is a table indicating the potential changes of the respective signal lines when the window display illustrated in FIG. 4 is made in the second primary color (green) in the second modification illustrated in FIG. 28;

FIG. 35 is a table indicating the potential changes of the respective signal lines when the window display illustrated in FIG. 4 is made in the third primary color (blue) in the second modification illustrated in FIG. 28;

FIG. 38 is a table indicating the potential changes of the respective signal lines when the window display illustrated in FIG. 4 is made in the first primary color (red) in the third modification illustrated in FIG. 36;

FIG. 41 is a table indicating the potential changes of the respective signal lines when the window display illustrated in FIG. 4 is made in the first primary color (red) in the fourth modification illustrated in FIG. 39;

FIG. 43 is a table indicating the potential changes of the respective signal lines when the window display illustrated in FIG. 4 is made in the second primary color (green) in the fourth modification illustrated in FIG. 39;

FIG. 45 is a table indicating the potential changes of the respective signal lines when the window display illustrated in FIG. 4 is made in the third primary color (blue) in the fourth modification illustrated in FIG. 39;

FIG. 48 is a table indicating the potential changes of the respective signal lines when the window display illustrated in FIG. 4 is made in the first primary color (red) in the fifth modification illustrated in FIG. 46;

FIG. 50 is a table indicating the potential changes of the respective signal lines when the window display illustrated in FIG. 4 is made in the second primary color (green) in the fifth modification illustrated in FIG. 46;

FIG. 52 is a table indicating the potential changes of the respective signal lines when the window display illustrated in FIG. 4 is made in the third primary color (blue) in the fifth modification illustrated in FIG. 46;

FIG. 55 is a table indicating the potential changes of the respective signal lines when the window display illustrated in FIG. 4 is made in the first primary color (red) in the sixth modification illustrated in FIG. 53;

FIG. 57 is a table indicating the potential changes of the respective signal lines when the window display illustrated in FIG. 4 is made in the second primary color (green) in the sixth modification illustrated in FIG. 53;

FIG. 59 is a table indicating the potential changes of the respective signal lines when the window display illustrated in FIG. 4 is made in the third primary color (blue) in the sixth modification illustrated in FIG. 53;

FIG. 63 is a table indicating the potential changes of the respective signal lines when the window display illustrated in FIG. 4 is made in the first primary color (red) in the seventh modification illustrated in FIG. 60;

FIG. 66 is a table indicating the potential changes of the respective signal lines when the window display illustrated in FIG. 4 is made in the second primary color (green) in the seventh modification illustrated in FIG. 60;

FIG. 69 is a table indicating the potential changes of the respective signal lines when the window display illustrated in FIG. 4 is made in the third primary color (blue) in the seventh modification illustrated in FIG. 60.

DETAILED DESCRIPTION

Figure 1:
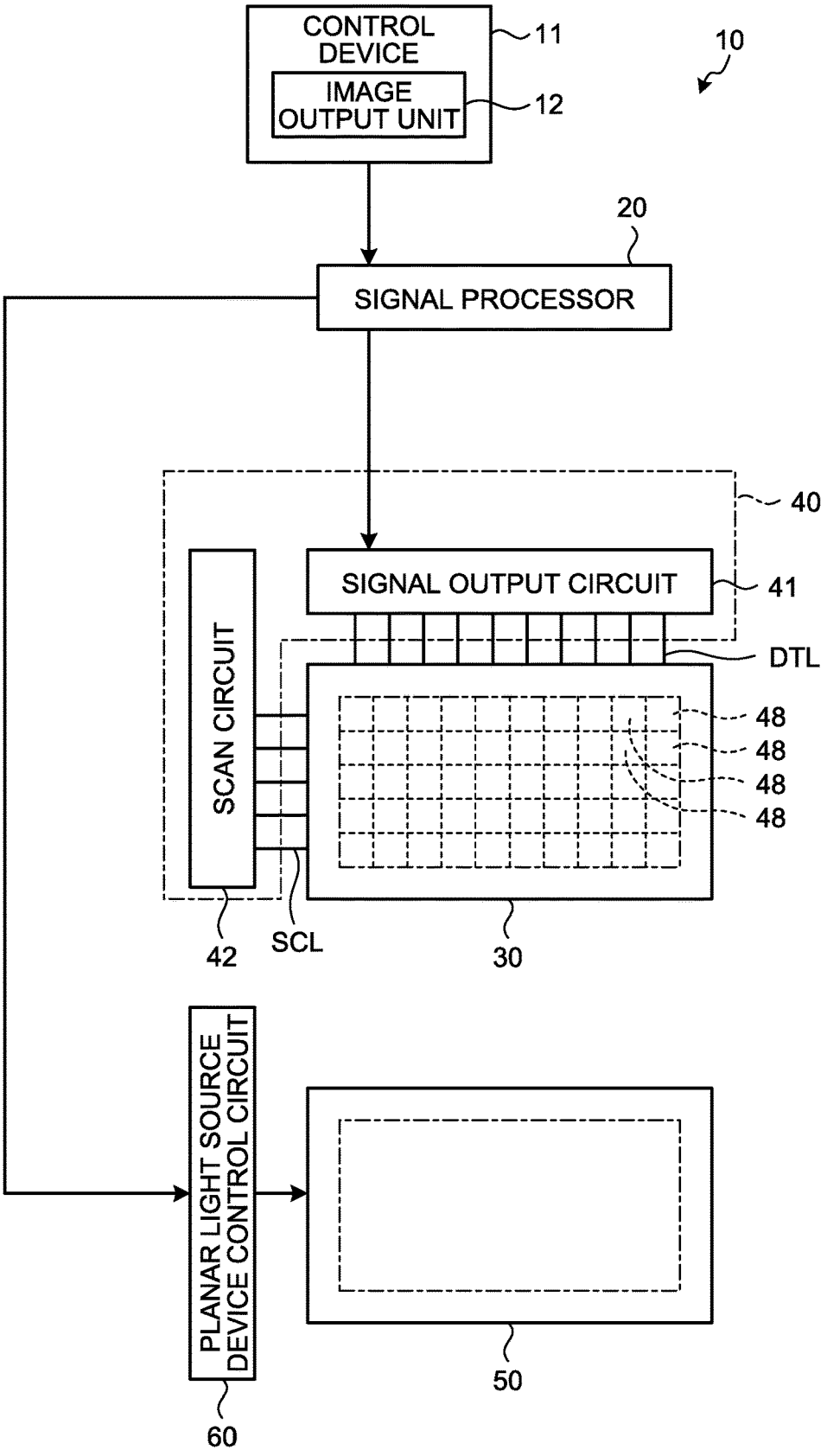
FIG. 1 is a block diagram illustrating an exemplary configuration of a display device according to an embodiment of the present disclosure.

Modes (embodiments) for carrying out the present disclosure will be described below in detail with reference to the drawings. The disclosure is given by way of example only, and various changes made without departing from the spirit of the disclosure and easily conceivable by those skilled in the art naturally fall within the scope of the present disclosure. The drawings may possibly illustrate the width, the thickness, the shape, and other elements of each unit more schematically than the actual aspect to simplify the explanation. These elements, however, are given by way of example only and are not intended to limit interpretation of the present disclosure. In the specification and the drawings, components similar to those previously described with reference to a preceding drawing are denoted by like reference numerals, and overlapping explanation thereof will be appropriately omitted.

Figure 2:
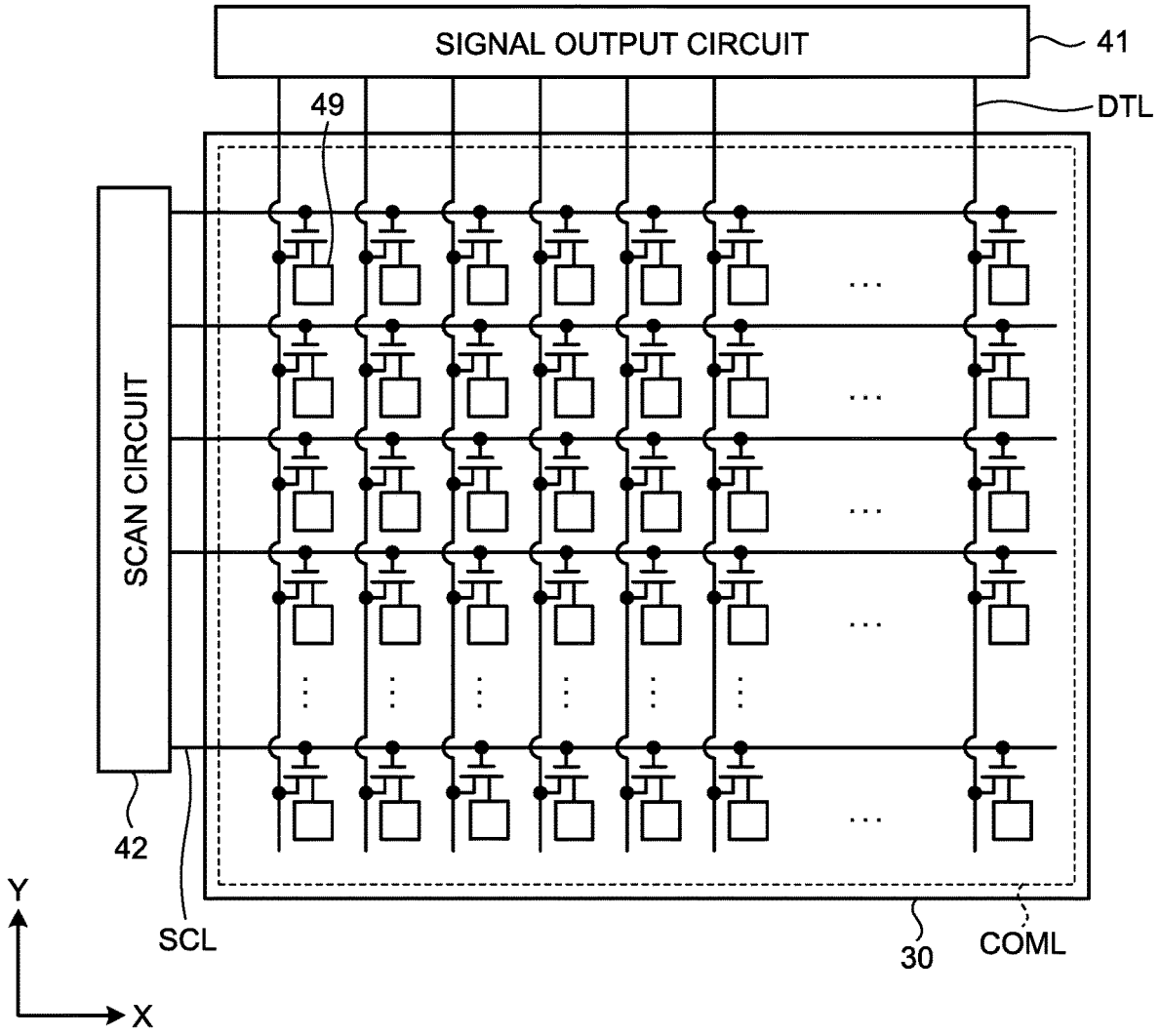
FIG. 2 is a conceptual diagram of an image display panel and an image display panel drive circuit of the display device according to the embodiment.

FIG. 1 is a block diagram illustrating an exemplary configuration of a display device according to an embodiment of the present disclosure. FIG. 2 is a conceptual diagram of an image display panel and an image display panel drive circuit of the display device according to the embodiment.

As illustrated in FIG. 1, a display device 10 includes a signal processor 20, an image display panel 30, an image display panel drive circuit 40, a planar light source device 50, a planar light source device control circuit 60. The signal processor 20 transmits signals to components of the display device 10 and controls their operations. The image display panel 30 displays an image based on output signals from the signal processor 20. The image display panel drive circuit 40 controls drive of the image display panel 30. The planar light source device 50 illuminates the image display panel 30 from its back side. The planar light source device control circuit 60 controls drive of the planar light source device 50.

The signal processor 20 is an arithmetic processor that controls operations of the image display panel 30 and the planar light source device 50. The signal processor 20 is coupled to the image display panel drive circuit 40 for driving the image display panel 30 and to the planar light source device control circuit 60 for driving the planar light source device 50. The signal processor 20 processes an input signal supplied from the outside, and generates an output signal and a planar light source device control signal. In other words, the signal processor 20 receives the input signal (red-green-blue (RGB) data) from an image output unit 12 of a control device 11, and generates the output signal by performing predetermined data conversion processing on the input signal to output the output signal to the image display panel 30. The signal processor 20 outputs the generated output signal to the image display panel drive circuit 40, and outputs the generated planar light source device control signal to the planar light source device control circuit 60.

Pixels 48 are arranged in a two-dimensional matrix of $P_0 \times Q_0$ pixels ($P_0$ pixels in the row direction and $Q_0$ pixels in the column direction) on the image display panel 30. In the example illustrated in FIG. 2, the row direction corresponds to the X-direction, and the column direction corresponds to the Y-direction. Hereinafter, the X-direction is also called the "first direction", and the Y-direction is also called the "second direction".

Each of the pixels 48 includes a plurality of sub-pixels 49 for displaying different colors. The pixel 48 may include, for example, a first sub-pixel for displaying a first primary color (e.g., red), a second sub-pixel for displaying a second primary color (e.g., green), and a third sub-pixel for displaying a third primary color (e.g., blue), or may include a fourth sub-pixel for displaying a fourth color (i.e., white) in addition to the first, second, and third sub-pixels.

The present embodiment assumes that display drive is independently performed for each of the sub-pixels. In the present embodiment, in video processing (to be described later) by the signal processor 20, the sub-pixels 49 for displaying the different colors are processed as one pixel unit for the sake of convenience. Specifically, partition of one pixel unit varies according to the video processing by the signal processor 20. Examples of processing for performing the display drive for each of the sub-pixels include sub-pixel rendering.

In the present embodiment, the sub-pixels 49 for displaying the different colors are periodically arranged in the X-direction (first direction) to form a sub-pixel row. The sub-pixel rows are regularly arranged in the Y-direction (second direction) to form a pixel array. The pixel array will be described later.

The display device 10 is more specifically a transmissive color liquid crystal display device. The image display panel 30 is a color liquid crystal display panel, in which a color filter is provided for each of the first, second, and third sub-pixels. When the fourth sub-pixel is included, the fourth sub-pixel may be provided with a transparent resin layer.

The image display panel drive circuit 40 is a control device according to the present embodiment, and includes a signal output circuit 41 and a scan circuit 42. The image display panel drive circuit 40 uses the signal output circuit 41 to hold and sequentially output video signals to the image display panel 30. The signal output circuit 41 is electrically coupled to the image display panel 30 through signal lines DTL. The image display panel drive circuit 40 uses the scan circuit 42 to select the sub-pixels on the image display panel 30, and controls on and off of switching elements (e.g., thin film transistors (TFTs)) for controlling operations (optical transmittance) of the sub-pixels. The scan circuit 42 is electrically coupled to the image display panel 30 through scan lines SCL.

The scan lines SCL and the signal lines DTL are linear metal wiring, and three-dimensionally intersect with each other in directions substantially orthogonal to each other.

The planar light source device 50 is disposed on the back side of the image display panel 30, and emits light toward the image display panel 30 to illuminate the image display panel 30. The planar light source device 50 emits the light to the entire image display panel 30 to brighten the image display panel 30. The planar light source device control circuit 60 controls, for example, the light quantity of the light emitted from the planar light source device 50. Specifically, the planar light source device control circuit 60 controls the light quantity of the light (intensity of the light) irradiating the image display panel 30 by adjusting a voltage or a duty ratio of power supplied to the planar light source device 50 based on the planar light source device control signal output from the signal processor 20.

The signal processor 20 processes the input signal to generate the output signal for determining display gradations of the sub-pixels 49, and outputs the generated output signal to the image display panel drive circuit 40. As described above, the present embodiment assumes that the display drive is independently performed for each of the sub-pixels, and thus is applicable to, for example, a configuration in which sub-pixel rendering is performed.

Figure 3:
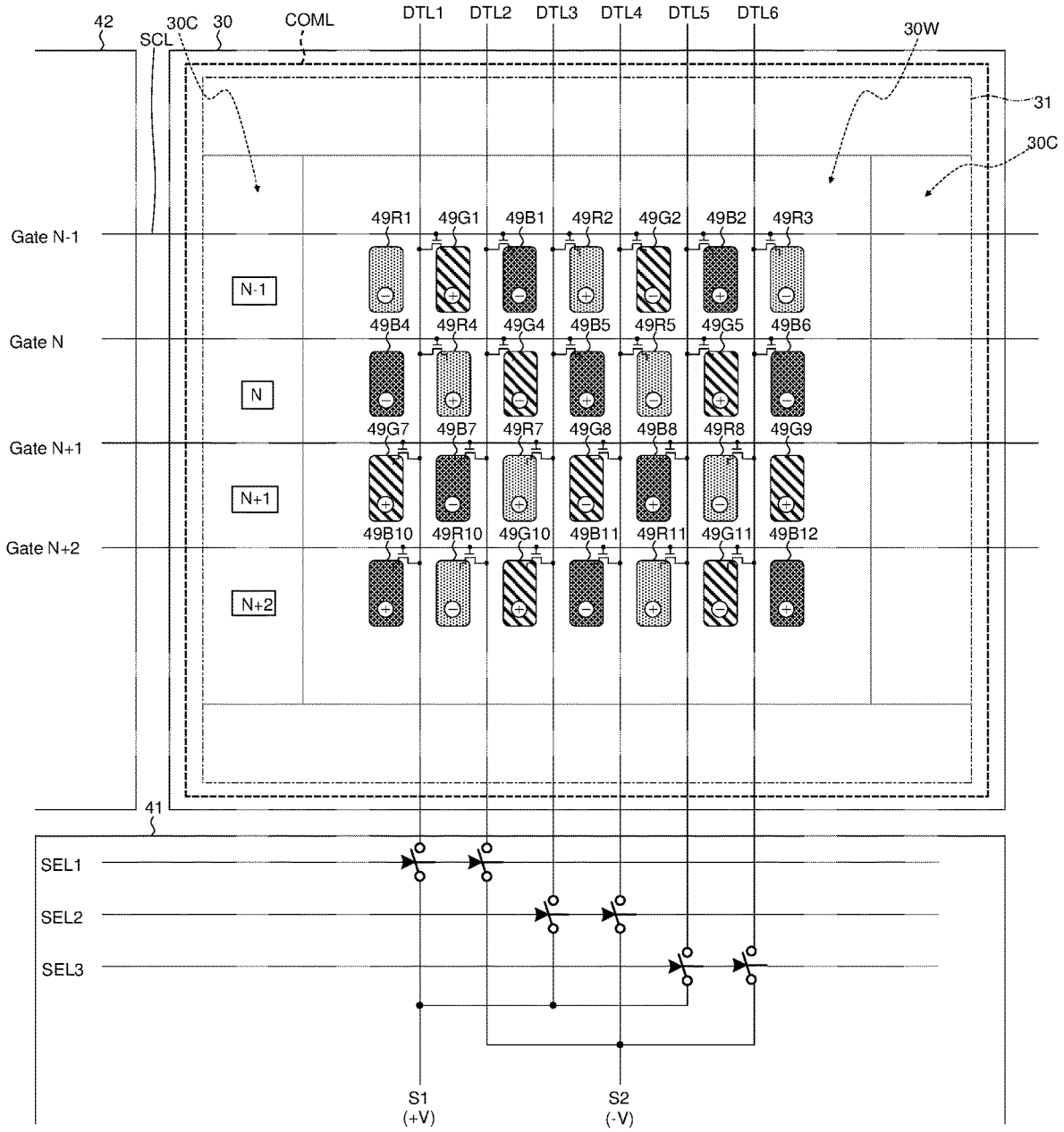
FIG. 3 is a schematic diagram illustrating an example of a pixel array and an internal configuration of a signal output circuit in a display device according to a comparative example.

FIG. 3 is a schematic diagram illustrating an example of the pixel array and an internal configuration of the signal output circuit in a display device according to a comparative example. The comparative example illustrated in FIG. 3 represents a configuration example including the first sub-pixels for displaying the first primary color (e.g., red), the second sub-pixels for displaying the second primary color (e.g., green), and the third sub-pixels for displaying the third primary color (e.g., blue).

Figure 4:
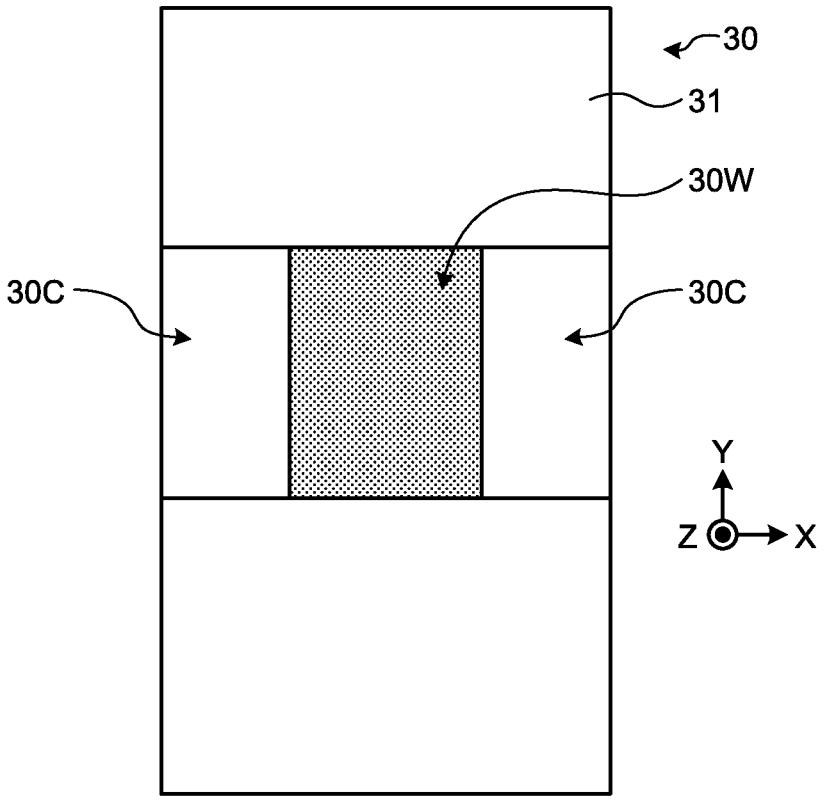
FIG. 4 is a schematic diagram illustrating a state where a single-colored window image is displayed at a central part of the image display panel.

FIG. 4 is a schematic diagram illustrating a state where a single-colored window image is displayed at a central part of the image display panel. In the example illustrated in FIG. 4, a single-colored window image 30W is displayed at a central part of a display region 31 of the image display panel 30.

In the comparative example illustrated in FIG. 3, the first sub-pixel (red), the second sub-pixel (green), and the third sub-pixel (blue) are sequentially arrayed in this order in each sub-pixel row in the display region 31 of the image display panel 30. These sub-pixels are arranged in the Y direction such that each of the first sub-pixel (red), the second sub-pixel (green), and the third sub-pixel (blue) belonging to a first sub-pixel row is shifted in the X direction by one sub-pixel with respect to a corresponding sub-pixel belonging to a second sub-pixel row adjacent to the first sub-pixel row.

Also in the comparative example illustrated in FIG. 3, in the display region 31 of the image display panel 30, each signal line DTL is coupled alternately in the Y direction to two consecutive sub-pixels 49 belonging to a first sub-pixel column and two consecutive sub-pixels 49 belonging to a second sub-pixel column adjacent to the first sub-pixel column. More specifically, an example is illustrated in which, in N−1th (where N is an integer of two or greater) and Nth sub-pixel rows, each signal line DTL is coupled to a part of the sub-pixels 49 belonging to a sub-pixel column on the right side in FIG. 3 of the signal line DTL, and, in N+1th and N+2th sub-pixel rows, each signal line DTL is coupled to a part of the sub-pixels 49 belonging to a sub-pixel column on the left side in FIG. 3 of the signal line DTL.

In the signal output circuit 41 according to the comparative example illustrated in FIG. 3, each of a first selector signal SEL1, a second selector signal SEL2, and a third selector signal SEL3 selects a pair of the signal lines DTL each supplied with either of a first source signal S1 and a second source signal S2 each having a mutually reverse polarity. For example, assuming a common electrode COML to have a reference potential, the first source signal S1 has a potential higher than the reference potential (hereinafter, referred to as a positive (+) polarity), and the second source signal S2 has a potential lower than the reference potential (hereinafter, referred to as a negative (−) polarity). The magnitude of the potential +V of the first source signal S1 relative to the potential of the common electrode COML is substantially equal to the magnitude of the potential −V of the second source signal S2 relative to the potential of the common electrode COML.

Specifically, a signal line DTL1 is supplied with the first source signal S1 having the positive (+) polarity selected by the first selector signal SEL1.

A signal line DTL2 is supplied with the second source signal S2 having the negative (−) polarity selected by the first selector signal SEL1.

A signal line DTL3 is supplied with the first source signal S1 having the positive (+) polarity selected by the second selector signal SEL2.

A signal line DTL4 is supplied with the second source signal S2 having the negative (−) polarity selected by the second selector signal SEL2.

A signal line DTL5 is supplied with the first source signal S1 having the positive (+) polarity selected by the third selector signal SEL3.

A signal line DTL6 is supplied with the second source signal S2 having the negative (−) polarity selected by the third selector signal SEL3.

Figure 5:
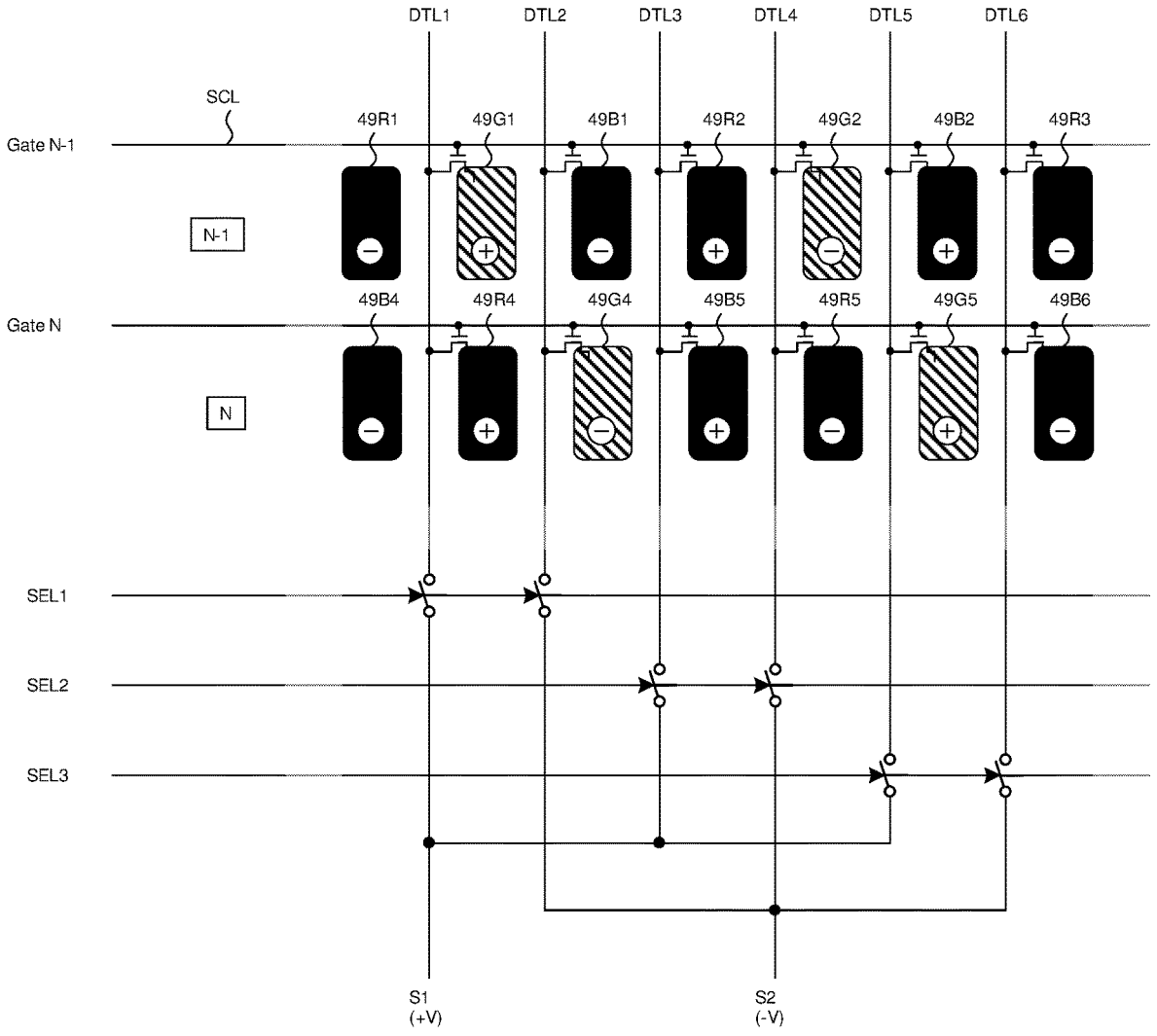
FIG. 5 is a diagram illustrating a state of an N−1th row and an Nth row when the window display illustrated in FIG. 4 is made in a second primary color (green) in the comparative example illustrated in FIG. 3.

The following describes potential changes of the signal lines DTL1 to DTL6 in the comparative example illustrated in FIG. 3 configured as described above. FIG. 5 is a diagram illustrating a state of the N−1th row and the Nth row when the window display illustrated in FIG. 4 is made in the second primary color (green) in the comparative example illustrated in FIG. 3.

When the scan circuit 42 selects Gate N−1 out of the scan lines SCL, a second sub-pixel 49G1 has the potential of the positive (+) polarity. When the scan circuit 42 selects Gate N out of the scan lines SCL, a first sub-pixel 49R4 is at 0 V because of displaying black. Thus, when the selection shifts from Gate N−1 to Gate N, the voltage of the signal line DTL1 changes in the negative (−) direction. More specifically, when the selection shifts from Gate N−1 to Gate N, the potential change of the signal line DTL1 is −V.

When the scan circuit 42 selects Gate N−1 out of the scan lines SCL, a third sub-pixel 49B1 is at 0 V because of displaying black. When the scan circuit 42 selects Gate N out of the scan lines SCL, a second sub-pixel 49G4 has the potential of the negative (−) polarity. Thus, when the selection shifts from Gate N−1 to Gate N, the voltage of the signal line DTL2 changes in the negative (−) direction. More specifically, when the selection shifts from Gate N−1 to Gate N, the potential change of the signal line DTL2 is −V.

When the scan circuit 42 selects Gate N−1 out of the scan lines SCL, a first sub-pixel 49R2 is at 0 V because of displaying black. When the scan circuit 42 selects Gate N out of the scan lines SCL, a third sub-pixel 49B5 is at 0 V because of displaying black. Thus, when the selection shifts from Gate N−1 to Gate N, the voltage of the signal line DTL3 does not change. More specifically, when the selection shifts from Gate N−1 to Gate N, the potential change of the signal line DTL3 is substantially zero (≈0).

When the scan circuit 42 selects Gate N−1 out of the scan lines SCL, a second sub-pixel 49G2 has the potential of the negative (−) polarity. When the scan circuit 42 selects Gate N out of the scan lines SCL, a first sub-pixel 49R5 is at 0 V because of displaying black. Thus, when the selection shifts from Gate N−1 to Gate N, the voltage of the signal line DTL4 changes in the positive (+) direction. More specifically, when the selection shifts from Gate N−1 to Gate N, the potential change of the signal line DTL4 is +V.

When the scan circuit 42 selects Gate N−1 out of the scan lines SCL, a third sub-pixel 49B2 is at 0 V because of displaying black. When the scan circuit 42 selects Gate N out of the scan lines SCL, a second sub-pixel 49G5 has the potential of the positive (+) polarity. Thus, when the selection shifts from Gate N−1 to Gate N, the voltage of the signal line DTL5 changes in the positive (+) direction. More specifically, when the selection shifts from Gate N−1 to Gate N, the potential change of the signal line DTL5 is +V.

When the scan circuit 42 selects Gate N−1 out of the scan lines SCL, a first sub-pixel 49R3 is at 0 V because of displaying black. When the scan circuit 42 selects Gate N out of the scan lines SCL, a third sub-pixel 49B6 is at 0 V because of displaying black. Thus, when the selection shifts from Gate N−1 to Gate N, the voltage of the signal line DTL6 does not change. More specifically, when the selection shifts from Gate N−1 to Gate N, the potential change of the signal line DTL6 is substantially zero (≈0).

Figure 6:
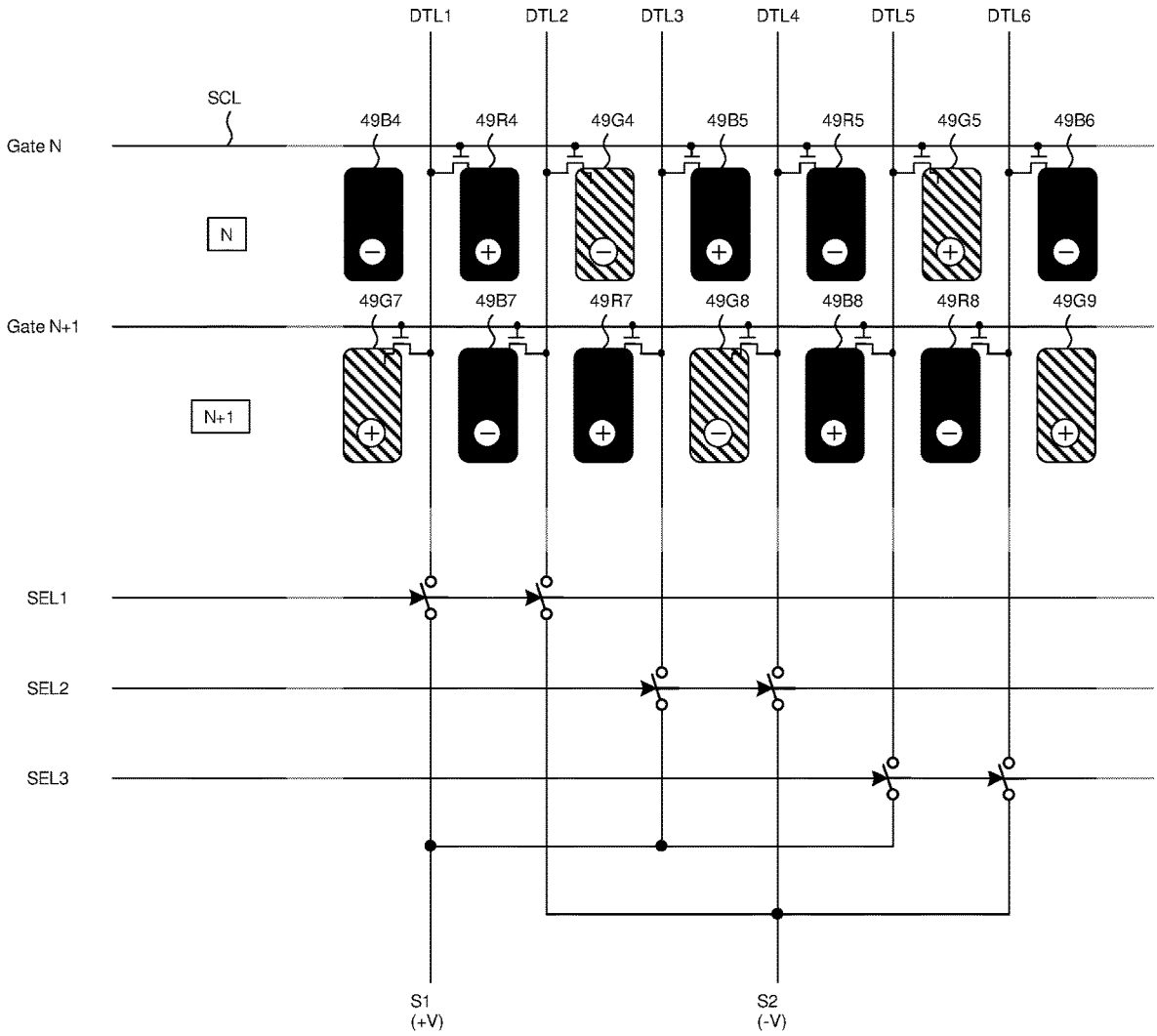
FIG. 6 is a diagram illustrating a state of the Nth row and an N+1th row when the window display illustrated in FIG. 4 is made in the second primary color (green) in the comparative example illustrated in FIG. 3.

FIG. 6 is a diagram illustrating a state of the Nth row and an N+1th row when the window display illustrated in FIG. 4 is made in the second primary color (green) in the comparative example illustrated in FIG. 3.

When the scan circuit 42 selects Gate N out of the scan lines SCL, the first sub-pixel 49R4 is at 0 V because of displaying black. When the scan circuit 42 selects Gate N+1 out of the scan lines SCL, a second sub-pixel 49G7 has the potential of the positive (+) polarity. Thus, when the selection shifts from Gate N to Gate N+1, the voltage of the signal line DTL1 changes in the positive (+) direction. More specifically, when the selection shifts from Gate N to Gate N+1, the potential change of the signal line DTL1 is +V.

When the scan circuit 42 selects Gate N out of the scan lines SCL, the second sub-pixel 49G4 has the potential of the negative (−) polarity. When the scan circuit 42 selects Gate N+1 out of the scan lines SCL, a third sub-pixel 49B7 is at 0 V because of displaying black. Thus, when the selection shifts from Gate N to Gate N+1, the voltage of the signal line DTL2 changes in the positive (+) direction. More specifically, when the selection shifts from Gate N to Gate N+1, the potential change of the signal line DTL2 is +V.

When the scan circuit 42 selects Gate N out of the scan lines SCL, the third sub-pixel 49B5 is at 0 V because of displaying black. When the scan circuit 42 selects Gate N+1 out of the scan lines SCL, a first sub-pixel 49R7 is at 0 V because of displaying black. Thus, when the selection shifts from Gate N to Gate N+1, the voltage of the signal line DTL3 does not change. More specifically, when the selection shifts from Gate N to Gate N+1, the potential change of the signal line DTL3 is substantially zero (≈0).

When the scan circuit 42 selects Gate N out of the scan lines SCL, the first sub-pixel 49R5 is at 0 V because of displaying black. When the scan circuit 42 selects Gate N+1 out of the scan lines SCL, a second sub-pixel 49G8 has the potential of the negative (−) polarity. Thus, when the selection shifts from Gate N to Gate N+1, the voltage of the signal line DTL4 changes in the negative (−) direction. More specifically, when the selection shifts from Gate N to Gate N+1, the potential change of the signal line DTL4 is −V.

When the scan circuit 42 selects Gate N out of the scan lines SCL, the second sub-pixel 49G5 has the potential of the positive (+) polarity. When the scan circuit 42 selects Gate N+1 out of the scan lines SCL, a third sub-pixel 49B8 is at 0 V because of displaying black. Thus, when the selection shifts from Gate N to Gate N+1, the voltage of the signal line DTL5 changes in the negative (−) direction. More specifically, when the selection shifts from Gate N to Gate N+1, the potential change of the signal line DTL5 is −V.

When the scan circuit 42 selects Gate N out of the scan lines SCL, the third sub-pixel 49B6 is at 0 V because of displaying black. When the scan circuit 42 selects Gate N+1 out of the scan lines SCL, a first sub-pixel 49R8 is at 0 V because of displaying black. Thus, when the selection shifts from Gate N to Gate N+1, the voltage of the signal line DTL6 does not change. More specifically, when the selection shifts from Gate N to Gate N+1, the potential change of the signal line DTL6 is substantially zero (≈0).

Figure 7:
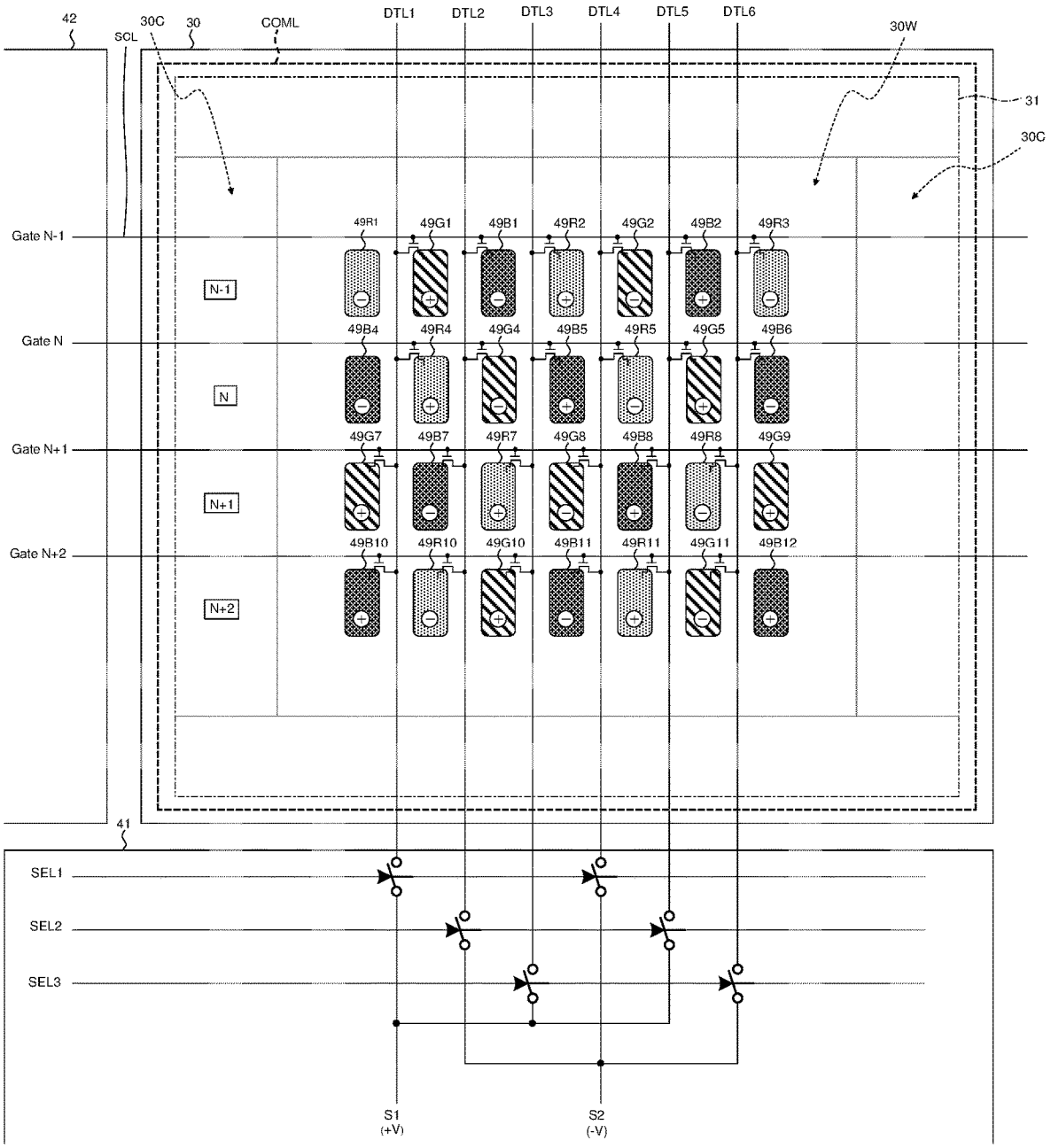
FIG. 7 is a schematic diagram illustrating an example of the pixel array and the internal configuration of the signal output circuit in the display device according to the embodiment.

FIG. 7 is a schematic diagram illustrating an example of the pixel array and the internal configuration of the signal output circuit in the display device according to the embodiment. In the example illustrated in FIG. 7, similarly to the comparative example illustrated in FIG. 3, the first sub-pixel (red), the second sub-pixel (green), and the third sub-pixel (blue) are sequentially arrayed in this order in each sub-pixel, and these sub-pixels are arranged in the Y direction such that each of the first sub-pixel (red), the second sub-pixel (green), and the third sub-pixel (blue) belonging to the first sub-pixel row is shifted in the X direction by one sub-pixel with respect to a corresponding sub-pixel belonging to the second sub-pixel row adjacent to the first sub-pixel row.

In the example illustrated in FIG. 7, similarly to the comparative example illustrated in FIG. 3, each signal line DTL is coupled alternately in the Y direction to two consecutive sub-pixels 49 belonging to the first sub-pixel column and two consecutive sub-pixels 49 belonging to the second sub-pixel column adjacent to the first sub-pixel column. Specifically, an example is illustrated in which, in the N−1th and Nth sub-pixel rows, each signal line DTL is coupled to a part of the sub-pixels 49 belonging to a sub-pixel column on the right side in FIG. 7 of the signal line DTL, and, in the N+1th and N+2th sub-pixel rows, each signal line DTL is coupled to a part of the sub-pixels 49 belonging to a sub-pixel column on the left side in FIG. 7 of the signal line DTL.

In the example illustrated in FIG. 7, similarly to the comparative example illustrated in FIG. 3, each of the first selector signal SEL1, the second selector signal SEL2, and the third selector signal SEL3 selects a pair of the signal lines DTL each supplied with either of the first source signal S1 and the second source signal S2 each having a mutually reverse polarity. The example illustrated in FIG. 7, however, differs from the comparative example illustrated in FIG. 3 in combination of signal lines selected by each of the first selector signal SEL1, the second selector signal SEL2, and the third selector signal SEL3. The magnitude of the potential +V of the first source signal S1 relative to the potential of the common electrode COML is substantially equal to the magnitude of the potential −V of the second source signal S2 relative to the potential of the common electrode COML.

Specifically, the signal line DTL1 is supplied with the first source signal S1 having the positive (+) polarity selected by the first selector signal SEL1.

The signal line DTL2 is supplied with the second source signal S2 having the negative (−) polarity selected by the second selector signal SEL2.

The signal line DTL3 is supplied with the first source signal S1 having the positive (+) polarity selected by the third selector signal SEL3.

The signal line DTL4 is supplied with the second source signal S2 having the negative (−) polarity selected by the first selector signal SEL1.

The signal line DTL5 is supplied with the first source signal S1 having the positive (+) polarity selected by the second selector signal SEL2.

The signal line DTL6 is supplied with the second source signal S2 having the negative (−) polarity selected by the third selector signal SEL3.

Figure 8:
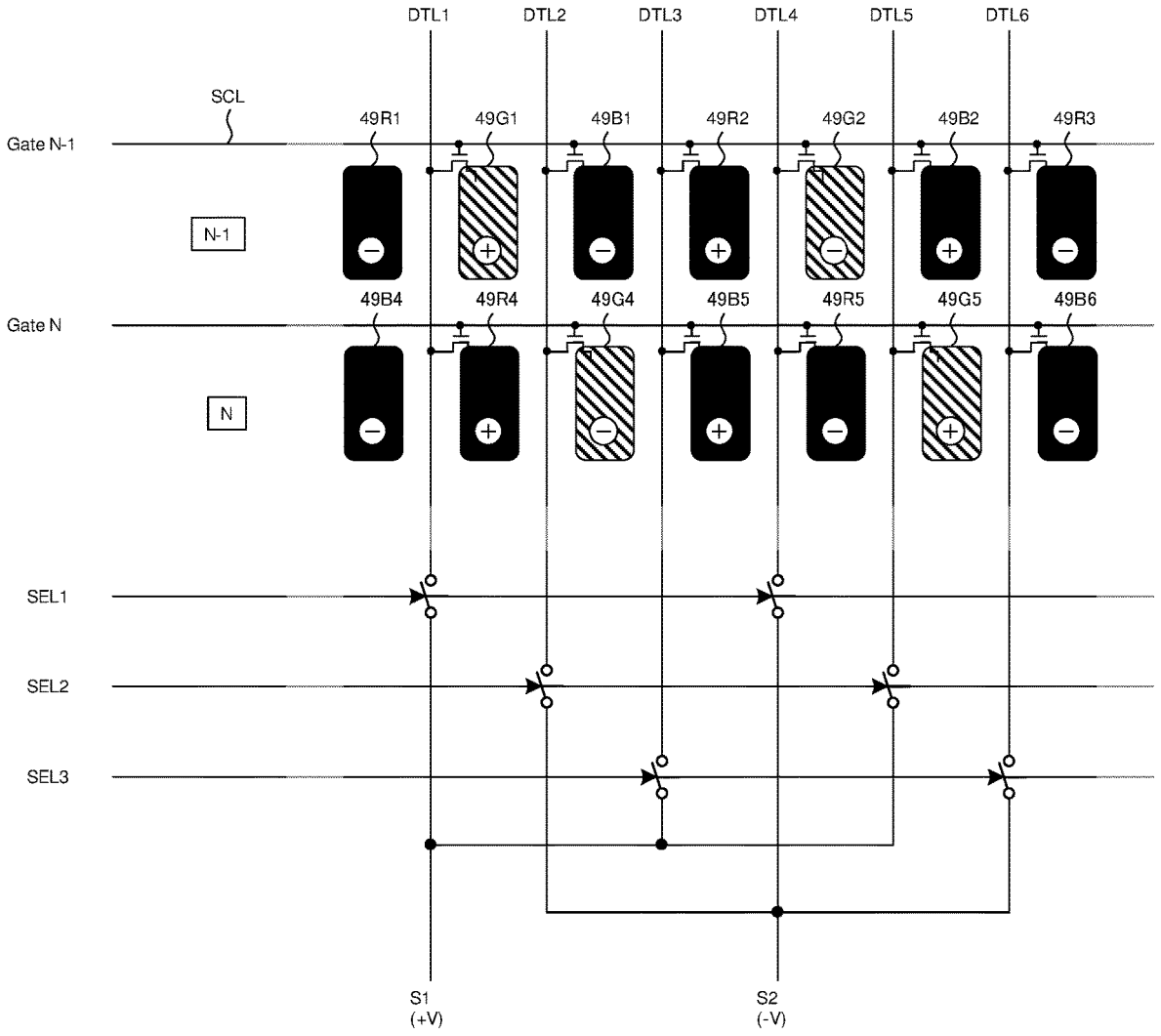
FIG. 8 is a diagram illustrating a state of the N−1th row and the Nth row when the window display illustrated in FIG. 4 is made in the second primary color (green) in the example illustrated in FIG. 7.

The following describes the potential changes of the signal lines DTL1 to DTL6 in the example illustrated in FIG. 7 configured as described above. FIG. 8 is a diagram illustrating a state of the N−1th row and the Nth row when the window image 30W illustrated in FIG. 4 is made in the second primary color (green) in the example illustrated in FIG. 7.

When Gate N−1 is selected, the second sub-pixel 49G1 has the potential of the positive (+) polarity. When Gate N is selected, the first sub-pixel 49R4 is at 0 V because of displaying black. Thus, when the selection shifts from Gate N−1 to Gate N, the voltage of the signal line DTL1 changes in the negative (−) direction. More specifically, when the selection shifts from Gate N−1 to Gate N, the potential change of the signal line DTL1 is −V.

When Gate N−1 is selected, the third sub-pixel 49B1 is at 0 V because of displaying black. When Gate N is selected, the second sub-pixel 49G4 has the potential of the negative (−) polarity. Thus, when the selection shifts from Gate N−1 to Gate N, the voltage of the signal line DTL2 changes in the negative (−) direction. More specifically, when the selection shifts from Gate N−1 to Gate N, the potential change of the signal line DTL2 is −V.

When Gate N−1 is selected, the first sub-pixel 49R2 is at 0 V because of displaying black. When Gate N is selected, the third sub-pixel 49B5 is at 0 V because of displaying black. Thus, when the selection shifts from Gate N−1 to Gate N, the voltage of the signal line DTL3 does not change. More specifically, when the selection shifts from Gate N−1 to Gate N, the potential change of the signal line DTL3 is substantially zero (≈0).

When Gate N−1 is selected, the second sub-pixel 49G2 has the potential of the negative (−) polarity. When Gate N is selected, the first sub-pixel 49R5 is at 0 V because of displaying black. Thus, when the selection shifts from Gate N−1 to Gate N, the voltage of the signal line DTL4 changes in the positive (+) direction. More specifically, when the selection shifts from Gate N−1 to Gate N, the potential change of the signal line DTL4 is +V.

When Gate N−1 is selected, the third sub-pixel 49B2 is at 0 V because of displaying black. When Gate N is selected, the second sub-pixel 49G5 has the potential of the positive (+) polarity. Thus, when the selection shifts from Gate N−1 to Gate N, the voltage of the signal line DTL5 changes in the positive (+) direction. More specifically, when the selection shifts from Gate N−1 to Gate N, the potential change of the signal line DTL5 is +V.

When Gate N−1 is selected, the first sub-pixel 49R3 is at 0 V because of displaying black. When Gate N is selected, the third sub-pixel 49B6 is at 0 V because of displaying black. Thus, when the selection shifts from Gate N−1 to Gate N, the voltage of the signal line DTL6 does not change. More specifically, when the selection shifts from Gate N−1 to Gate N, the potential change of the signal line DTL6 is substantially zero (≈0).

Figure 9:
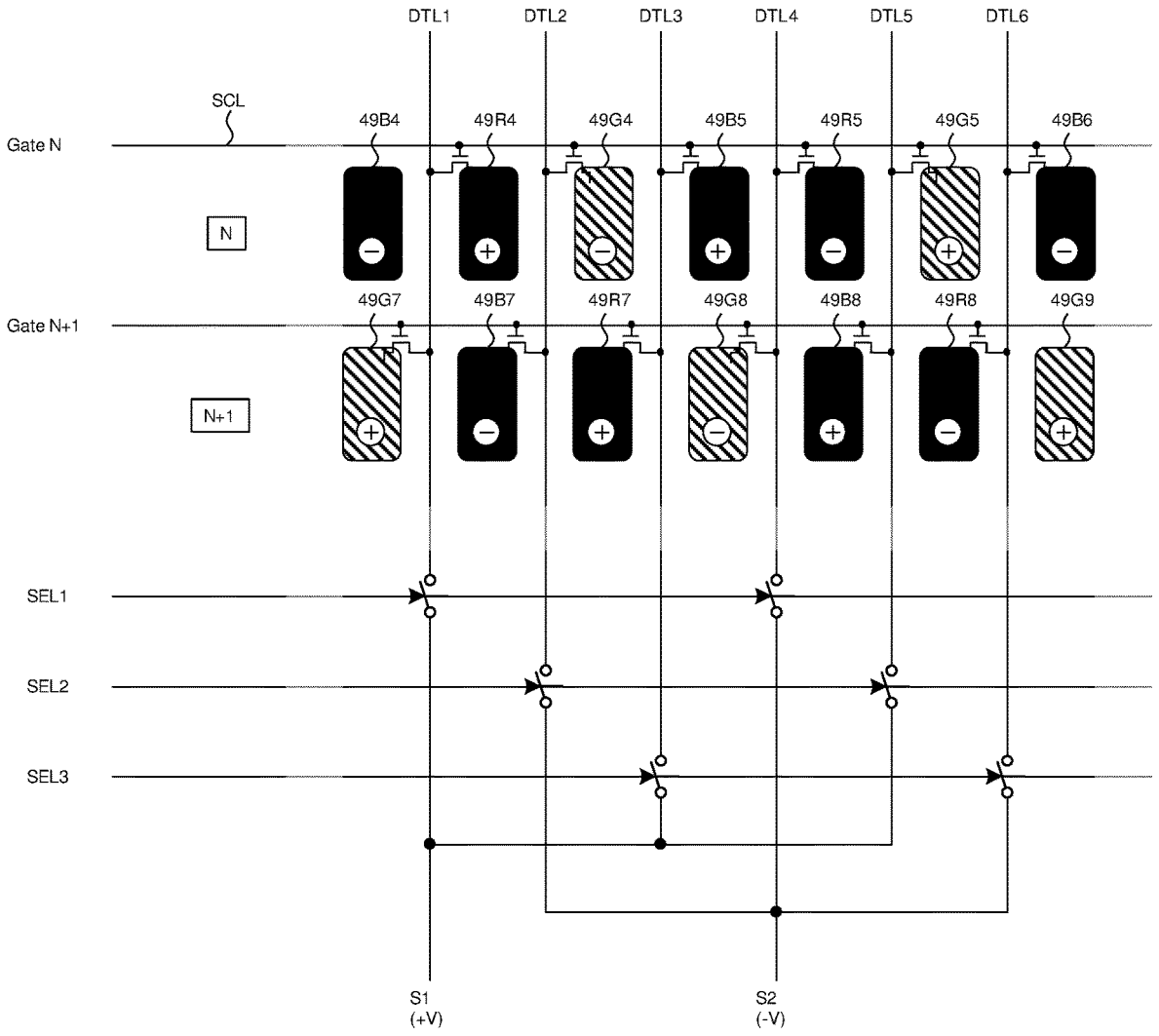
FIG. 9 is a diagram illustrating a state of the Nth row and the N+1th row when the window display illustrated in FIG. 4 is made in the second primary color (green) in the example illustrated in FIG. 7.

FIG. 9 is a diagram illustrating a state of the Nth row and the N+1th row when the window display illustrated in FIG. 4 is made in the second primary color (green) in the example illustrated in FIG. 7.

When Gate N is selected, the first sub-pixel 49R4 is at 0 V because of displaying black. When Gate N+1 is selected, the second sub-pixel 49G7 has the potential of the positive (+) polarity. Thus, when the selection shifts from Gate N to Gate N+1, the voltage of the signal line DTL1 changes in the positive (+) direction. More specifically, when the selection shifts from Gate N to Gate N+1, the potential change of the signal line DTL1 is +V.

When Gate N is selected, the second sub-pixel 49G4 has the potential of the negative (−) polarity. When Gate N+1 is selected, the third sub-pixel 49B7 is at 0 V because of displaying black. Thus, when the selection shifts from Gate N to Gate N+1, the voltage of the signal line DTL2 changes in the positive (+) direction. More specifically, when the selection shifts from Gate N to Gate N+1, the potential change of the signal line DTL2 is +V.

When Gate N is selected, the third sub-pixel 49B5 is at 0 V because of displaying black. When Gate N+1 is selected, the first sub-pixel 49R7 is at 0 V because of displaying black. Thus, when the selection shifts from Gate N to Gate N+1, the voltage of the signal line DTL5 does not change. More specifically, when the selection shifts from Gate N to Gate N+1, the potential change of the signal line DTL3 is substantially zero (≈0).

When Gate N is selected, the first sub-pixel 49R5 is at 0 V because of displaying black. When Gate N+1 is selected, the second sub-pixel 49G8 has the potential of the negative (−) polarity. Thus, when the selection shifts from Gate N to Gate N+1, the voltage of the signal line DTL4 changes in the negative (−) direction. More specifically, when the selection shifts from Gate N to Gate N+1, the potential change of the signal line DTL4 is −V.

When Gate N is selected, the second sub-pixel 49G5 has the potential of the positive (+) polarity. When Gate N+1 is selected, the third sub-pixel 49B8 is at 0 V because of displaying black. Thus, when the selection shifts from Gate N to Gate N+1, the voltage of the signal line DTL5 changes in the negative (−) direction. More specifically, when the selection shifts from Gate N to Gate N+1, the potential change of the signal line DTL5 is −V.

When Gate N is selected, the third sub-pixel 49B6 is at 0 V because of displaying black. When Gate N+1 is selected, the first sub-pixel 49R8 is at 0 V because of displaying black. Thus, when the selection shifts from Gate N to Gate N+1, the voltage of the signal line DTL6 does not change. More specifically, when the selection shifts from Gate N to Gate N+1, the potential change of the signal line DTL6 is substantially zero (≈0).

FIG. 10 is a table indicating the potential changes of the respective signal lines in the comparative example illustrated in FIG. 3. FIG. 11 is a table indicating the potential changes of the respective signal lines in the example illustrated in FIG. 7.

The examples illustrated in FIGS. 10 and 11 illustrate the potential change of each signal line DTL and the sum of the potential changes of the respective signal lines DTL selected by each selector signal when the selection of the scan line SCL shifts from Gate N−1 to Gate N, and illustrate the potential change of each signal line DTL and the sum of the potential changes of the respective signal lines DTL selected by each of the selector signals when the selection of the scan line SCL shifts from Gate N to Gate N+1.

As illustrated in FIG. 10, in the comparative example illustrated in FIG. 3, when the selection of the scan line SCL shifts from Gate N−1 to Gate N, the sum of the potential changes of the signal line DTL1 and the signal line DTL2 selected by the first selector signal SEL1 is −2V. When the selection of the scan line SCL shifts from Gate N−1 to Gate N, the sum of the potential changes of the signal line DTL3 and the signal line DTL4 selected by the second selector signal SEL2 is +V. When the selection of the scan line SCL shifts from Gate N−1 to Gate N, the sum of the potential changes of the signal line DTL5 and the signal line DTL6 selected by the third selector signal SEL3 is +V.

As illustrated in FIG. 10, in the comparative example illustrated in FIG. 3, when the selection of the scan line SCL shifts from Gate N to Gate N+1, the sum of the potential changes of the signal line DTL1 and the signal line DTL2 selected by the first selector signal SEL1 is +2V. When the selection of the scan line SCL shifts from Gate N to Gate N+1, the sum of the potential changes of the signal line DTL3 and the signal line DTL4 selected by the second selector signal SEL2 is −V. When the selection of the scan line SCL shifts from Gate N to Gate N+1, the sum of the potential changes of the signal line DTL5 and the signal line DTL6 selected by the third selector signal SEL3 is −V.

Meanwhile, in the case of the example illustrated in FIG. 7, FIG. 11 indicates that in both events when the selection of the scan line SCL shifts from Gate N−1 to Gate N and when the selection of the scan line SCL shifts from Gate N to Gate N+1, the sum of the potential changes of the signal line DTL1 and the signal line DTL4 selected by the first selector signal SEL1 is substantially zero (≈0). The sum of the potential changes of the signal line DTL2 and the signal line DTL5 selected by the second selector signal SEL2 is also substantially zero (≈0). Further, the sum of the potential changes of the signal line DTL3 and the signal line DTL6 selected by the third selector signal SEL3 is also substantially zero (≈0).

The inventors of the present disclosure have found the following as illustrated in FIG. 3: When the selection of the scan line SCL shifts with the single-colored window image 30W being displayed at the central part of the display region 31 of the image display panel 30, regions 30C on both sides in the X-direction (first direction) of the window image 30W are brightened (or darkened) if the sum of the potential changes of the respective signal lines DTL selected by each of the selector signals is not substantially zero (≈0).

Coupling capacitance C acts between the common electrode COML and the signal lines DTL. As a result, when the selection of the scan line SCL shifts and the sum of the potential changes of the respective signal lines DTL selected by each of the selector signals is biased toward the positive (+) direction or the negative (−) direction, the potential of the common electrode COML is changed by the coupling capacitance C acting between the common electrode COML and the signal lines DTL. Consequently, in the case of the comparative example illustrated in FIG. 3, when the selection of the scan line SCL shifts and the sum of the potential changes of the respective signal lines DTL selected by each of the selector signals is not substantially zero (≈0), the potential change of the common electrode COML may cause crosstalk that deteriorates display quality in the X-direction (first direction).

As described above, in the display device 10 according to the embodiment illustrated in FIG. 7, the sum of the potential changes of the respective signal lines selected by each of the selector signals is substantially zero (≈0) when the selection of the scan line SCL shifts. In this manner, the configuration, in which the sum of the potential changes of the respective signal lines selected by each of the selector signals is substantially zero (≈0) when each of the sub-pixel columns is sequentially selected, can prevent the deterioration in display quality caused by the crosstalk.

The examples described above illustrate the cases where the window image 30W illustrated in FIG. 4 is displayed in the second primary color (green). The same applies to cases where the window image 30W illustrated in FIG. 4 is displayed in other colors.

Figure 12:
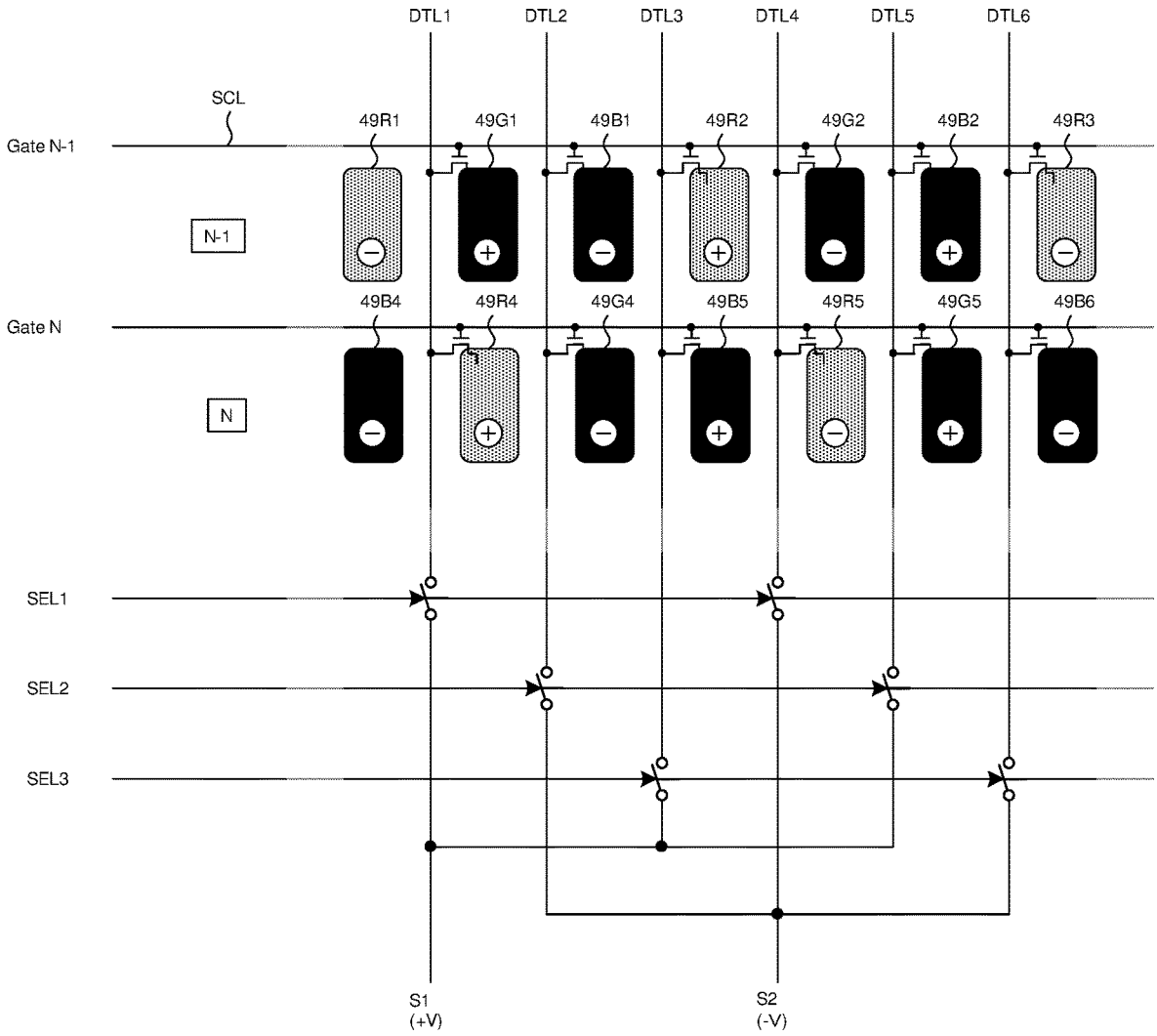
FIG. 12 is a diagram illustrating a state of the N−1th row and the Nth row when the window display illustrated in FIG. 4 is made in a first primary color (red) in the example illustrated in FIG. 7.

FIG. 12 is a diagram illustrating a state of the N−1th row and the Nth row when the window display illustrated in FIG. 4 is made in the first primary color (red) in the example illustrated in FIG. 7.

When Gate N−1 is selected, the second sub-pixel 49G1 is at 0 V because of displaying black. When Gate N is selected, the first sub-pixel 49R4 has the potential of the positive (+) polarity. Thus, when the selection shifts from Gate N−1 to Gate N, the voltage of the signal line DTL1 changes in the positive (+) direction. More specifically, when the selection shifts from Gate N−1 to Gate N, the potential change of the signal line DTL1 is +V.

When Gate N−1 is selected, the third sub-pixel 49B1 is at 0 V because of displaying black. When Gate N is selected, the second sub-pixel 49G4 is at 0 V because of displaying black. Thus, when the selection shifts from Gate N−1 to Gate N, the voltage of the signal line DTL2 does not change. More specifically, when the selection shifts from Gate N−1 to Gate N, the potential change of the signal line DTL2 is substantially zero (≈0).

When Gate N−1 is selected, the first sub-pixel 49R2 has the potential of the positive (+) polarity. When Gate N is selected, the third sub-pixel 49B5 is at 0 V because of displaying black. Thus, when the selection shifts from Gate N−1 to Gate N, the voltage of the signal line DTL3 changes in the negative (−) direction. More specifically, when the selection shifts from Gate N−1 to Gate N, the potential change of the signal line DTL3 is −V.

When Gate N−1 is selected, the second sub-pixel 49G2 is at 0 V because of displaying black. When Gate N is selected, the first sub-pixel 49R5 has the potential of the negative (−) polarity. Thus, when the selection shifts from Gate N−1 to Gate N, the voltage of the signal line DTL4 changes in the negative (−) direction. More specifically, when the selection shifts from Gate N−1 to Gate N, the potential change of the signal line DTL4 is −V.

When Gate N−1 is selected, the third sub-pixel 49B2 is at 0 V because of displaying black. When Gate N is selected, the second sub-pixel 49G5 is at 0 V because of displaying black. Thus, when the selection shifts from Gate N−1 to Gate N, the voltage of the signal line DTL5 does not change. More specifically, when the selection shifts from Gate N−1 to Gate N, the potential change of the signal line DTL5 is substantially zero (≈0).

When Gate N−1 is selected, the first sub-pixel 49R3 has the potential of the negative (−) polarity. When Gate N is selected, the third sub-pixel 49B6 is at 0 V because of displaying black. Thus, when the selection shifts from Gate N−1 to Gate N, the voltage of the signal line DTL6 changes in the positive (+) direction. More specifically, when the selection shifts from Gate N−1 to Gate N, the potential change of the signal line DTL6 is +V.

Figure 13:
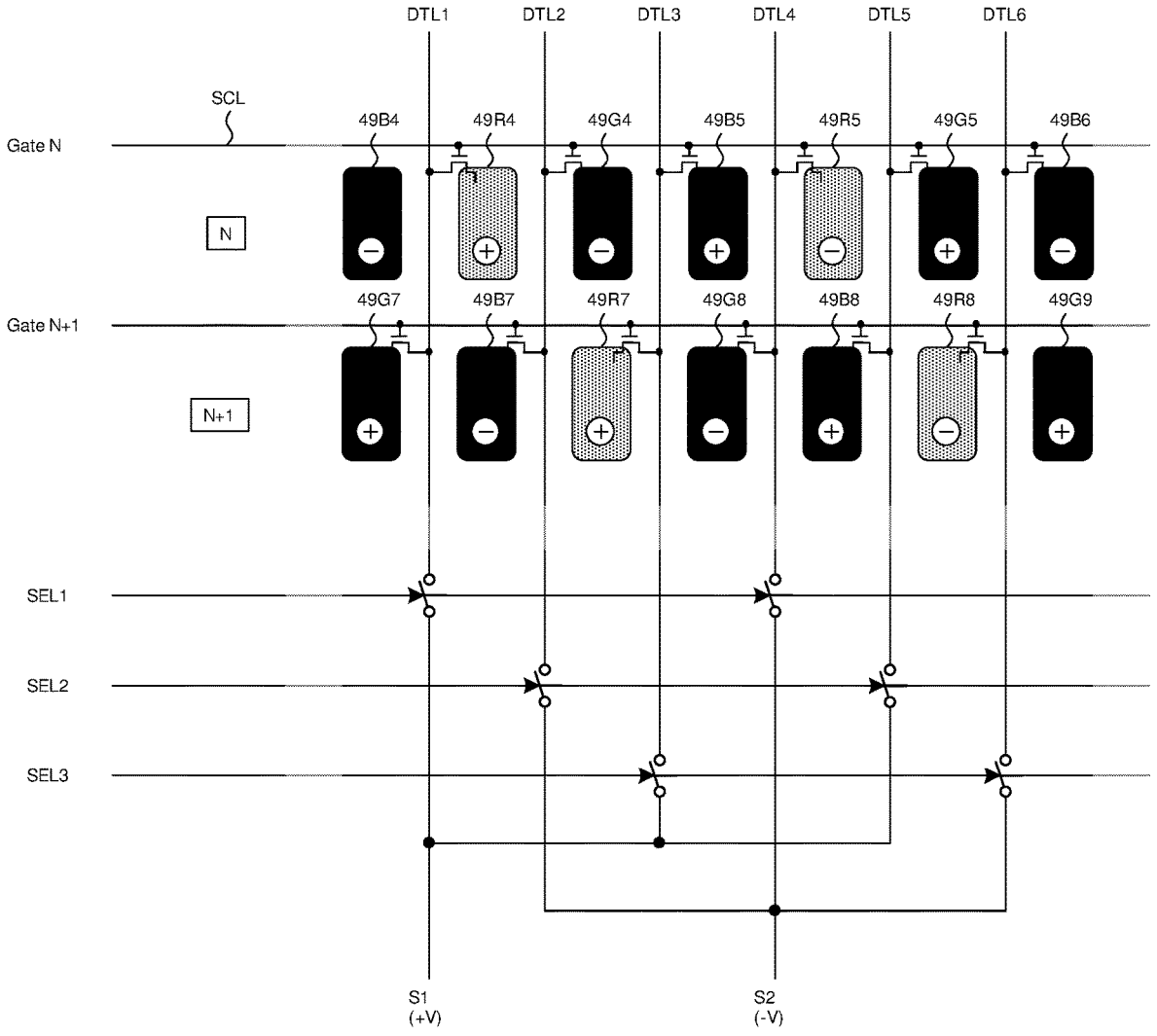
FIG. 13 is a diagram illustrating a state of the Nth row and the N+1th row when the window display illustrated in FIG. 4 is made in the first primary color (red) in the example illustrated in FIG. 7.

FIG. 13 is a diagram illustrating a state of the Nth row and the N+1th row when the window display illustrated in FIG. 4 is made in the first primary color (red) in the example illustrated in FIG. 7.

When Gate N is selected, the first sub-pixel 49R4 has the potential of the positive (+) polarity. When Gate N+1 is selected, the second sub-pixel 49G7 is at 0 V because of displaying black. Thus, when the selection shifts from Gate N to Gate N+1, the voltage of the signal line DTL1 changes in the negative (−) direction. More specifically, when the selection shifts from Gate N to Gate N+1, the potential change of the signal line DTL1 is −V.

When Gate N is selected, the second sub-pixel 49G4 is at 0 V because of displaying black. When Gate N+1 is selected, the third sub-pixel 49B7 is at 0 V because of displaying black. Thus, when the selection shifts from Gate N to Gate N+1, the voltage of the signal line DTL2 does not change. More specifically, when the selection shifts from Gate N to Gate N+1, the potential change of the signal line DTL2 is substantially zero (≈0).

When Gate N is selected, the third sub-pixel 49B5 is at 0 V because of displaying black. When Gate N+1 is selected, the first sub-pixel 49R7 has the potential of the positive (+) polarity. Thus, when the selection shifts from Gate N to Gate N+1, the voltage of the signal line DTL3 changes in the positive (+) direction. More specifically, when the selection shifts from Gate N to Gate N+1, the potential change of the signal line DTL3 is +V.

When Gate N is selected, the first sub-pixel 49R5 has the potential of the negative (−) polarity. When Gate N+1 is selected, the second sub-pixel 49G8 is at 0 V because of displaying black. Thus, when the selection shifts from Gate N to Gate N+1, the voltage of the signal line DTL4 changes in the positive (+) direction. More specifically, when the selection shifts from Gate N to Gate N+1, the potential change of the signal line DTL4 is +V.

When Gate N is selected, the second sub-pixel 49G5 is at 0 V because of displaying black. When Gate N+1 is selected, the third sub-pixel 49B8 is at 0 V because of displaying black. Thus, when the selection shifts from Gate N to Gate N+1, the voltage of the signal line DTL5 does not change. More specifically, when the selection shifts from Gate N to Gate N+1, the potential change of the signal line DTL5 is substantially zero (≈0).

When Gate N is selected, the third sub-pixel 49B6 is at 0 V because of displaying black. When Gate N+1 is selected, the first sub-pixel 49R8 has the potential of the negative (−) polarity. Thus, when the selection shifts from Gate N to Gate N+1, the voltage of the signal line DTL6 changes in the negative (−) direction. More specifically, when the selection shifts from Gate N to Gate N+1, the potential change of the signal line DTL6 is −V.

FIG. 14 is a table indicating the potential changes of the respective signal lines when the window display illustrated in FIG. 4 is made in the first primary color (red) in the example illustrated in FIG. 7.

As illustrated in FIG. 14, in both events when the selection of the scan line SCL shifts from Gate N−1 to Gate N and when the selection of the scan line SCL shifts from Gate N to Gate N+1, the sum of the potential changes of the signal line DTL1 and the signal line DTL4 selected by the first selector signal SEL1 is substantially zero (≈0). The sum of the potential changes of the signal line DTL2 and the signal line DTL5 selected by the second selector signal SEL2 is also substantially zero (≈0). Further, the sum of the potential changes of the signal line DTL5 and the signal line DTL6 selected by the third selector signal SEL3 is also substantially zero (≈0).

Figure 15:
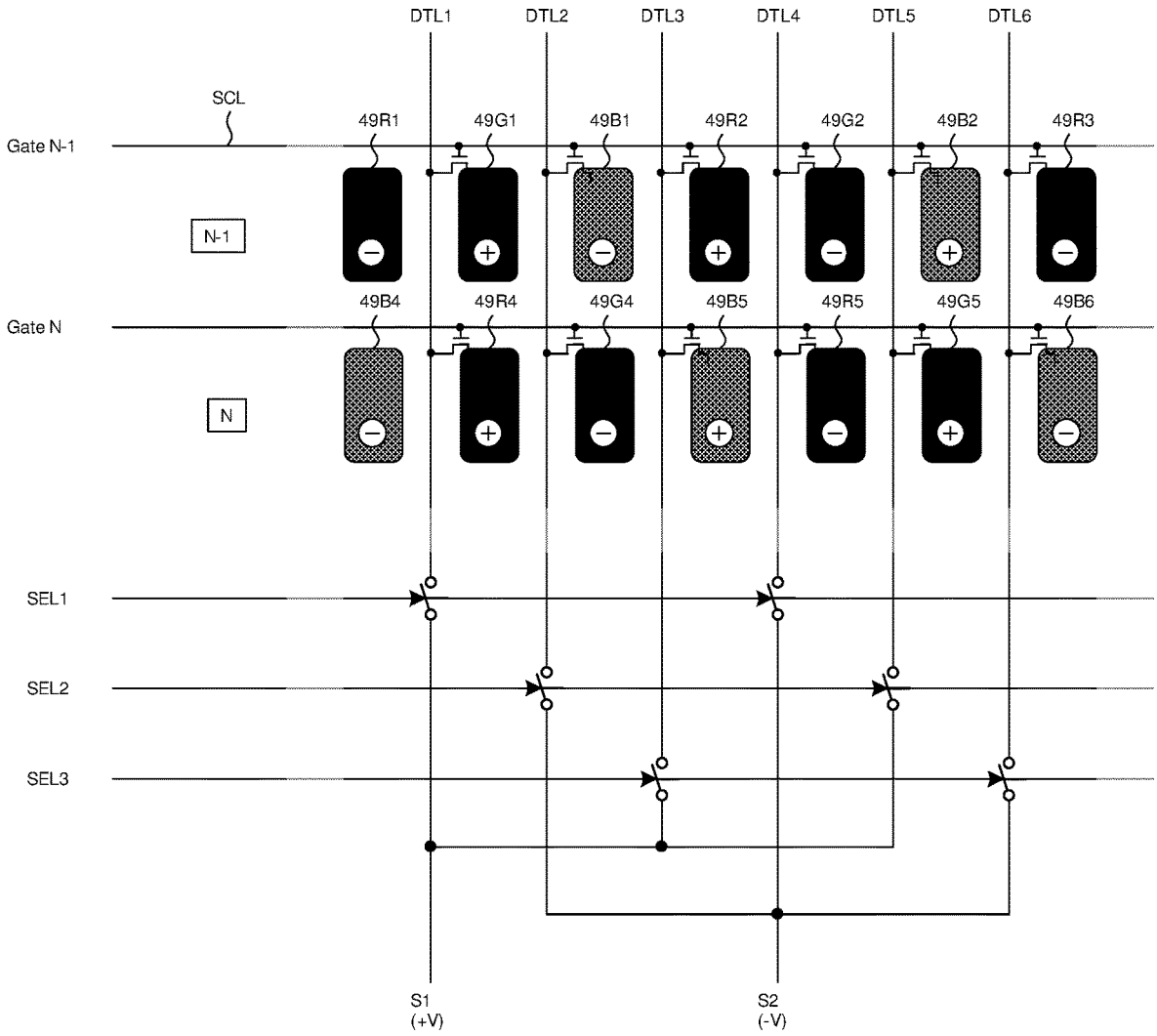
FIG. 15 is a diagram illustrating a state of the N−1th row and the Nth row when the window display illustrated in FIG. 4 is made in a third primary color (blue) in the example illustrated in FIG. 7.

FIG. 15 is a diagram illustrating a state of the N−1th row and the Nth row when the window display illustrated in FIG. 4 is made in the third primary color (blue) in the example illustrated in FIG. 7.

When Gate N−1 is selected, the second sub-pixel 49G1 is at 0 V because of displaying black. When Gate N is selected, the first sub-pixel 49R4 is at 0 V because of displaying black. Thus, when the selection shifts from Gate N−1 to Gate N, the voltage of the signal line DTL1 does not change. More specifically, when the selection shifts from Gate N−1 to Gate N, the potential change of the signal line DTL1 is substantially zero (≈0).

When Gate N−1 is selected, the third sub-pixel 49B1 has the potential of the negative (−) polarity. When Gate N is selected, the second sub-pixel 49G4 is at 0 V because of displaying black. Thus, when the selection shifts from Gate N−1 to Gate N, the voltage of the signal line DTL2 changes in the positive (+) direction. More specifically, when the selection shifts from Gate N−1 to Gate N, the potential change of the signal line DTL2 is +V.

When Gate N−1 is selected, the first sub-pixel 49R2 is at 0 V because of displaying black. When Gate N is selected, the third sub-pixel 49B5 has the potential of the positive (+) polarity. Thus, when the selection shifts from Gate N−1 to Gate N, the voltage of the signal line DTL3 changes in the positive (+) direction. More specifically, when the selection shifts from Gate N−1 to Gate N, the potential change of the signal line DTL3 is +V.

When Gate N−1 is selected, the second sub-pixel 49G2 is at 0 V because of displaying black. When Gate N is selected, the first sub-pixel 49R5 is at 0 V because of displaying black. Thus, when the selection shifts from Gate N−1 to Gate N, the voltage of the signal line DTL4 does not change. More specifically, when the selection shifts from Gate N−1 to Gate N, the potential change of the signal line DTL4 is substantially zero (≈0).

When Gate N−1 is selected, the third sub-pixel 49B2 has the potential of the positive (+) polarity. When Gate N is selected, the second sub-pixel 49G5 is at 0 V because of displaying black. Thus, when the selection shifts from Gate N−1 to Gate N, the voltage of the signal line DTL5 changes in the negative (−) direction. More specifically, when the selection shifts from Gate N−1 to Gate N, the potential change of the signal line DTL5 is −V.

When Gate N−1 is selected, the first sub-pixel 49R3 is at 0 V because of displaying black. When Gate N is selected, the third sub-pixel 49B6 has the potential of the negative (−) polarity. Thus, when the selection shifts from Gate N−1 to Gate N, the voltage of the signal line DTL6 changes in the negative (−) direction. More specifically, when the selection shifts from Gate N−1 to Gate N, the potential change of the signal line DTL6 is −V.

FIG. 16 is a table indicating the potential changes of the respective signal lines when the window display illustrated in FIG. 4 is made in the third primary color (blue) in the example illustrated in FIG. 7.

As illustrated in FIG. 16, when the selection of the scan line SCL shifts from Gate N−1 to Gate N, the sum of the potential changes of the signal line DTL1 and the signal line DTL4 selected by the first selector signal SEL1 is substantially zero (≈0). The sum of the potential changes of the signal line DTL2 and the signal line DTL5 selected by the second selector signal SEL2 is also substantially zero (≈0). Further, the sum of the potential changes of the signal line DTL3 and the signal line DTL6 selected by the third selector signal SEL3 is also substantially zero (≈0).

Figure 17:
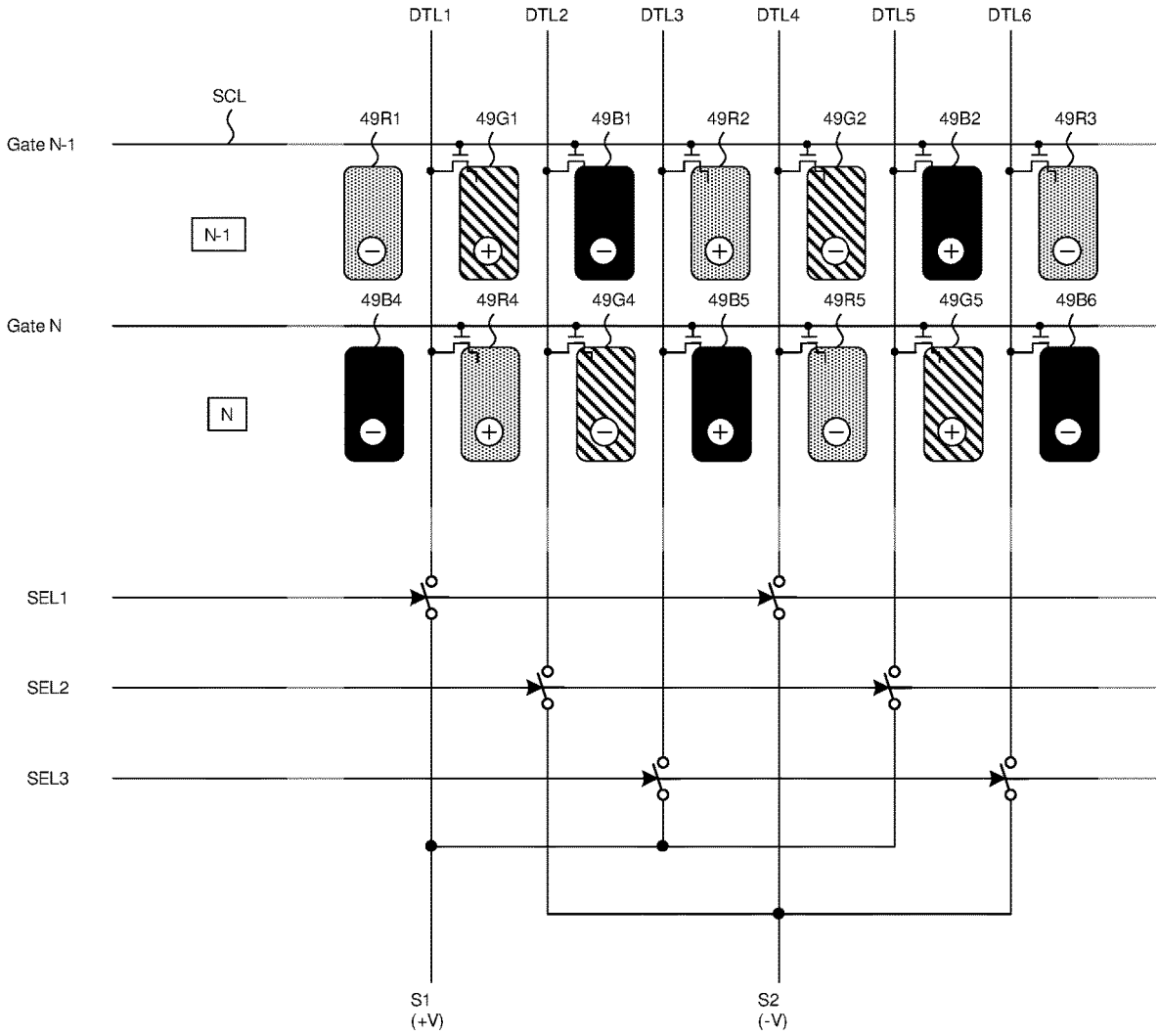
FIG. 17 is a diagram illustrating a state of the N−1th row and the Nth row when the window display illustrated in FIG. 4 is made in yellow in the example illustrated in FIG. 7.

FIG. 17 is a diagram illustrating a state of the N−1th row and the Nth row when the window display illustrated in FIG. 4 is made in yellow in the example illustrated in FIG. 7.

When Gate N−1 is selected, the second sub-pixel 49G1 has the potential of the positive (+) polarity. When Gate N is selected, the first sub-pixel 49R4 has the potential of the positive (+) polarity. Thus, when the selection shifts from Gate N−1 to Gate N, the voltage of the signal line DTL1 does not change. More specifically, when the selection shifts from Gate N−1 to Gate N, the potential change of the signal line DTL1 is substantially zero (≈0).

When Gate N−1 is selected, the third sub-pixel 49B1 is at 0 V because of displaying black. When Gate N is selected, the second sub-pixel 49G4 has the potential of the negative (−) polarity. Thus, when the selection shifts from Gate N−1 to Gate N, the voltage of the signal line DTL2 changes in the negative (−) direction. More specifically, when the selection shifts from Gate N−1 to Gate N, the potential change of the signal line DTL2 is −V.

When Gate N−1 is selected, the first sub-pixel 49R2 has the potential of the positive (+) polarity. When Gate N is selected, the third sub-pixel 49B5 is at 0 V because of displaying black. Thus, when the selection shifts from Gate N−1 to Gate N, the voltage of the signal line DTL3 changes in the negative (−) direction. More specifically, when the selection shifts from Gate N−1 to Gate N, the potential change of the signal line DTL3 is −V.

When Gate N−1 is selected, the second sub-pixel 49G2 has the potential of the negative (−) polarity. When Gate N is selected, the first sub-pixel 49R5 has the potential of the negative (−) polarity. Thus, when the selection shifts from Gate N−1 to Gate N, the voltage of the signal line DTL4 does not change. More specifically, when the selection shifts from Gate N−1 to Gate N, the potential change of the signal line DTL4 is substantially zero (≈0).

When Gate N−1 is selected, the third sub-pixel 49B2 is at 0 V because of displaying black. When Gate N is selected, the second sub-pixel 49G5 has the potential of the positive (+) polarity. Thus, when the selection shifts from Gate N−1 to Gate N, the voltage of the signal line DTL5 changes in the positive (+) direction. More specifically, when the selection shifts from Gate N−1 to Gate N, the potential change of the signal line DTL5 is +V.

When Gate N−1 is selected, the first sub-pixel 49R3 has the potential of the negative (−) polarity. When Gate N is selected, the third sub-pixel 49B6 is at 0 V because of displaying black. Thus, when the selection shifts from Gate N−1 to Gate N, the voltage of the signal line DTL6 changes in the positive (+) direction. More specifically, when the selection shifts from Gate N−1 to Gate N, the potential change of the signal line DTL6 is +V.

FIG. 18 is a table indicating the potential changes of the respective signal lines when the window display illustrated in FIG. 4 is made in yellow in the example illustrated in FIG. 7.

As illustrated in FIG. 18, when the selection of the scan line SCL shifts from Gate N−1 to Gate N, the sum of the potential changes of the signal line DTL1 and the signal line DTL4 selected by the first selector signal SEL1 is substantially zero (≈0). The sum of the potential changes of the signal line DTL2 and the signal line DTL5 selected by the second selector signal SEL2 is also substantially zero (≈0). Further, the sum of the potential changes of the signal line DTL3 and the signal line DTL6 selected by the third selector signal SEL3 is also substantially zero (≈0).

Figure 19:
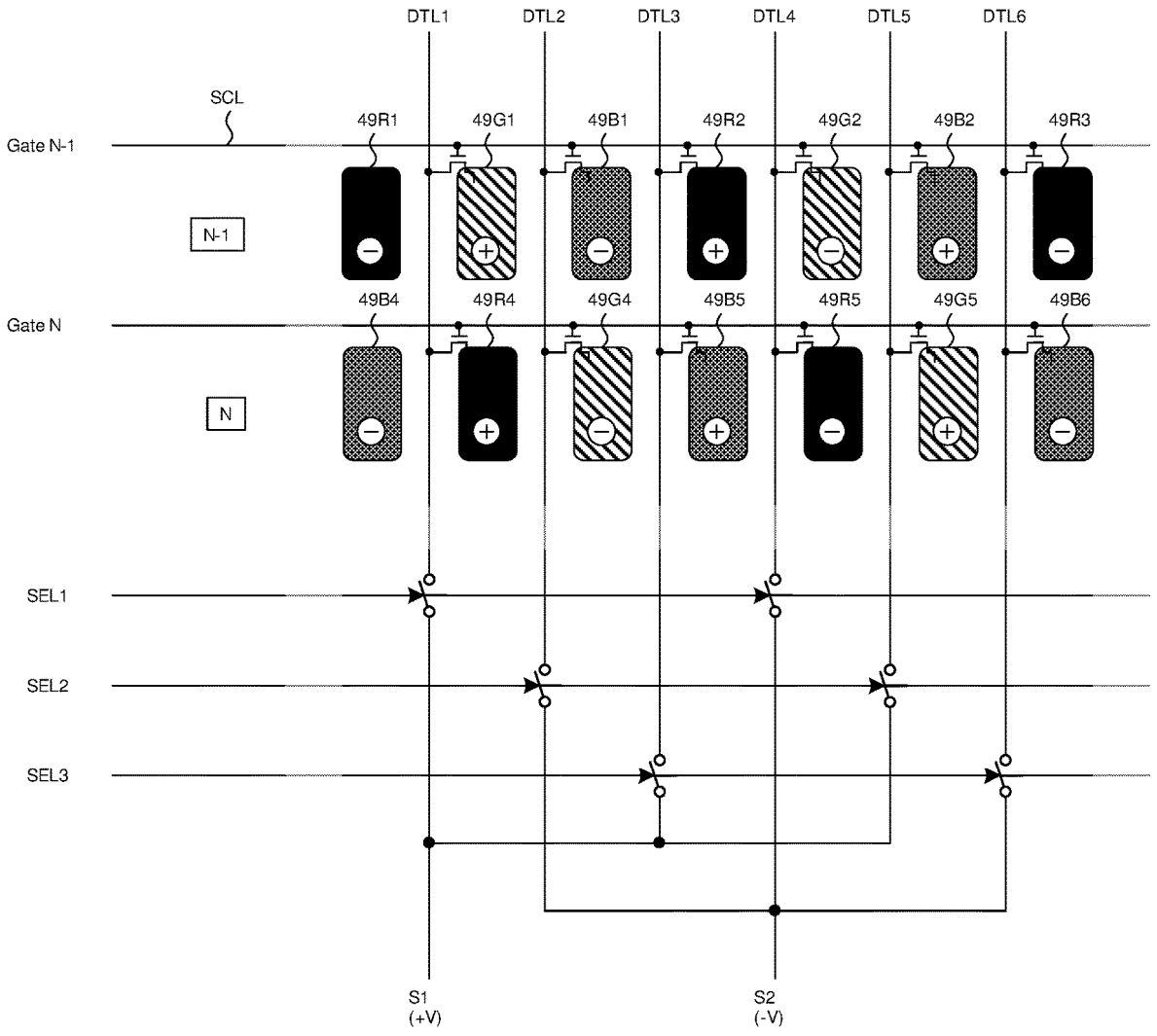
FIG. 19 is a diagram illustrating a state of the N−1th row and the Nth row when the window display illustrated in FIG. 4 is made in cyan in the example illustrated in FIG. 7.

FIG. 19 is a diagram illustrating a state of the N−1th row and the Nth row when the window display illustrated in FIG. 4 is made in cyan in the example illustrated in FIG. 7.

When Gate N−1 is selected, the second sub-pixel 49G1 has the potential of the positive (+) polarity. When Gate N is selected, the first sub-pixel 49R4 is at 0 V because of displaying black. Thus, when the selection shifts from Gate N−1 to Gate N, the voltage of the signal line DTL1 changes in the negative (−) direction. More specifically, when the selection shifts from Gate N−1 to Gate N, the potential change of the signal line DTL1 is −V.

When Gate N−1 is selected, the third sub-pixel 49B1 has the potential of the negative (−) polarity. When Gate N is selected, the second sub-pixel 49G4 has the potential of the negative (−) polarity. Thus, when the selection shifts from Gate N−1 to Gate N, the voltage of the signal line DTL2 does not change. More specifically, when the selection shifts from Gate N−1 to Gate N, the potential change of the signal line DTL2 is substantially zero (≈0).

When Gate N−1 is selected, the first sub-pixel 49R2 is at 0 V because of displaying black. When Gate N is selected, the third sub-pixel 49B5 has the potential of the positive (+) polarity. Thus, when the selection shifts from Gate N−1 to Gate N, the voltage of the signal line DTL3 changes in the positive (+) direction. More specifically, when the selection shifts from Gate N−1 to Gate N, the potential change of the signal line DTL3 is +V.

When Gate N−1 is selected, the second sub-pixel 49G2 has the potential of the negative (−) polarity. When Gate N is selected, the first sub-pixel 49R5 is at 0 V because of displaying black. Thus, when the selection shifts from Gate N−1 to Gate N, the voltage of the signal line DTL4 changes in the positive (+) direction. More specifically, when the selection shifts from Gate N−1 to Gate N, the potential change of the signal line DTL4 is +V.

When Gate N−1 is selected, the third sub-pixel 49B2 has the potential of the positive (+) polarity. When Gate N is selected, the second sub-pixel 49G5 has the potential of the positive (+) polarity. Thus, when the selection shifts from Gate N−1 to Gate N, the voltage of the signal line DTL5 does not change. More specifically, when the selection shifts from Gate N−1 to Gate N, the potential change of the signal line DTL5 is substantially zero (≈0).

When Gate N−1 is selected, the first sub-pixel 49R3 is at 0 V because of displaying black. When Gate N is selected, the third sub-pixel 49B6 has the potential of the negative (−) polarity. Thus, when the selection shifts from Gate N−1 to Gate N, the voltage of the signal line DTL6 changes in the negative (−) direction. More specifically, when the selection shifts from Gate N−1 to Gate N, the potential change of the signal line DTL6 is −V.

FIG. 20 is a table indicating the potential changes of the respective signal lines when the window display illustrated in FIG. 4 is made in cyan in the example illustrated in FIG. 7.

As illustrated in FIG. 20, when the selection of the scan line SCL shifts from Gate N−1 to Gate N, the sum of the potential changes of the signal line DTL1 and the signal line DTL4 selected by the first selector signal SEL1 is substantially zero (≈0). The sum of the potential changes of the signal line DTL2 and the signal line DTL5 selected by the second selector signal SEL2 is also substantially zero (≈0). Further, the sum of the potential changes of the signal line DTL3 and the signal line DTL6 selected by the third selector signal SEL3 is also substantially zero (≈0).

Figure 21:
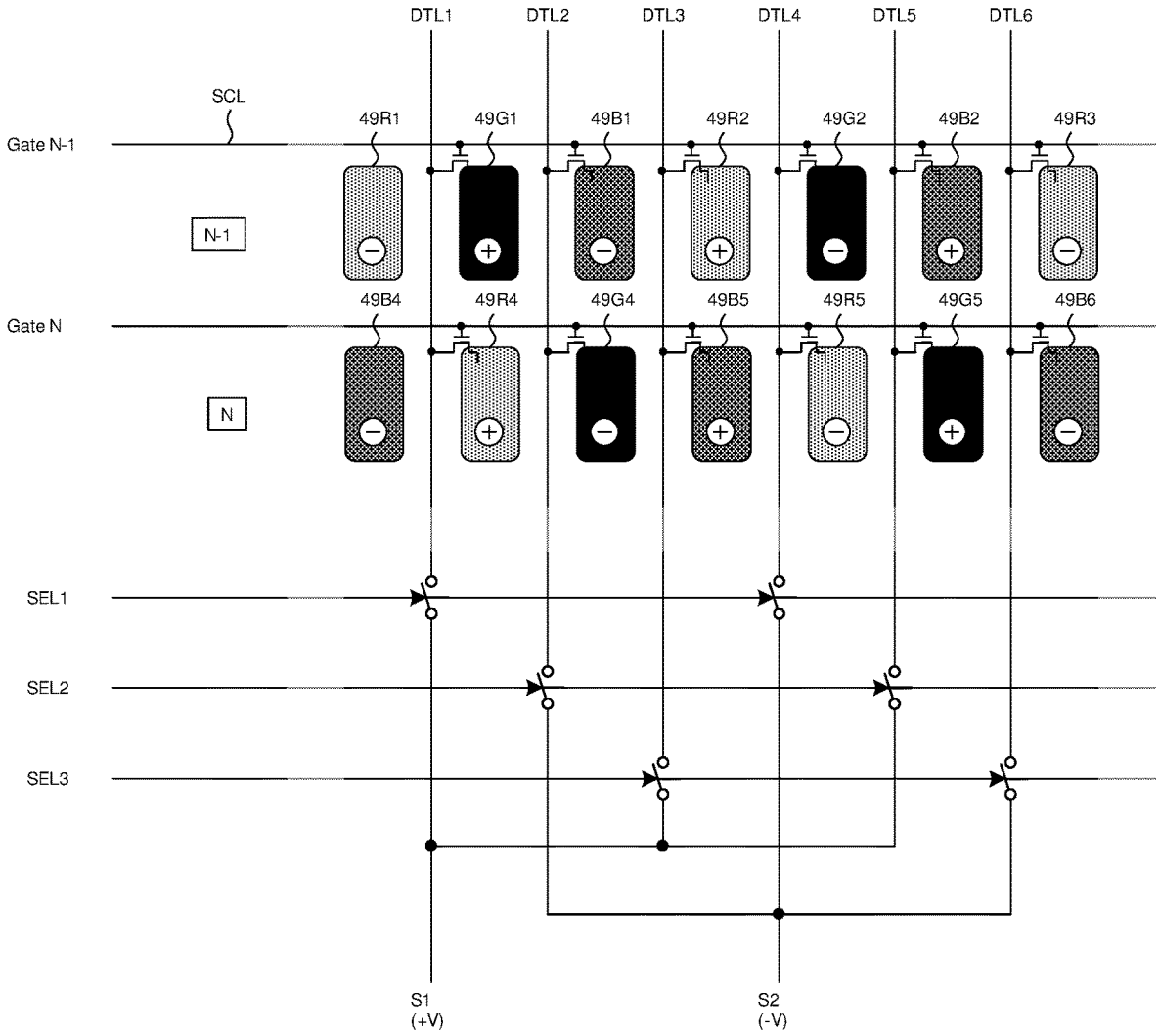
FIG. 21 is a diagram illustrating a state of the N−1th row and the Nth row when the window display illustrated in FIG. 4 is made in magenta in the example illustrated in FIG. 7.

FIG. 21 is a diagram illustrating a state of the N−1th row and the Nth row when the window display illustrated in FIG. 4 is made in magenta in the example illustrated in FIG. 7.

When Gate N−1 is selected, the second sub-pixel 49G1 is at 0 V because of displaying black. When Gate N is selected, the first sub-pixel 49R4 has the potential of the positive (+) polarity. Thus, when the selection shifts from Gate N−1 to Gate N, the voltage of the signal line DTL1 changes in the positive (+) direction. More specifically, when the selection shifts from Gate N−1 to Gate N, the potential change of the signal line DTL1 is +V.

When Gate N−1 is selected, the third sub-pixel 49B1 has the potential of the negative (−) polarity. When Gate N is selected, the second sub-pixel 49G4 is at 0 V because of displaying black. Thus, when the selection shifts from Gate N−1 to Gate N, the voltage of the signal line DTL2 changes in the positive (+) direction. More specifically, when the selection shifts from Gate N−1 to Gate N, the potential change of the signal line DTL2 is +V.

When Gate N−1 is selected, the first sub-pixel 49R2 has the potential of the positive (+) polarity. When Gate N is selected, the third sub-pixel 49B5 has the potential of the positive (+) polarity. Thus, when the selection shifts from Gate N−1 to Gate N, the voltage of the signal line DTL3 does not change. More specifically, when the selection shifts from Gate N−1 to Gate N, the potential change of the signal line DTL3 is substantially zero (≈0).

When Gate N−1 is selected, the second sub-pixel 49G2 is at 0 V because of displaying black. When Gate N is selected, the first sub-pixel 49R5 has the potential of the negative (−) polarity. Thus, when the selection shifts from Gate N−1 to Gate N, the voltage of the signal line DTL4 changes in the negative (−) direction. More specifically, when the selection shifts from Gate N−1 to Gate N, the potential change of the signal line DTL4 is −V.

When Gate N−1 is selected, the third sub-pixel 49B2 has the potential of the positive (+) polarity. When Gate N is selected, the second sub-pixel 49G5 is at 0 V because of displaying black. Thus, when the selection shifts from Gate N−1 to Gate N, the voltage of the signal line DTL5 changes in the negative (−) direction. More specifically, when the selection shifts from Gate N−1 to Gate N, the potential change of the signal line DTL5 is −V.

When Gate N−1 is selected, the first sub-pixel 49R3 has the potential of the negative (−) polarity. When Gate N is selected, the third sub-pixel 49B6 has the potential of the negative (−) polarity. Thus, when the selection shifts from Gate N−1 to Gate N, the voltage of the signal line DTL6 does not change. More specifically, when the selection shifts from Gate N−1 to Gate N, the potential change of the signal line DTL6 is substantially zero (≈0).

FIG. 22 is a table indicating the potential changes of the respective signal lines when the window display illustrated in FIG. 4 is made in magenta in the example illustrated in FIG. 7.

As illustrated in FIG. 22, when the selection of the scan line SCL shifts from Gate N−1 to Gate N, the sum of the potential changes of the signal line DTL1 and the signal line DTL4 selected by the first selector signal SEL1 is substantially zero (≈0). The sum of the potential changes of the signal line DTL2 and the signal line DTL5 selected by the second selector signal SEL2 is also substantially zero (≈0). Further, the sum of the potential changes of the signal line DTL3 and the signal line DTL6 selected by the third selector signal SEL3 is also substantially zero (≈0).

The following describes modifications of the pixel array and the internal configuration of the signal output circuit in the display device according to the embodiment.

First Modification

Figure 23:
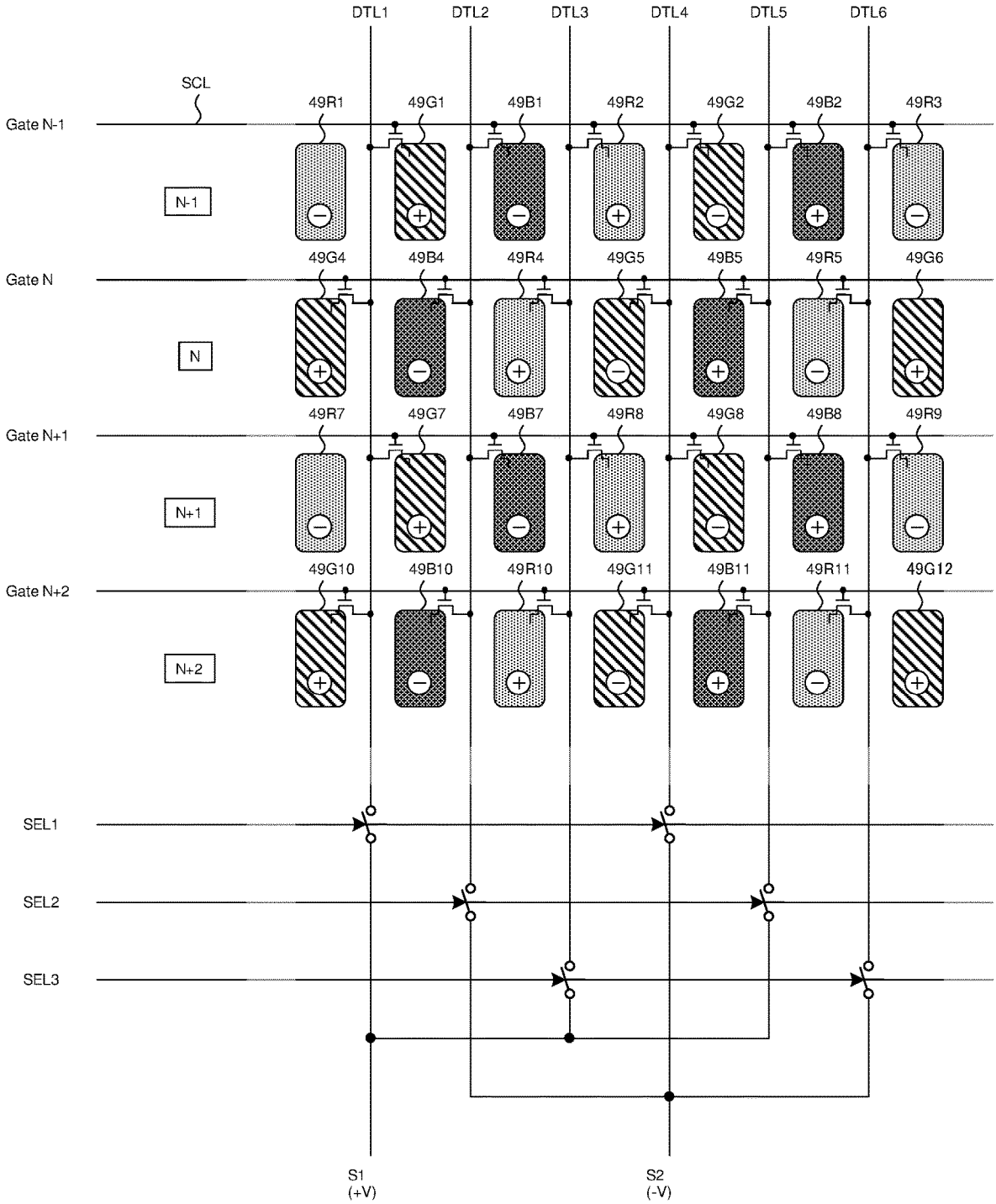
FIG. 23 is a schematic diagram illustrating a first modification of the pixel array and the internal configuration of the signal output circuit in the display device according to the embodiment.

FIG. 23 is a schematic diagram illustrating a first modification of the pixel array and the internal configuration of the signal output circuit in the display device according to the embodiment. Similarly to the example illustrated in FIG. 7, the first modification illustrated in FIG. 23 represents a configuration example including the first sub-pixel for displaying the first primary color (e.g., red), the second sub-pixel for displaying the second primary color (e.g., green), and the third sub-pixel for displaying the third primary color (e.g., blue). The frameworks of the signal output circuit 41, the scan circuit 42, and the image display panel 30 are not depicted in the example illustrated in FIG. 23.

In the first modification illustrated in FIG. 23, the first sub-pixel (red), the second sub-pixel (green), and the third sub-pixel (blue) are sequentially arrayed in this order in each sub-pixel row, and these sub-pixels are arranged in the Y direction such that each of the first sub-pixel (red), the second sub-pixel (green), and the third sub-pixel (blue) belonging to an even-numbered sub-pixel row is shifted in the X direction by one sub-pixel with respect to a corresponding sub-pixel belonging to an odd-numbered row.

In the first modification illustrated in FIG. 23, each signal line DTL is coupled alternately in the second direction to one sub-pixel 49 belonging to the first sub-pixel column and another sub-pixel 49 belonging to the second sub-pixel column adjacent to the first sub-pixel column. Specifically, an example is illustrated in which, in the N−1th (where N is an integer of two or greater) and N+1th sub-pixel rows, each signal line DTL is coupled to a part of the sub-pixels 49 belonging to a sub-pixel column on the right side in FIG. 23 of the signal line DTL, and, in the Nth and N+2th sub-pixel rows, each signal line DTL is coupled to a part of the sub-pixels 49 belonging to a sub-pixel column on the left side in FIG. 23 of the signal line DTL.

In the first modification illustrated in FIG. 23, each of the first selector signal SEL1, the second selector signal SEL2, and the third selector signal SEL3 selects a pair of the signal lines DTL each supplied with either of the first source signal S1 and the second source signal S2 each having a mutually reverse polarity. The magnitude of the potential +V of the first source signal S1 relative to the potential of the common electrode COML is substantially equal to the magnitude of the potential −V of the second source signal S2 relative to the potential of the common electrode COML.

Specifically, the signal line DTL1 is supplied with the first source signal S1 having the positive (+) polarity selected by the first selector signal SEL1.

The signal line DTL2 is supplied with the second source signal S2 having the negative (−) polarity selected by the second selector signal SEL2.

The signal line DTL3 is supplied with the first source signal S1 having the positive (+) polarity selected by the third selector signal SEL3.

The signal line DTL4 is supplied with the second source signal S2 having the negative (−) polarity selected by the first selector signal SEL1.

The signal line DTL5 is supplied with the first source signal S1 having the positive (+) polarity selected by the second selector signal SEL2.

The signal line DTL6 is supplied with the second source signal S2 having the negative (−) polarity selected by the third selector signal SEL3.

Figure 24:
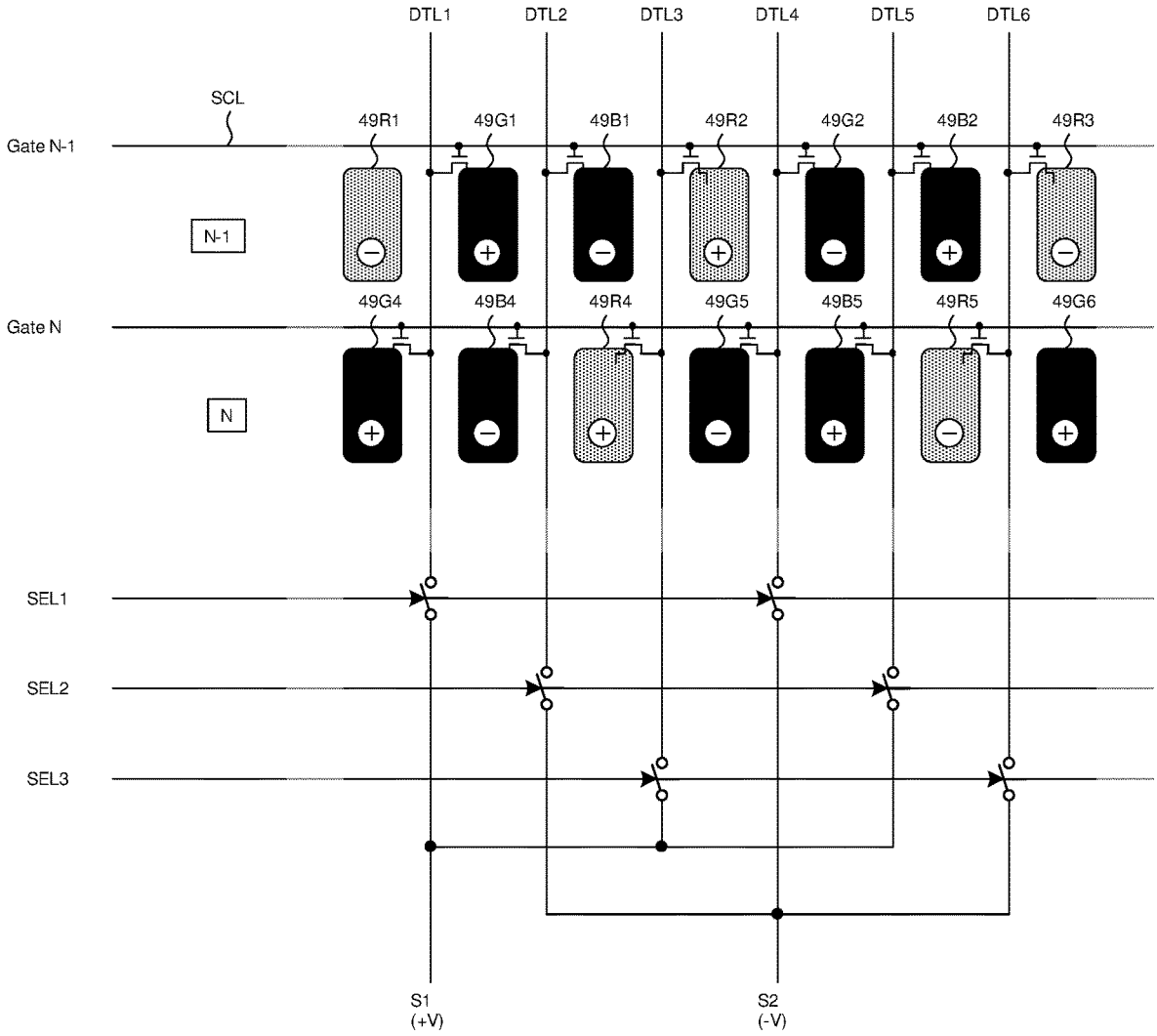
FIG. 24 is a diagram illustrating a state of the N−1th row and the Nth row when the window display illustrated in FIG. 4 is made in the first primary color (red) in the first modification illustrated in FIG. 23.

FIG. 24 is a diagram illustrating a state of the N−1th row and the Nth row when the window display illustrated in FIG. 4 is made in the first primary color (red) in the first modification illustrated in FIG. 23. FIG. 25 is a table indicating the potential changes of the respective signal lines when the window display illustrated in FIG. 4 is made in the first primary color (red) in the first modification illustrated in FIG. 23.

Figure 26:
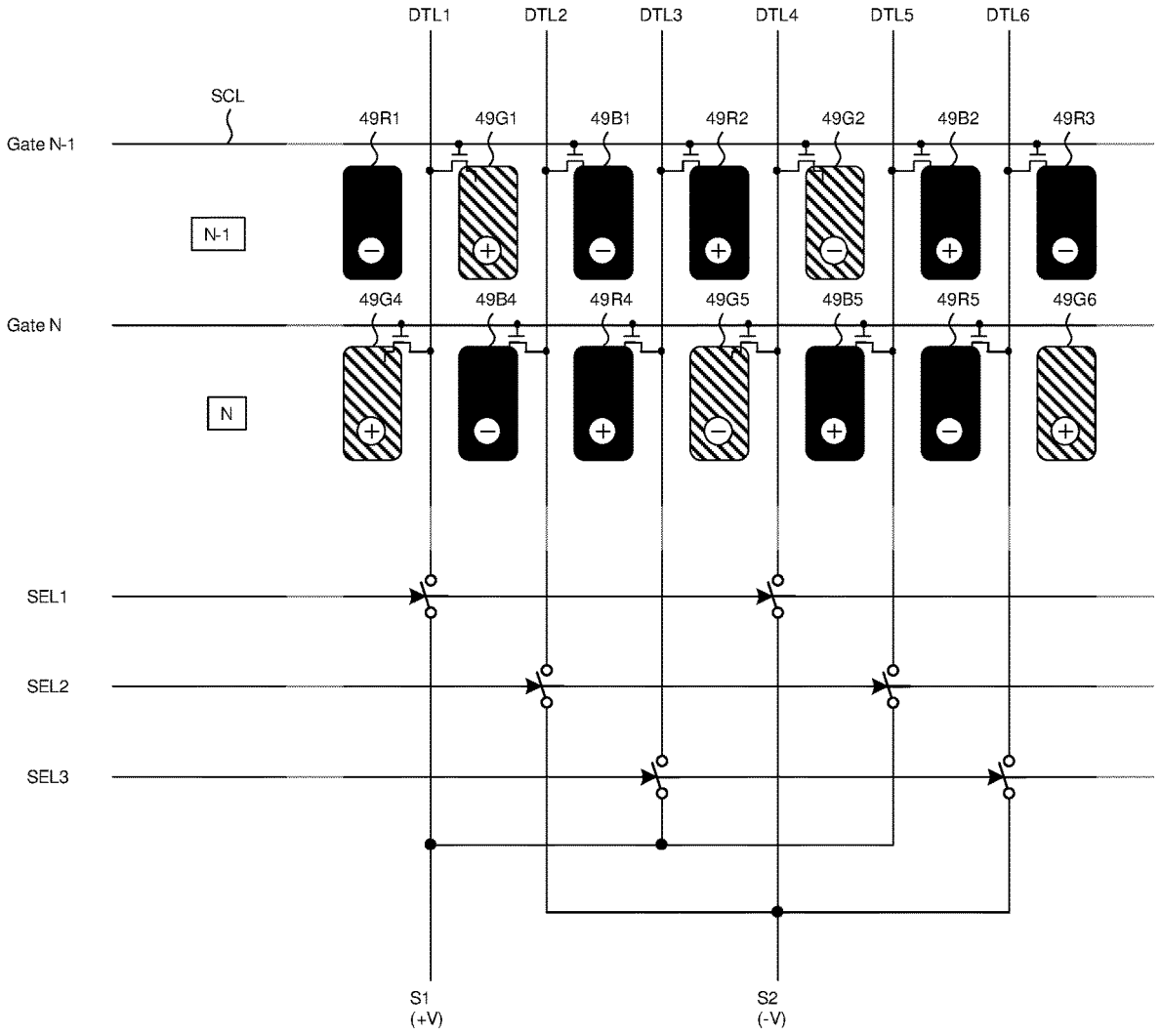
FIG. 26 is a diagram illustrating a state of the N−1th row and the Nth row when the window display illustrated in FIG. 4 is made in the second primary color (green) in the first modification illustrated in FIG. 23.

FIG. 26 is a diagram illustrating a state of the N−1th row and the Nth row when the window display illustrated in FIG. 4 is made in the second primary color (green) in the first modification illustrated in FIG. 23. FIG. 27 is a table indicating the potential changes of the respective signal lines when the window display illustrated in FIG. 4 is made in the second primary color (green) in the first modification illustrated in FIG. 23.

Also in the case of the first modification illustrated in FIG. 23, when each of the sub-pixel columns is sequentially selected, the sum of the potential changes of the signal line DTL1 and the signal line DTL4 selected by the first selector signal SEL1 is substantially zero (≈0), as illustrated in FIGS. 24 to 27. The sum of the potential changes of the signal line DTL2 and the signal line DTL5 selected by the second selector signal SEL2 is also substantially zero (≈0). Further, the sum of the potential changes of the signal line DTL3 and the signal line DTL6 selected by the third selector signal SEL3 is also substantially zero (≈0).

In this manner, also in the first modification illustrated in FIG. 23, the sum of the potential changes of the respective signal lines DTL selected by each of the selector signals is substantially zero (≈0) when each of the sub-pixel columns is sequentially selected, thereby preventing the deterioration in display quality caused by the crosstalk.

Second Modification

Figure 28:
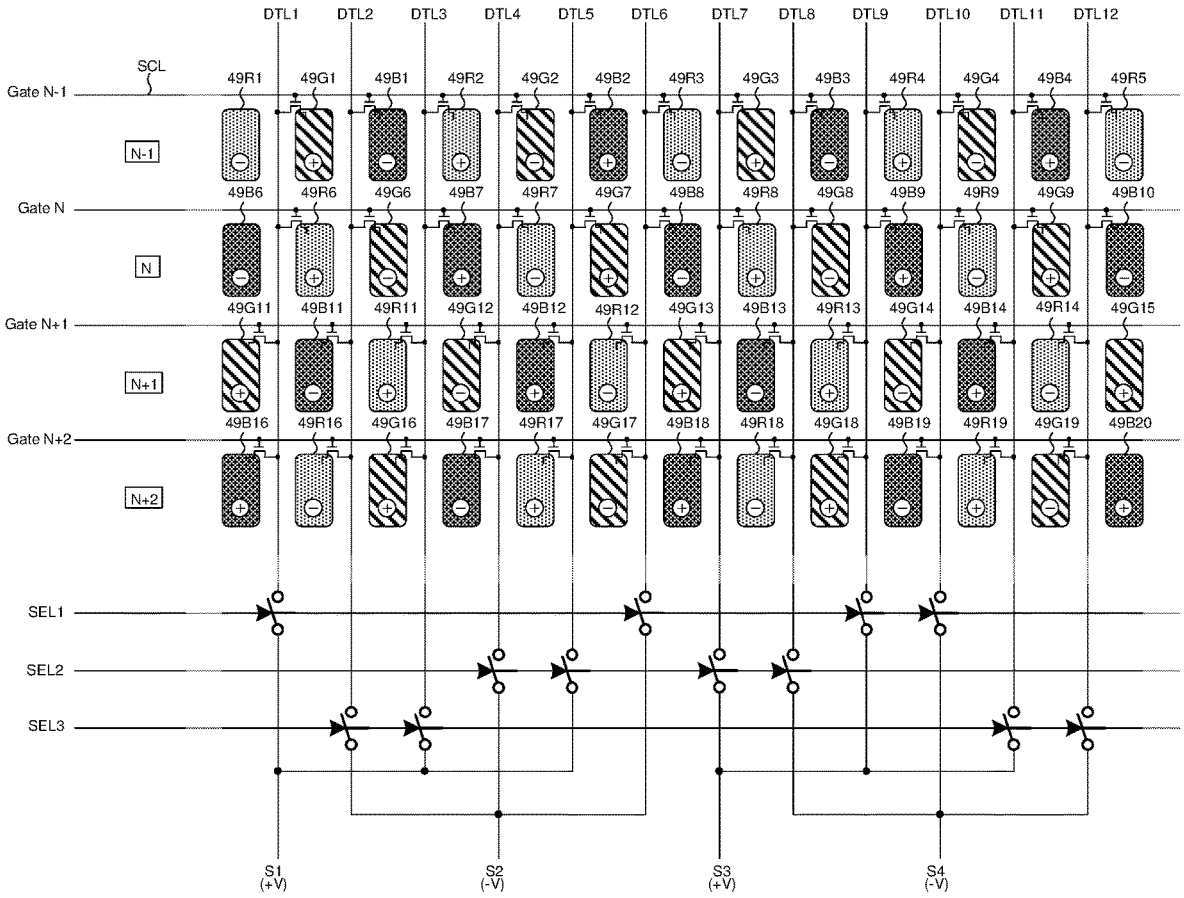
FIG. 28 is a schematic diagram illustrating a second modification of the pixel array and the internal configuration of the signal output circuit in the display device according to the embodiment.

FIG. 28 is a schematic diagram illustrating a second modification of the pixel array and the internal configuration of the signal output circuit in the display device according to the embodiment. Similarly to the example illustrated in FIG. 7 and the first modification illustrated in FIG. 23, the second modification illustrated in FIG. 28 represents a configuration example including the first sub-pixel for displaying the first primary color (e.g., red), the second sub-pixel for displaying the second primary color (e.g., green), and the third sub-pixel for displaying the third primary color (e.g., blue). The frameworks of the signal output circuit 41, the scan circuit 42, and the image display panel 30 are also not depicted in the example illustrated in FIG. 28.

Similarly to the example illustrated in FIG. 7, in the second modification illustrated in FIG. 28, the first sub-pixel (red), the second sub-pixel (green), and the third sub-pixel (blue) are sequentially arrayed in this order in each sub-pixel, and these sub-pixels are arranged in the Y direction such that each of the first sub-pixel (red), the second sub-pixel (green), and the third sub-pixel (blue) belonging to the first sub-pixel row is shifted in the X direction by one sub-pixel with respect to a corresponding sub-pixel belonging to the second sub-pixel row adjacent to the first sub-pixel row.

Similarly to the example illustrated in FIG. 7, in the second modification illustrated in FIG. 28, each signal line DTL is coupled alternately in the Y direction to two consecutive sub-pixels 49 belonging to the first sub-pixel column and two consecutive sub-pixels 49 belonging to the second sub-pixel column adjacent to the first sub-pixel column. Specifically, an example is illustrated in which, in the N−1th (where N is an integer of two or greater) and Nth sub-pixel rows, each signal line DTL is coupled to a part of the sub-pixels 49 belonging to a sub-pixel column on the right side in FIG. 28 of the signal line DTL, and, in the N+1th and N+2th sub-pixel rows, each signal line DTL is coupled to a part of the sub-pixels 49 belonging to a sub-pixel column on the left side in FIG. 28 of the signal line DTL.

In the second modification illustrated in FIG. 28, each of the first selector signal SEL1, the second selector signal SEL2, and the third selector signal SEL3 selects a pair of the signal lines DTL each supplied with either of the first source signal S1 and the second source signal S2 each having a mutually reverse polarity and a pair of the signal lines DTL each supplied with either of a third source signal S3 and a fourth source signal S4 each having a mutually reverse polarity. The magnitude of the potential +V of the first source signal S1 relative to the potential of the common electrode COML is substantially equal to the magnitude of the potential −V of the second source signal S2 relative to the potential of the common electrode COML. The magnitude of the potential +V of the third source signal S3 relative to the potential of the common electrode COML is substantially equal to the magnitude of the potential −V of the fourth source signal S4 relative to the potential of the common electrode COML. In this example, to display the single-colored window image 30W illustrated in FIG. 4, the magnitude of the potential +V of the first source signal S1 relative to the potential of the common electrode COML, the magnitude of the potential −V of the second source signal S2 relative to the potential of the common electrode COML, the magnitude of the potential +V of the third source signal S3 relative to the potential of the common electrode COML, and the magnitude of the potential −V of the fourth source signal S4 relative to the potential of the common electrode COML are substantially equal to one another.

Specifically, the signal line DTL1 is supplied with the first source signal S1 having the positive (+) polarity selected by the first selector signal SEL1.

The signal line DTL2 is supplied with the second source signal S2 having the negative (−) polarity selected by the third selector signal SEL3.

The signal line DTL3 is supplied with the first source signal S1 having the positive (+) polarity selected by the third selector signal SEL3.

The signal line DTL4 is supplied with the second source signal S2 having the negative (−) polarity selected by the second selector signal SEL2.

The signal line DTL5 is supplied with the first source signal S1 having the positive (+) polarity selected by the second selector signal SEL2.

The signal line DTL6 is supplied with the second source signal S2 having the negative (−) polarity selected by the first selector signal SEL1.

A signal line DTL7 is supplied with the third source signal S3 having the positive (+) polarity selected by the second selector signal SEL2.

A signal line DTL8 is supplied with the fourth source signal S4 having the negative (−) polarity selected by the second selector signal SEL2.

A signal line DTL9 is supplied with the third source signal S3 having the positive (+) polarity selected by the first selector signal SEL1.

A signal line DTL10 is supplied with the fourth source signal S4 having the negative (−) polarity selected by the first selector signal SEL1.

A signal line DTL11 is supplied with the third source signal S3 having the positive (+) polarity selected by the third selector signal SEL3.

A signal line DTL12 is supplied with the fourth source signal S4 having the negative (−) polarity selected by the third selector signal SEL3.

Figure 29:
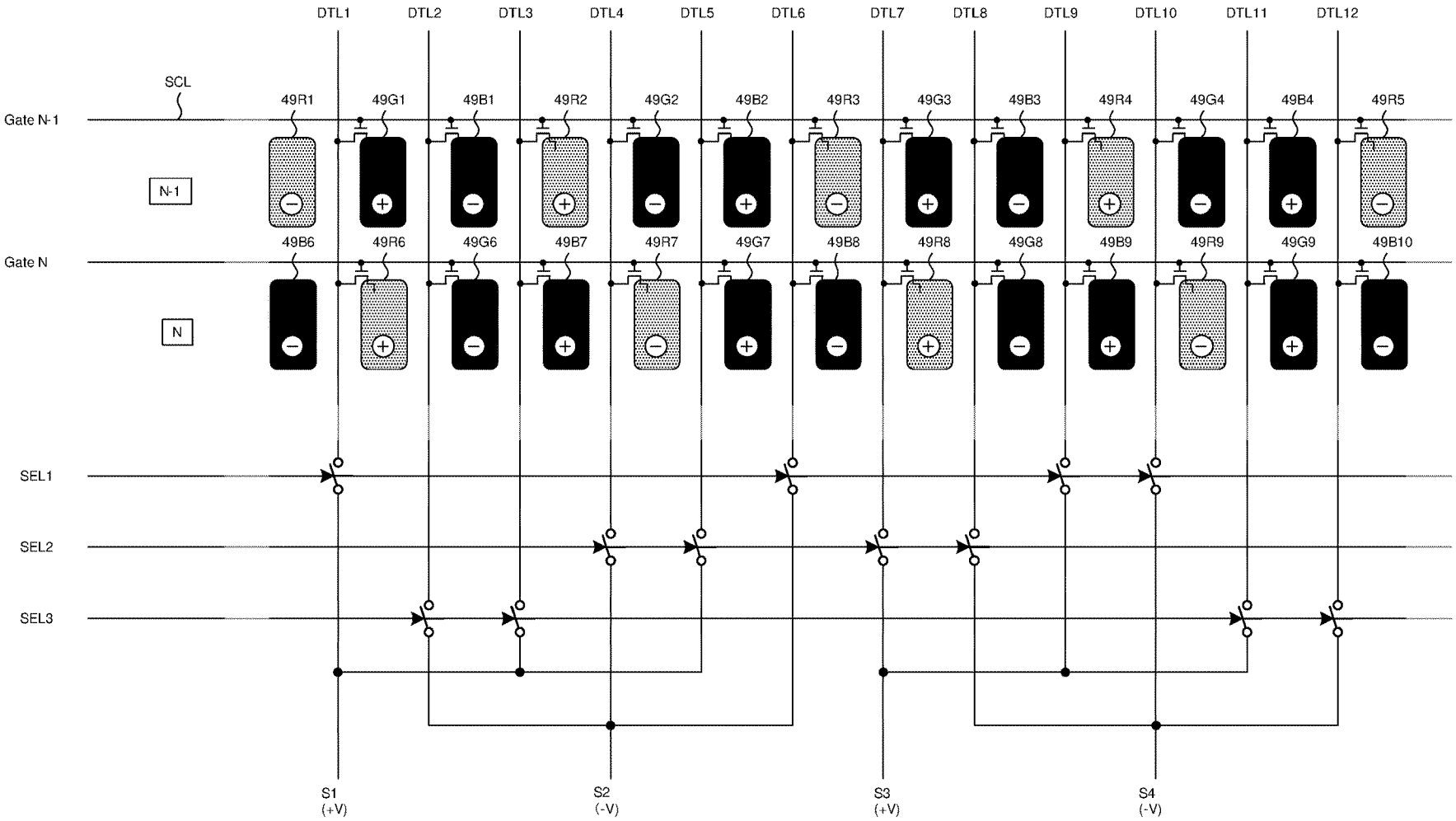
FIG. 29 is a diagram illustrating a state of the N−1th row and the Nth row when the window display illustrated in FIG. 4 is made in the first primary color (red) in the second modification illustrated in FIG. 28.
Figure 30:
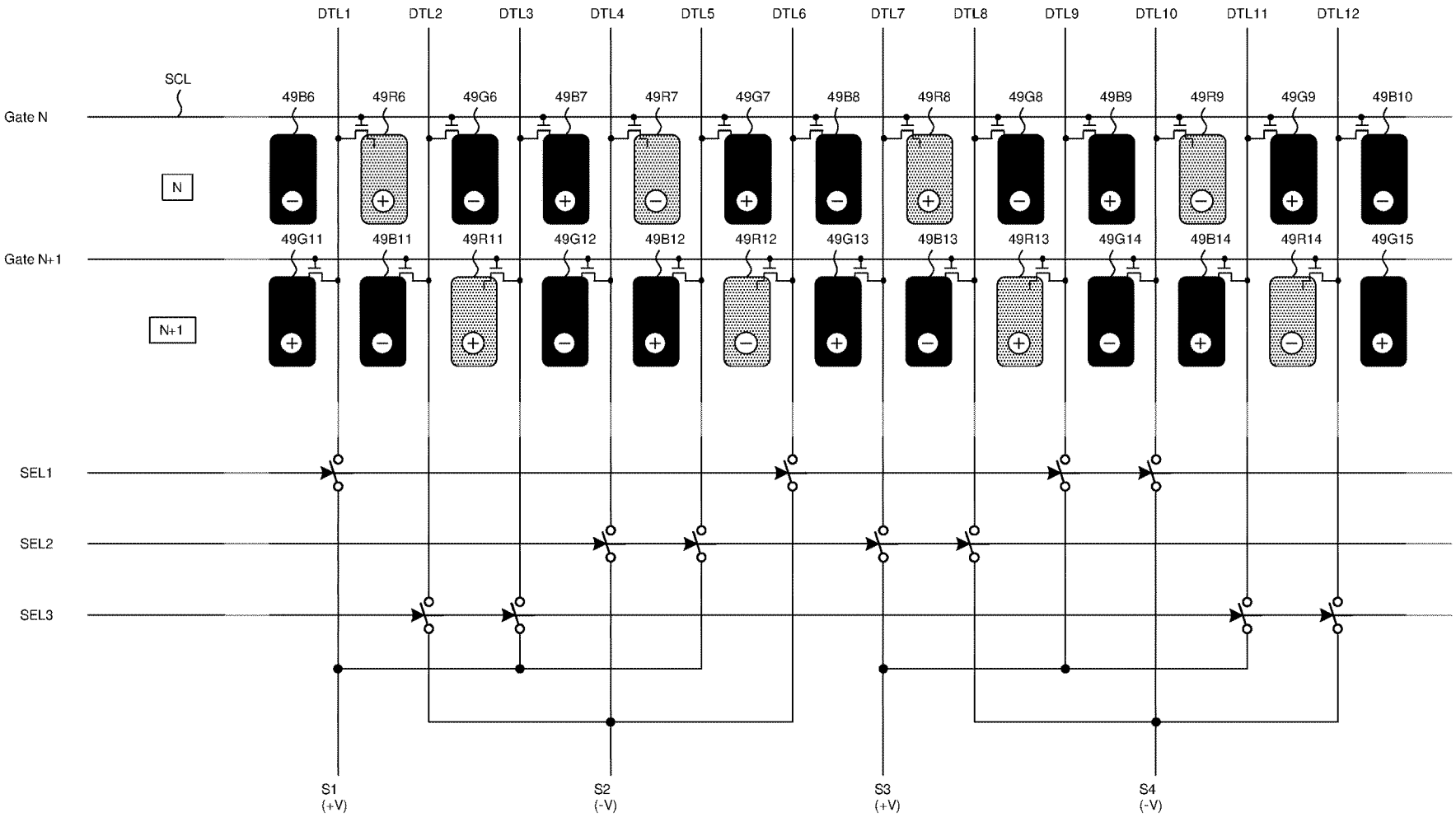
FIG. 30 is a diagram illustrating a state of the Nth row and the N+1th row when the window display illustrated in FIG. 4 is made in the first primary color (red) in the second modification illustrated in FIG. 28.
Figure 32:
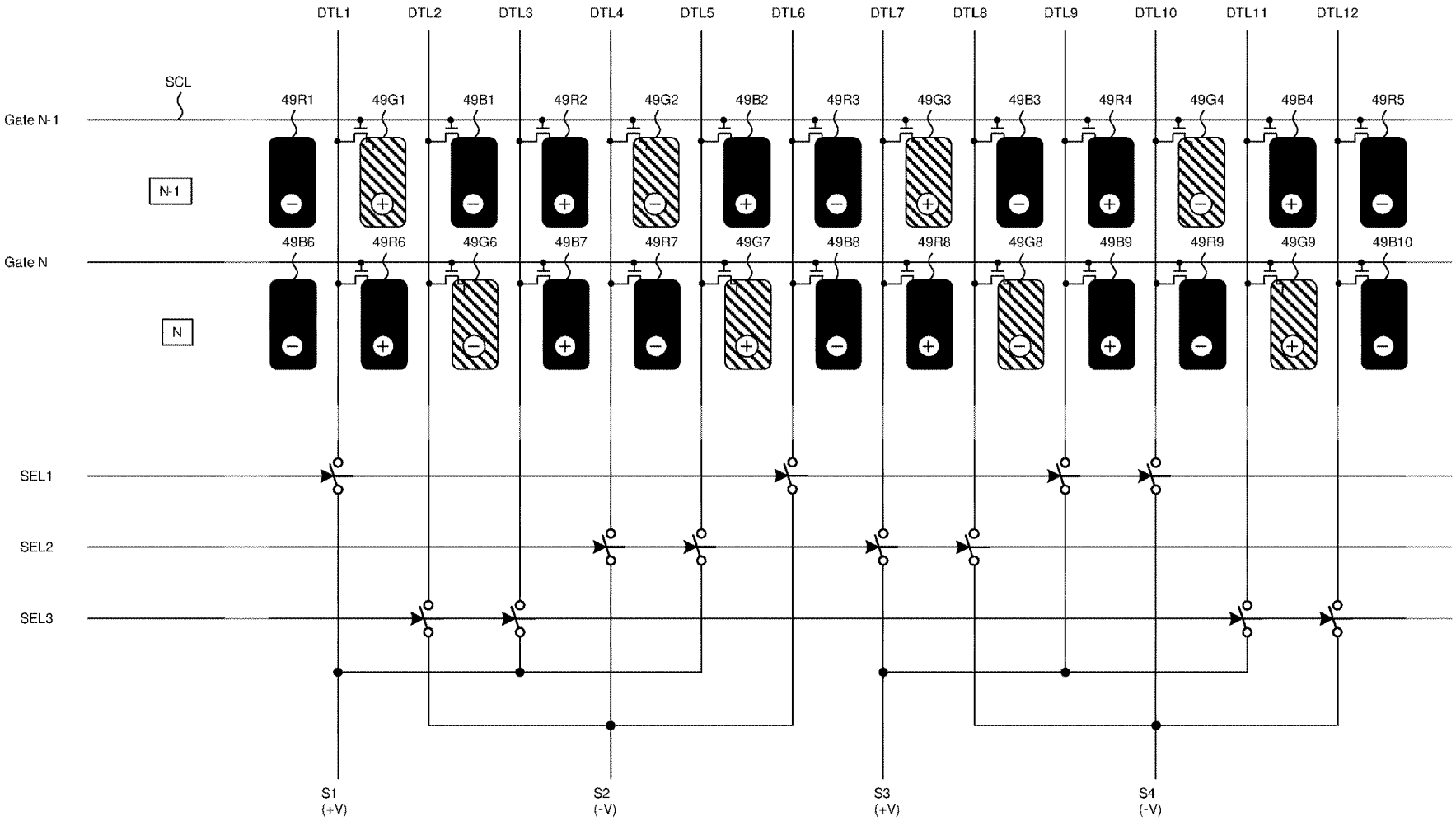
FIG. 32 is a diagram illustrating a state of the N−1th row and the Nth row when the window display illustrated in FIG. 4 is made in the second primary color (green) in the second modification illustrated in FIG. 28.
Figure 34:
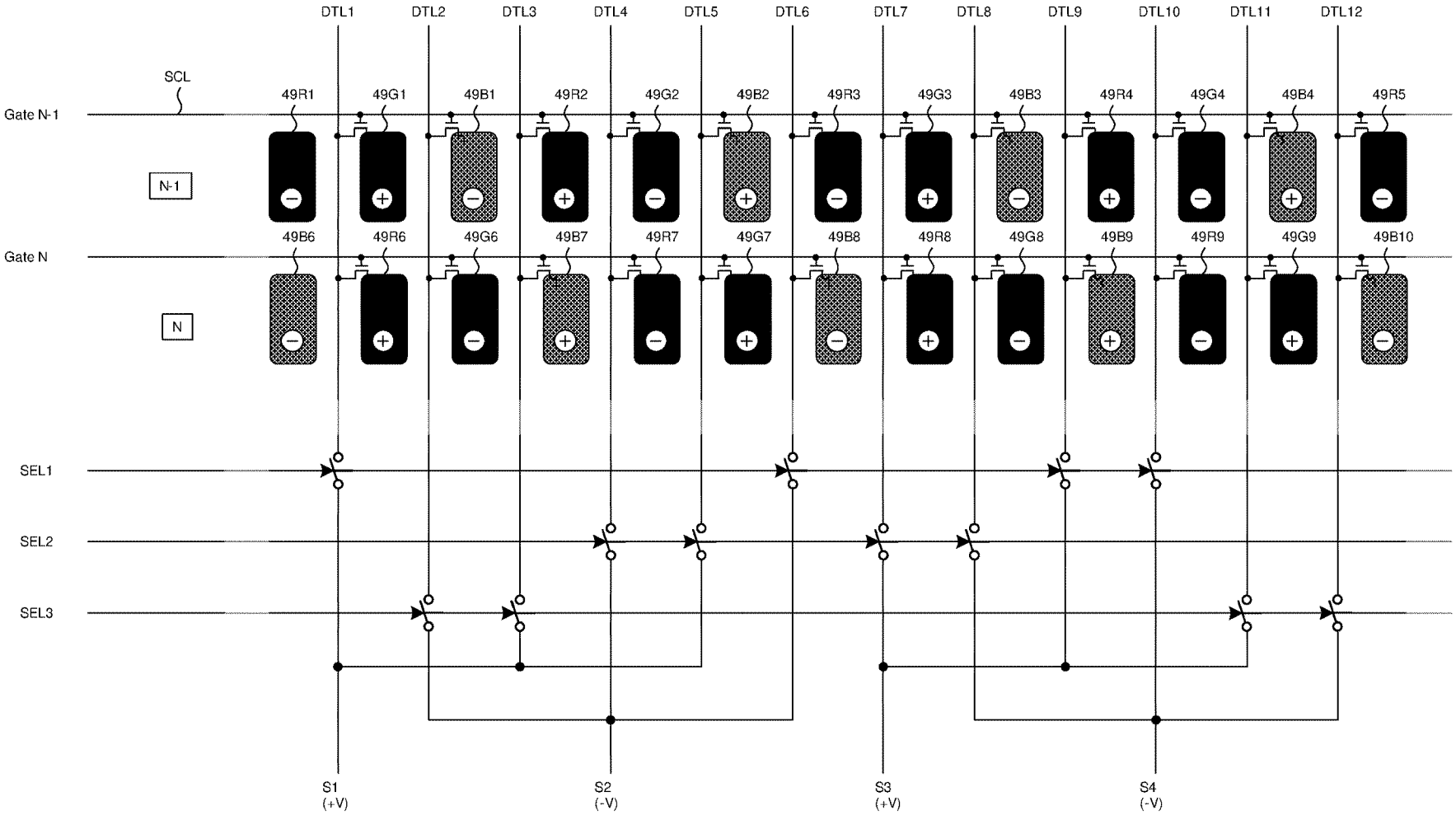
FIG. 34 is a diagram illustrating a state of the N−1th row and the Nth row when the window display illustrated in FIG. 4 is made in the third primary color (blue) in the second modification illustrated in FIG. 28.

FIG. 29 is a diagram illustrating a state of the N−1th row and the Nth row when the window display illustrated in FIG. 4 is made in the first primary color (red) in the second modification illustrated in FIG. 28. FIG. 30 is a diagram illustrating a state of the Nth row and the N+1th row when the window display illustrated in FIG. 4 is made in the first primary color (red) in the second modification illustrated in FIG. 28. FIG. 31 is a table indicating the potential changes of the respective signal lines when the window display illustrated in FIG. 4 is made in the first primary color (red) in the second modification illustrated in FIG. 28. FIG. 32 is a diagram illustrating a state of the N−1th row and the Nth row when the window display illustrated in FIG. 4 is made in the second primary color (green) in the second modification illustrated in FIG. 28. FIG. 33 is a table indicating the potential changes of the respective signal lines when the window display illustrated in FIG. 4 is made in the second primary color (green) in the second modification illustrated in FIG. 28. FIG. 34 is a diagram illustrating a state of the N−1th row and the Nth row when the window display illustrated in FIG. 4 is made in the third primary color (blue) in the second modification illustrated in FIG. 28. FIG. 35 is a table indicating the potential changes of the respective signal lines when the window display illustrated in FIG. 4 is made in the third primary color (blue) in the second modification illustrated in FIG. 28.

In the second modification illustrated in FIG. 28, when each of the sub-pixel columns is sequentially selected, the sum of the potential changes of the signal lines DTL1, DTL6, DTL9, and DTL10 selected by the first selector signal SEL1 is substantially zero (≈0), as illustrated in FIGS. 29 to 35. The sum of the potential changes of the signal lines DTL4, DTL5, DTL7, and DTL8 selected by the second selector signal SEL2 is also substantially zero (≈0). Further, the sum of the potential changes of the signal lines DTL2, DTL3, DTL11, and DTL12 selected by the third selector signal SEL3 is also substantially zero (≈0).

In this manner, also in the second modification illustrated in FIG. 28, the sum of the potential changes of the respective signal lines selected by each of the selector signals is substantially zero (≈0) when each of the sub-pixel columns is sequentially selected, thereby preventing the deterioration in display quality caused by the crosstalk.

Third Modification

Figure 36:
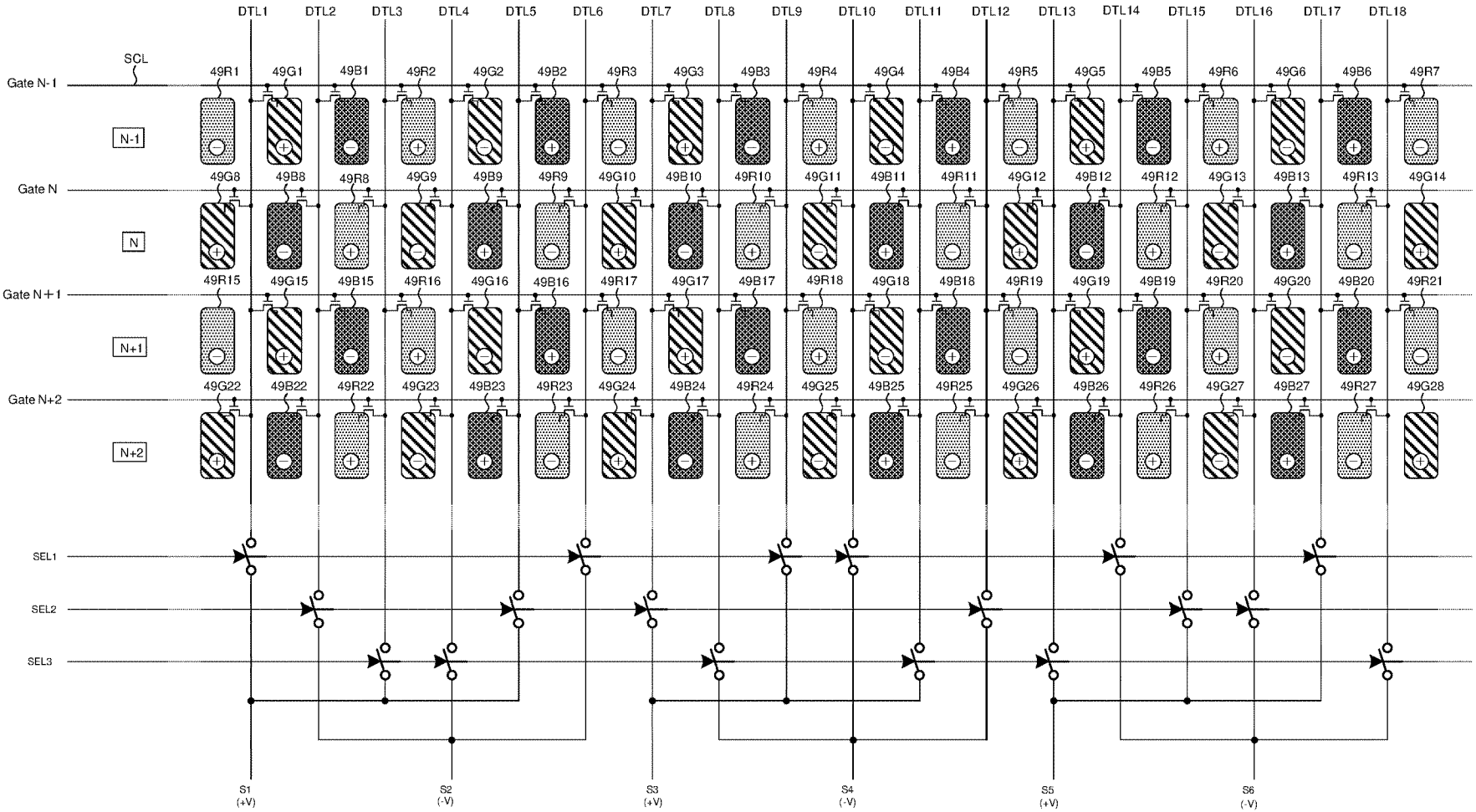
FIG. 36 is a schematic diagram illustrating a third modification of the pixel array and the internal configuration of the signal output circuit in the display device according to the embodiment.

FIG. 36 is a schematic diagram illustrating a third modification of the pixel array and the internal configuration of the signal output circuit in the display device according to the embodiment. Similarly to the example illustrated in FIG. 7, the first modification illustrated in FIG. 23, and the second modification illustrated in FIG. 28, the third modification illustrated in FIG. 36 represents a configuration example including the first sub-pixel for displaying the first primary color (e.g., red), the second sub-pixel for displaying the second primary color (e.g., green), and the third sub-pixel for displaying the third primary color (e.g., blue). The frameworks of the signal output circuit 41, the scan circuit 42, and the image display panel 30 are also not depicted in the example illustrated in FIG. 36.

Similarly to the first modification illustrated in FIG. 23, in the third modification illustrated in FIG. 36, the first sub-pixel (red), the second sub-pixel (green), and the third sub-pixel (blue) are sequentially arrayed in this order in each sub-pixel row, and these sub-pixels are arranged in the Y direction such that each of the first sub-pixel (red), the second sub-pixel (green), and the third sub-pixel (blue) belonging to the even-numbered sub-pixel row is shifted in the X direction by one sub-pixel with respect to a corresponding sub-pixel belonging to the odd-numbered row.

Similarly to the first modification illustrated in FIG. 23, in the third modification illustrated in FIG. 36, each signal line DTL is coupled alternately in the Y direction to one sub-pixel 49 belonging to the first sub-pixel column and another sub-pixel 49 belonging to the second sub-pixel column adjacent to the first sub-pixel column. Specifically, an example is illustrated in which, in the N−1th (where N is an integer of two or greater) and N+1th sub-pixel rows, each signal line DTL is coupled to a part of the sub-pixels 49 belonging to a sub-pixel column on the right side in FIG. 36 of the signal line DTL, and, in the Nth and N+2th sub-pixel rows, each signal line DTL is coupled to a part of the sub-pixels 49 belonging to a sub-pixel column on the left side in FIG. 36 of the signal line DTL.

In the third modification illustrated in FIG. 36, each of the first selector signal SEL1, the second selector signal SEL2, and the third selector signal SEL3 selects a pair of the signal lines DTL each supplied with either of the first source signal S1 and the second source signal S2 each having a mutually reverse polarity, a pair of the signal lines DTL each supplied with either of the third source signal S3 and the fourth source signal S4 each having a mutually reverse polarity, and a pair of the signal lines DTL each supplied with either of a fifth source signal S5 and a sixth source signal S6 each having a mutually reverse polarity. The magnitude of the potential +V of the first source signal S1 relative to the potential of the common electrode COML is substantially equal to the magnitude of the potential −V of the second source signal S2 relative to the potential of the common electrode COML. The magnitude of the potential +V of the third source signal S3 relative to the potential of the common electrode COML is substantially equal to the magnitude of the potential −V of the fourth source signal S4 relative to the potential of the common electrode COML. The magnitude of the potential +V of the fifth source signal S5 relative to the potential of the common electrode COML is substantially equal to the magnitude of the potential −V of the sixth source signal S6 relative to the potential of the common electrode COML. In this example, to display the single-colored window image 30W illustrated in FIG. 4, the magnitude of the potential +V of the first source signal S1 relative to the potential of the common electrode COML, the magnitude of the potential −V of the second source signal S2 relative to the potential of the common electrode COML, the magnitude of the potential +V of the third source signal S3 relative to the potential of the common electrode COML, the magnitude of the potential −V of the fourth source signal S4 relative to the potential of the common electrode COML, the magnitude of the potential +V of the fifth source signal S5 relative to the potential of the common electrode COML, the magnitude of the potential −V of the sixth source signal S6 relative to the potential of the common electrode COML are substantially equal to one another.

Specifically, the signal line DTL1 is supplied with the first source signal S1 having the positive (+) polarity selected by the first selector signal SEL1.

The signal line DTL2 is supplied with the second source signal S2 having the negative (−) polarity selected by the second selector signal SEL2.

The signal line DTL3 is supplied with the first source signal S1 having the positive (+) polarity selected by the third selector signal SEL3.

The signal line DTL4 is supplied with the second source signal S2 having the negative (−) polarity selected by the third selector signal SEL3.

The signal line DTL5 is supplied with the first source signal S1 having the positive (+) polarity selected by the second selector signal SEL2.

The signal line DTL6 is supplied with the second source signal S2 having the negative (−) polarity selected by the first selector signal SEL1.

The signal line DTL7 is supplied with the third source signal S3 having the positive (+) polarity selected by the second selector signal SEL2.

The signal line DTL8 is supplied with the fourth source signal S4 having the negative (−) polarity selected by the third selector signal SEL3.

The signal line DTL9 is supplied with the third source signal S3 having the positive (+) polarity selected by the first selector signal SEL1.

The signal line DTL10 is supplied with the fourth source signal S4 having the negative (−) polarity selected by the first selector signal SEL1.

The signal line DTL11 is supplied with the third source signal S3 having the positive (+) polarity selected by the third selector signal SEL3.

The signal line DTL12 is supplied with the fourth source signal S4 having the negative (−) polarity selected by the second selector signal SEL2.

A signal line DTL13 is supplied with the fifth source signal S5 having the positive (+) polarity selected by the third selector signal SEL3.

A signal line DTL14 is supplied with the sixth source signal S6 having the negative (−) polarity selected by the first selector signal SEL1.

A signal line DTL15 is supplied with the fifth source signal S5 having the positive (+) polarity selected by the second selector signal SEL2.

A signal line DTL16 is supplied with the sixth source signal S6 having the negative (−) polarity selected by the second selector signal SEL2.

A signal line DTL17 is supplied with the fifth source signal S5 having the positive (+) polarity selected by the first selector signal SEL1.

A signal line DTL18 is supplied with the sixth source signal S6 having the negative (−) polarity selected by the third selector signal SEL3.

Figure 37:
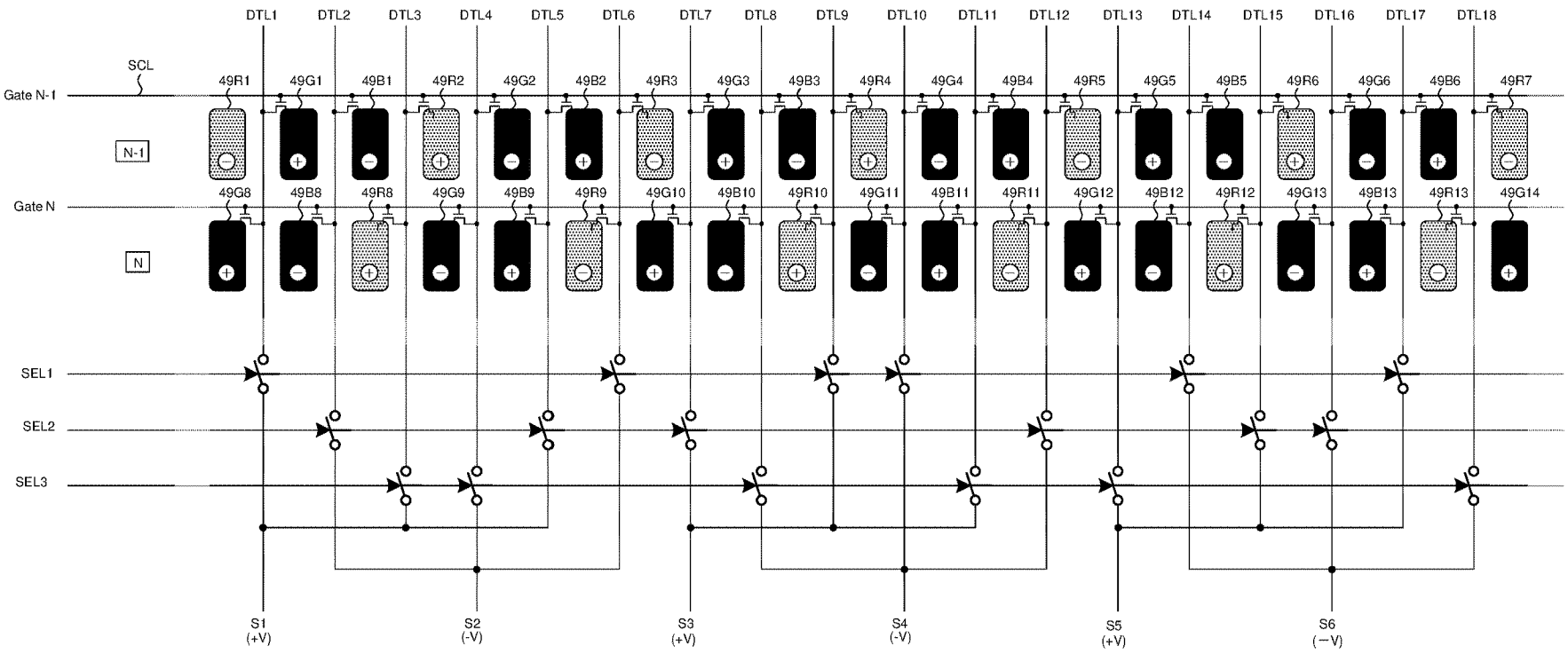
FIG. 37 is a diagram illustrating a state of the N−1th row and the Nth row when the window display illustrated in FIG. 4 is made in the first primary color (red) in the third modification illustrated in FIG. 36.

FIG. 37 is a diagram illustrating a state of the N−1th row and the Nth row when the window display illustrated in FIG. 4 is made in the first primary color (red) in the third modification illustrated in FIG. 36. FIG. 38 is a table indicating the potential changes of the respective signal lines when the window display illustrated in FIG. 4 is made in the first primary color (red) in the third modification illustrated in FIG. 36.

In the third modification illustrated in FIG. 36, when each of the sub-pixel columns is sequentially selected, the sum of the potential changes of the signal lines DTL1, DTL6, DTL9, DTL10, DTL14, and DTL17 selected by the first selector signal SEL1 is substantially zero (≈0), as illustrated in FIGS. 37 and 38. The sum of the potential changes of the signal lines DTL2, DTL5, DTL7, DTL12, DTL15, and DTL16 selected by the second selector signal SEL2 is also substantially zero (≈0). Further, the sum of the potential changes of the signal lines DTL3, DTL4, DTL8, DTL11, DTL13, and DTL18 selected by the third selector signal SEL3 is also substantially zero (≈0).

In this manner, also in the third modification illustrated in FIG. 36, the sum of the potential changes of the respective signal lines DTL selected by each of the selector signals is substantially zero (≈0) when each of the sub-pixel columns is sequentially selected, thereby preventing the deterioration in display quality caused by the crosstalk.

Fourth Modification

Figure 39:
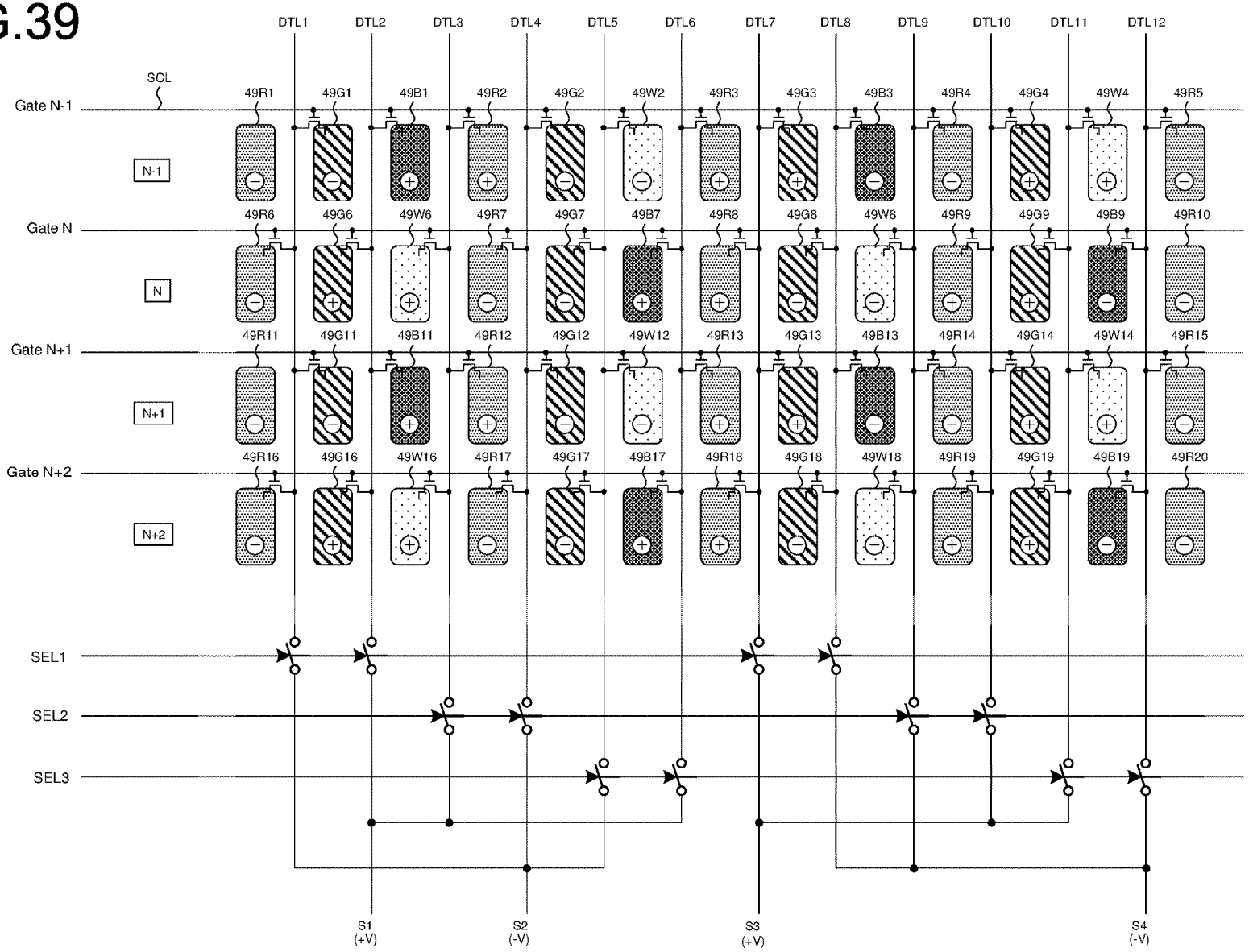
FIG. 39 is a schematic diagram illustrating a fourth modification of the pixel array and the internal configuration of the signal output circuit in the display device according to the embodiment.

FIG. 39 is a schematic diagram illustrating a fourth modification of the pixel array and the internal configuration of the signal output circuit in the display device according to the embodiment. The fourth modification illustrated in FIG. 39 represents a configuration example including the first sub-pixel for displaying the first primary color (e.g., red), the second sub-pixel for displaying the second primary color (e.g., green), the third sub-pixel for displaying the third primary color (e.g., blue), and the fourth sub-pixel for displaying the fourth color (i.e., white). The frameworks of the signal output circuit 41, the scan circuit 42, and the image display panel 30 are also not depicted in the example illustrated in FIG. 39.

Similarly to the first modification illustrated in FIG. 23, in the fourth modification illustrated in FIG. 39, the first sub-pixel (red), the second sub-pixel (green), the third sub-pixel (blue), the first sub-pixel (red), the second sub-pixel (green), and the fourth sub-pixel (white) are sequentially arrayed in this order in each sub-pixel row. These sub-pixels are arranged in the Y direction such that each of the first sub-pixel (red), the second sub-pixel (green), the third sub-pixel (blue), the first sub-pixel (red), the second sub-pixel (green), and the fourth sub-pixel (white) belonging to the even-numbered sub-pixel row is shifted in the X direction by three sub-pixels with respect to a corresponding sub-pixel belonging to the odd-numbered row.

Similarly to the first modification illustrated in FIG. 23 and the third modification illustrated in FIG. 36, in the fourth modification illustrated in FIG. 39, each signal line DTL is coupled alternately in the Y direction to one sub-pixel 49 belonging to the first sub-pixel column and another sub-pixel 49 belonging to the second sub-pixel column adjacent to the first sub-pixel column. Specifically, an example is illustrated in which, in the N−1th (where N is an integer of two or greater) and N+1th sub-pixel rows, each signal line DTL is coupled to a part of the sub-pixels 49 belonging to a sub-pixel column on the right side in FIG. 39 of the signal line DTL, and, in the Nth and N+2th sub-pixel rows, each signal line DTL is coupled to a part of the sub-pixels 49 belonging to a sub-pixel column on the left side in FIG. 39 of the signal line DTL.

In the fourth modification illustrated in FIG. 39, each of the first selector signal SEL1, the second selector signal SEL2, and the third selector signal SEL3 selects a pair of the signal lines DTL each supplied with either of the first source signal S1 and the second source signal S2 each having a mutually reverse polarity and a pair of the signal lines DTL each supplied with either of the third source signal S3 and the fourth source signal S4 each having a mutually reverse polarity. The magnitude of the potential +V of the first source signal S1 relative to the potential of the common electrode COML is substantially equal to the magnitude of the potential −V of the second source signal S2 relative to the potential of the common electrode COML. The magnitude of the potential +V of the third source signal S3 relative to the potential of the common electrode COML is substantially equal to the magnitude of the potential −V of the fourth source signal S4 relative to the potential of the common electrode COML. In this example, to display the single-colored window image 30W illustrated in FIG. 4, the magnitude of the potential +V of the first source signal S1 relative to the potential of the common electrode COML, the magnitude of the potential −V of the second source signal S2 relative to the potential of the common electrode COML, the magnitude of the potential +V of the third source signal S3 relative to the potential of the common electrode COML, and the magnitude of the potential −V of the fourth source signal S4 relative to the potential of the common electrode COML are substantially equal to one another.

Specifically, the signal line DTL1 is supplied with the second source signal S2 having the negative (−) polarity selected by the first selector signal SEL1.

The signal line DTL2 is supplied with the first source signal S1 having the positive (+) polarity selected by the first selector signal SEL1.

The signal line DTL3 is supplied with the first source signal S1 having the positive (+) polarity selected by the second selector signal SEL2.

The signal line DTL4 is supplied with the second source signal S2 having the negative (−) polarity selected by the second selector signal SEL2.

The signal line DTL5 is supplied with the second source signal S2 having the negative (−) polarity selected by the third selector signal SEL3.

The signal line DTL6 is supplied with the first source signal S1 having the positive (+) polarity selected by the third selector signal SEL3.

The signal line DTL7 is supplied with the third source signal S3 having the positive (+) polarity selected by the first selector signal SEL1.

The signal line DTL8 is supplied with the fourth source signal S4 having the negative (−) polarity selected by the first selector signal SEL1.

The signal line DTL9 is supplied with the fourth source signal S4 having the negative (−) polarity selected by the second selector signal SEL2.

The signal line DTL10 is supplied with the third source signal S3 having the positive (+) polarity selected by the second selector signal SEL2.

The signal line DTL11 is supplied with the third source signal S3 having the positive (+) polarity selected by the third selector signal SEL3.

The signal line DTL12 is supplied with the fourth source signal S4 having the negative (−) polarity selected by the third selector signal SEL3.

Figure 40:
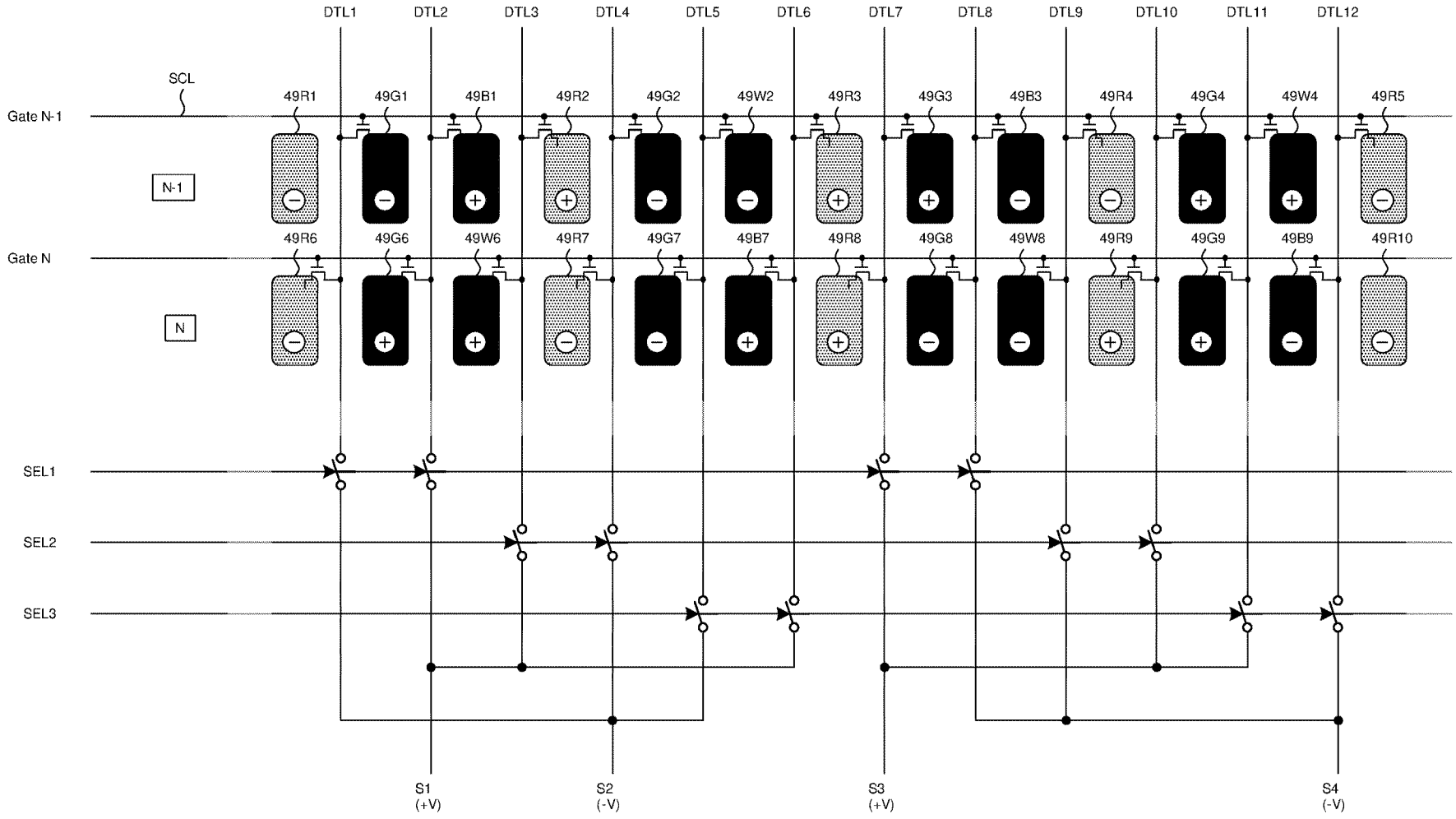
FIG. 40 is a diagram illustrating a state of the N−1th row and the Nth row when the window display illustrated in FIG. 4 is made in the first primary color (red) in the fourth modification illustrated in FIG. 39.
Figure 42:
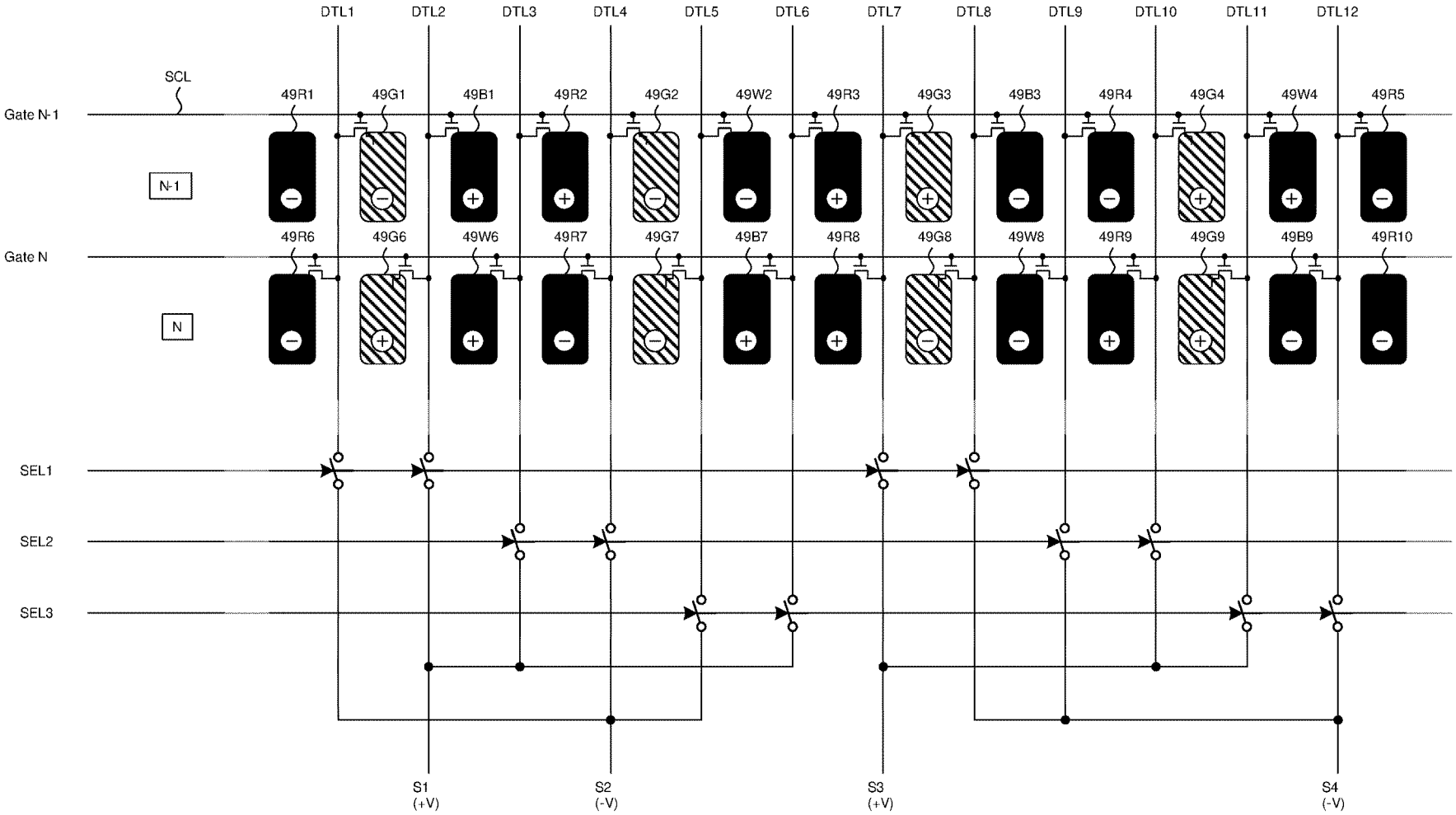
FIG. 42 is a diagram illustrating a state of the N−1th row and the Nth row when the window display illustrated in FIG. 4 is made in the second primary color (green) in the fourth modification illustrated in FIG. 39.
Figure 44:
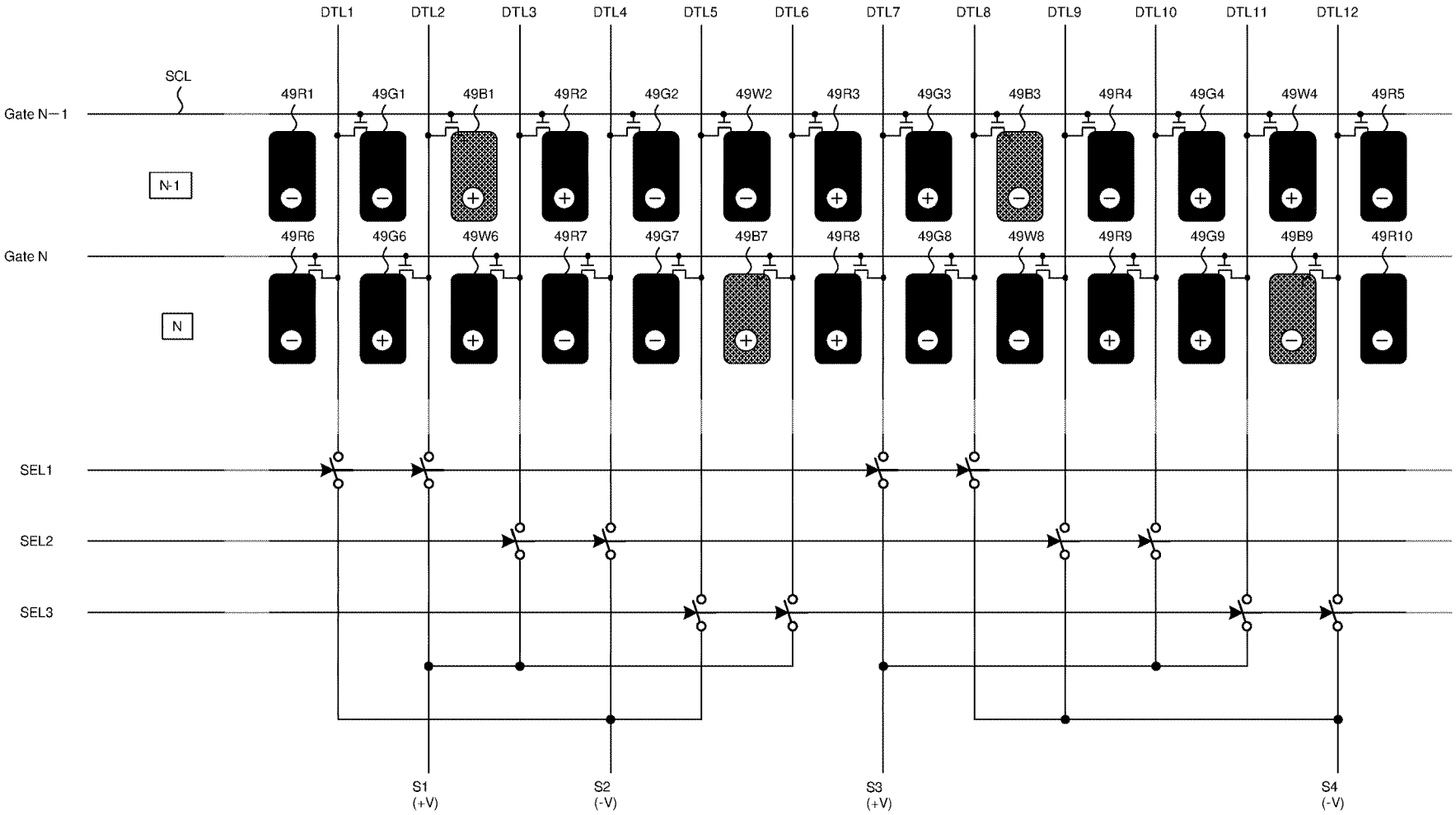
FIG. 44 is a diagram illustrating a state of the N−1th row and the Nth row when the window display illustrated in FIG. 4 is made in the third primary color (blue) in the fourth modification illustrated in FIG. 39.

FIG. 40 is a diagram illustrating a state of the N−1th row and the Nth row when the window display illustrated in FIG. 4 is made in the first primary color (red) in the fourth modification illustrated in FIG. 39. FIG. 41 is a table indicating the potential changes of the respective signal lines when the window display illustrated in FIG. 4 is made in the first primary color (red) in the fourth modification illustrated in FIG. 39. FIG. 42 is a diagram illustrating a state of the N−1th row and the Nth row when the window display illustrated in FIG. 4 is made in the second primary color (green) in the fourth modification illustrated in FIG. 39. FIG. 43 is a table indicating the potential changes of the respective signal lines when the window display illustrated in FIG. 4 is made in the second primary color (green) in the fourth modification illustrated in FIG. 39. FIG. 44 is a diagram illustrating a state of the N−1th row and the Nth row when the window display illustrated in FIG. 4 is made in the third primary color (blue) in the fourth modification illustrated in FIG. 39. FIG. 45 is a table indicating the potential changes of the respective signal lines when the window display illustrated in FIG. 4 is made in the third primary color (blue) in the fourth modification illustrated in FIG. 39.

In the fourth modification illustrated in FIG. 39, when each of the sub-pixel columns is sequentially selected, the sum of the potential changes of the signal lines DTL1, DTL2, DTL7, and DTL8 selected by the first selector signal SEL1 is substantially zero (≈0), as illustrated in FIGS. 40 to 45. The sum of the potential changes of the signal lines DTL3, DTL4, DTL9, and DTL10 selected by the second selector signal SEL2 is also substantially zero (≈0). Further, the sum of the potential changes of the signal lines DTL5, DTL6, DTL11, and DTL12 selected by the third selector signal SEL3 is also substantially zero (≈0).

In this manner, also in the fourth modification illustrated in FIG. 39, the sum of the potential changes of the respective signal lines DTL selected by each of the selector signals is substantially zero (≈0) when each of the sub-pixel columns is sequentially selected, thereby preventing the deterioration in display quality caused by the crosstalk.

Fifth Modification

Figure 46:
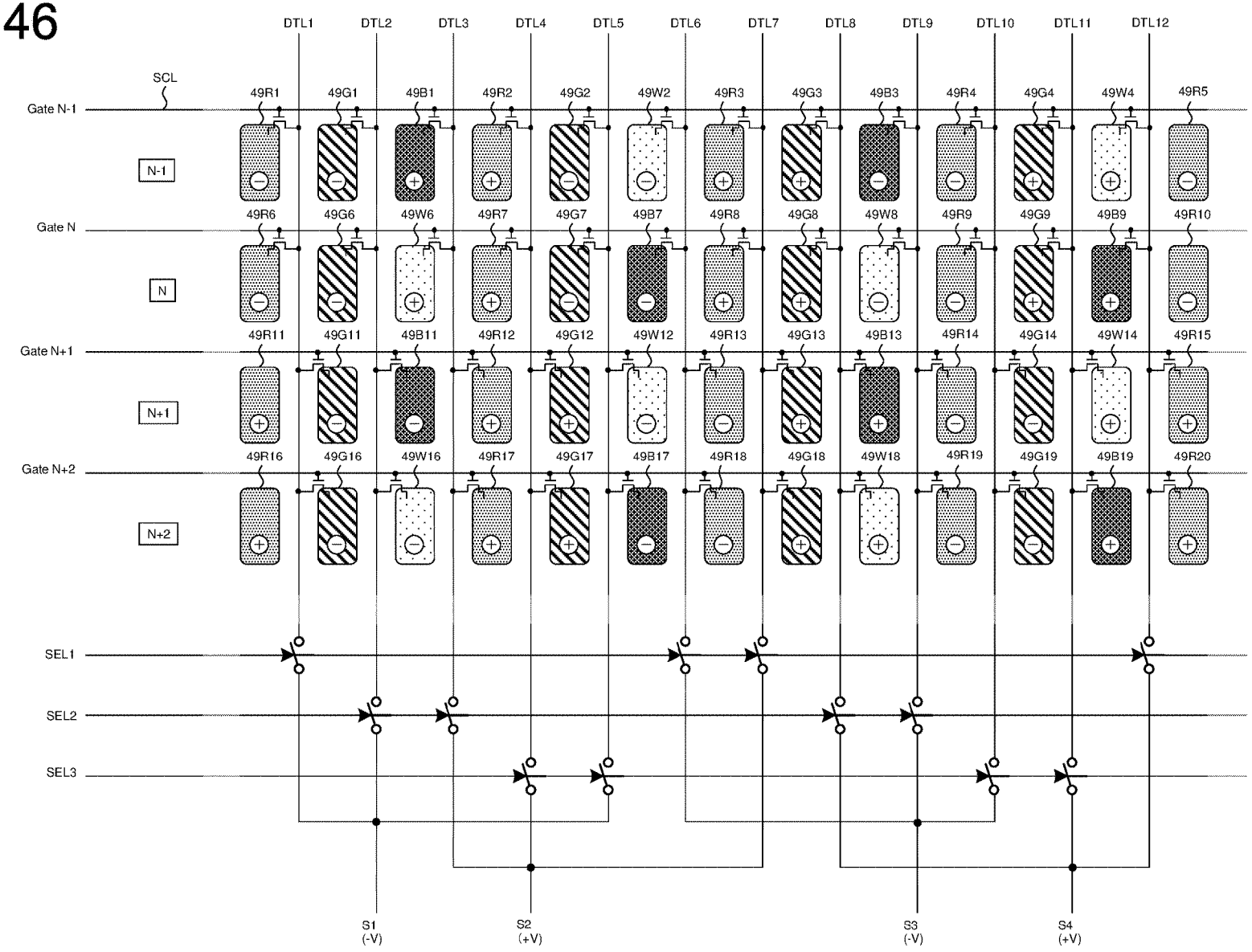
FIG. 46 is a schematic diagram illustrating a fifth modification of the pixel array and the internal configuration of the signal output circuit in the display device according to the embodiment.

FIG. 46 is a schematic diagram illustrating a fifth modification of the pixel array and the internal configuration of the signal output circuit in the display device according to the embodiment. Similarly to the fourth modification illustrated in FIG. 39, the fifth modification illustrated in FIG. 46 represents a configuration example including the first sub-pixel for displaying the first primary color (e.g., red), the second sub-pixel for displaying the second primary color (e.g., green), the third sub-pixel for displaying the third primary color (e.g., blue), and the fourth sub-pixel for displaying the fourth color (i.e., white). The frameworks of the signal output circuit 41, the scan circuit 42, and the image display panel 30 are also not depicted in the example illustrated in FIG. 46.

Similarly to the fourth modification illustrated in FIG. 39, in the fifth modification illustrated in FIG. 46, the first sub-pixel (red), the second sub-pixel (green), the third sub-pixel (blue), the first sub-pixel (red), the second sub-pixel (green), and the fourth sub-pixel (white) are sequentially arrayed in this order in each sub-pixel row. These sub-pixels are arranged in the Y direction such that each of the first sub-pixel (red), the second sub-pixel (green), the third sub-pixel (blue), the first sub-pixel (red), the second sub-pixel (green), and the fourth sub-pixel (white) belonging to the even-numbered sub-pixel row is shifted in the X direction by three sub-pixels with respect to a corresponding sub-pixel belonging to the odd-numbered row.

Similarly to the example illustrated in FIG. 7 and the second modification illustrated in FIG. 28, in the fifth modification illustrated in FIG. 46, each signal line DTL is coupled alternately in the Y direction to two consecutive sub-pixels 49 belonging to the first sub-pixel column and two consecutive sub-pixels 49 belonging to the second sub-pixel column adjacent to the first sub-pixel column. Specifically, an example is illustrated in which, in the N−1th (where N is an integer of two or greater) and Nth sub-pixel rows, each signal line DTL is coupled to a part of the sub-pixels 49 belonging to a sub-pixel column on the left side in FIG. 46 of the signal line DTL, and, in the N+1th and N+2th sub-pixel rows, each signal line DTL is coupled to a part of the sub-pixels 49 belonging to a sub-pixel column on the right side in FIG. 46 of the signal line DTL.

In the fifth modification illustrated in FIG. 46, each of the first selector signal SEL1, the second selector signal SEL2, and the third selector signal SEL3 selects a pair of the signal lines DTL each supplied with either of the first source signal S1 and the second source signal S2 each having a mutually reverse polarity and a pair of the signal lines DTL each supplied with either of the third source signal S3 and the fourth source signal S4 each having a mutually reverse polarity. The magnitude of the potential −V of the first source signal S1 relative to the potential of the common electrode COML is substantially equal to the magnitude of the potential +V of the second source signal S2 relative to the potential of the common electrode COML. The magnitude of the potential −V of the third source signal S3 relative to the potential of the common electrode COML is substantially equal to the magnitude of the potential +V of the fourth source signal S4 relative to the potential of the common electrode COML. In this example, to display the single-colored window image 30W illustrated in FIG. 4, the magnitude of the potential −V of the first source signal S1 relative to the potential of the common electrode COML, the magnitude of the potential +V of the second source signal S2 relative to the potential of the common electrode COML, the magnitude of the potential −V of the third source signal S3 relative to the potential of the common electrode COML, and the magnitude of the potential +V of the fourth source signal S4 relative to the potential of the common electrode COML are substantially equal to one another.

Specifically, the signal line DTL1 is supplied with the first source signal S1 having the negative (−) polarity selected by the first selector signal SEL1.

The signal line DTL2 is supplied with the first source signal S1 having the negative (−) polarity selected by the second selector signal SEL2.

The signal line DTL3 is supplied with the second source signal S2 having the positive (+) polarity selected by the second selector signal SEL2.

The signal line DTL4 is supplied with the second source signal S2 having the positive (+) polarity selected by the third selector signal SEL3.

The signal line DTL5 is supplied with the first source signal S1 having the negative (−) polarity selected by the third selector signal SEL3.

The signal line DTL6 is supplied with the third source signal S3 having the negative (−) polarity selected by the first selector signal SEL1.

The signal line DTL7 is supplied with the second source signal S2 having the positive (+) polarity selected by the first selector signal SEL1.

The signal line DTL8 is supplied with the fourth source signal S4 having the positive (+) polarity selected by the second selector signal SEL2.

The signal line DTL9 is supplied with the third source signal S3 having the negative (−) polarity selected by the second selector signal SEL2.

The signal line DTL10 is supplied with the third source signal S3 having the negative (−) polarity selected by the third selector signal SEL3.

The signal line DTL11 is supplied with the fourth source signal S4 having the positive (+) polarity selected by the third selector signal SEL3.

The signal line DTL12 is supplied with the fourth source signal S4 having the positive (+) polarity selected by the first selector signal SEL1.

Figure 47:
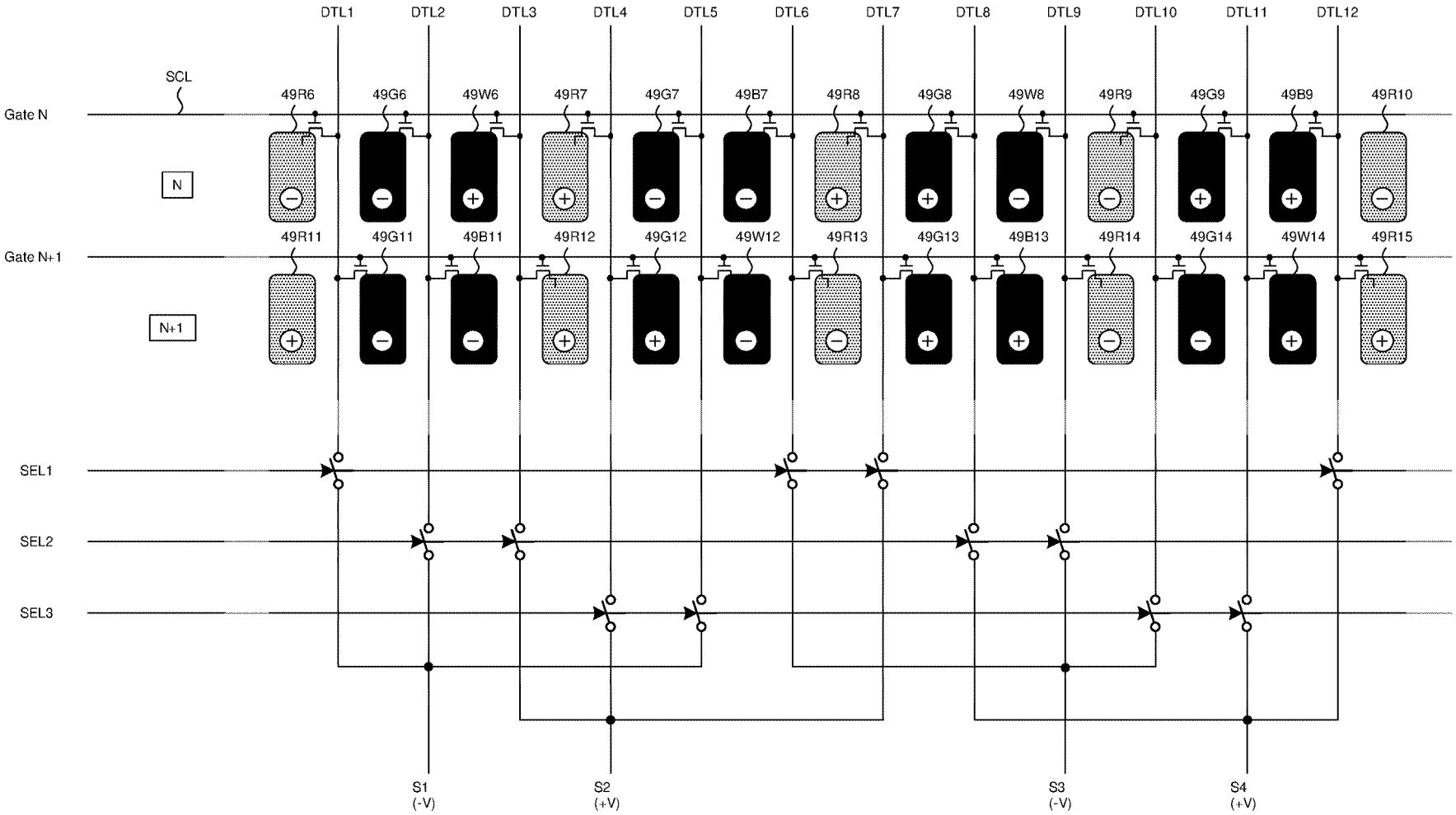
FIG. 47 is a diagram illustrating a state of the Nth row and the N+1th row when the window display illustrated in FIG. 4 is made in the first primary color (red) in the fifth modification illustrated in FIG. 46.
Figure 49:
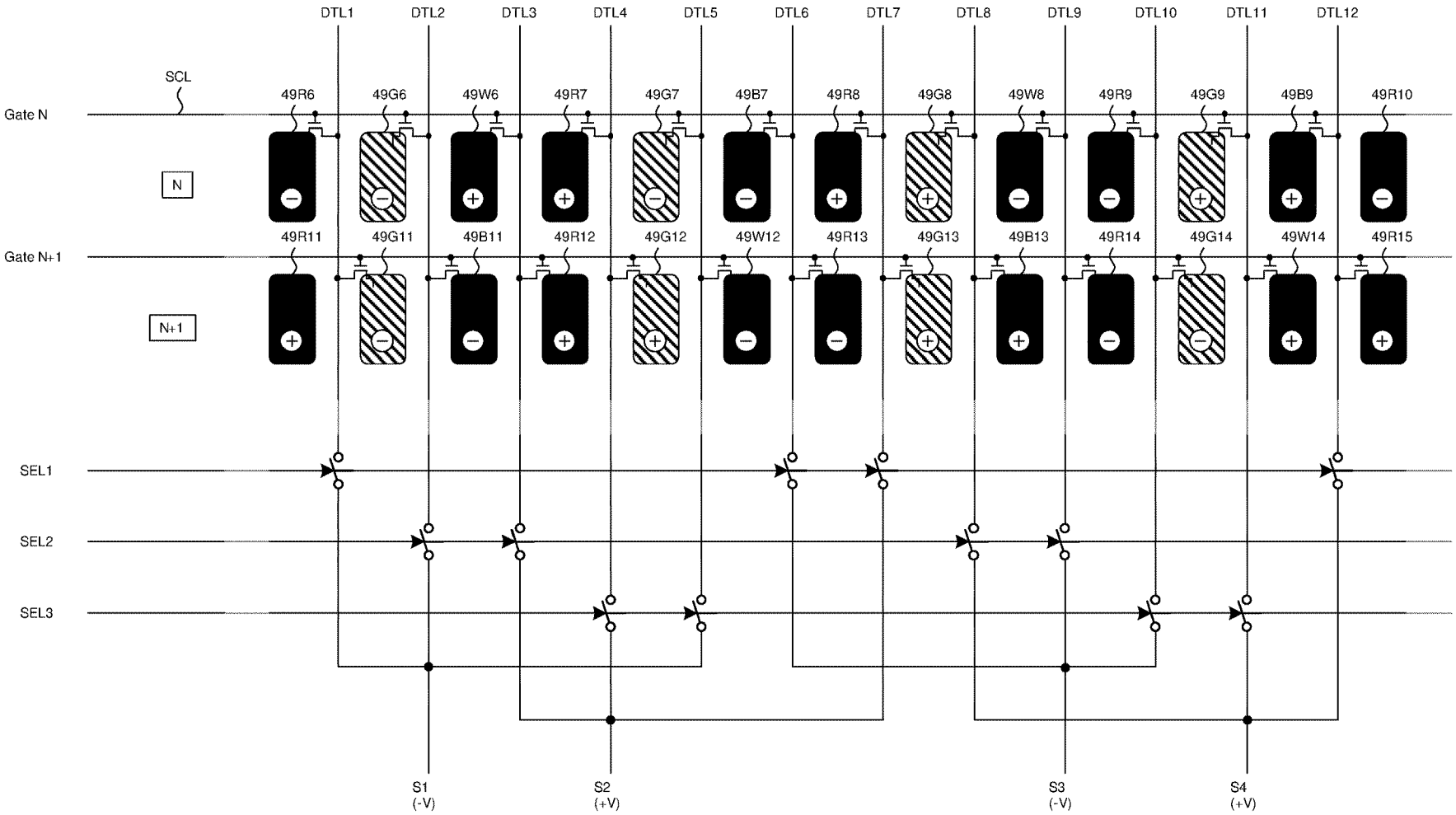
FIG. 49 is a diagram illustrating a state of the Nth row and the N+1th row when the window display illustrated in FIG. 4 is made in the second primary color (green) in the fifth modification illustrated in FIG. 46.
Figure 51:
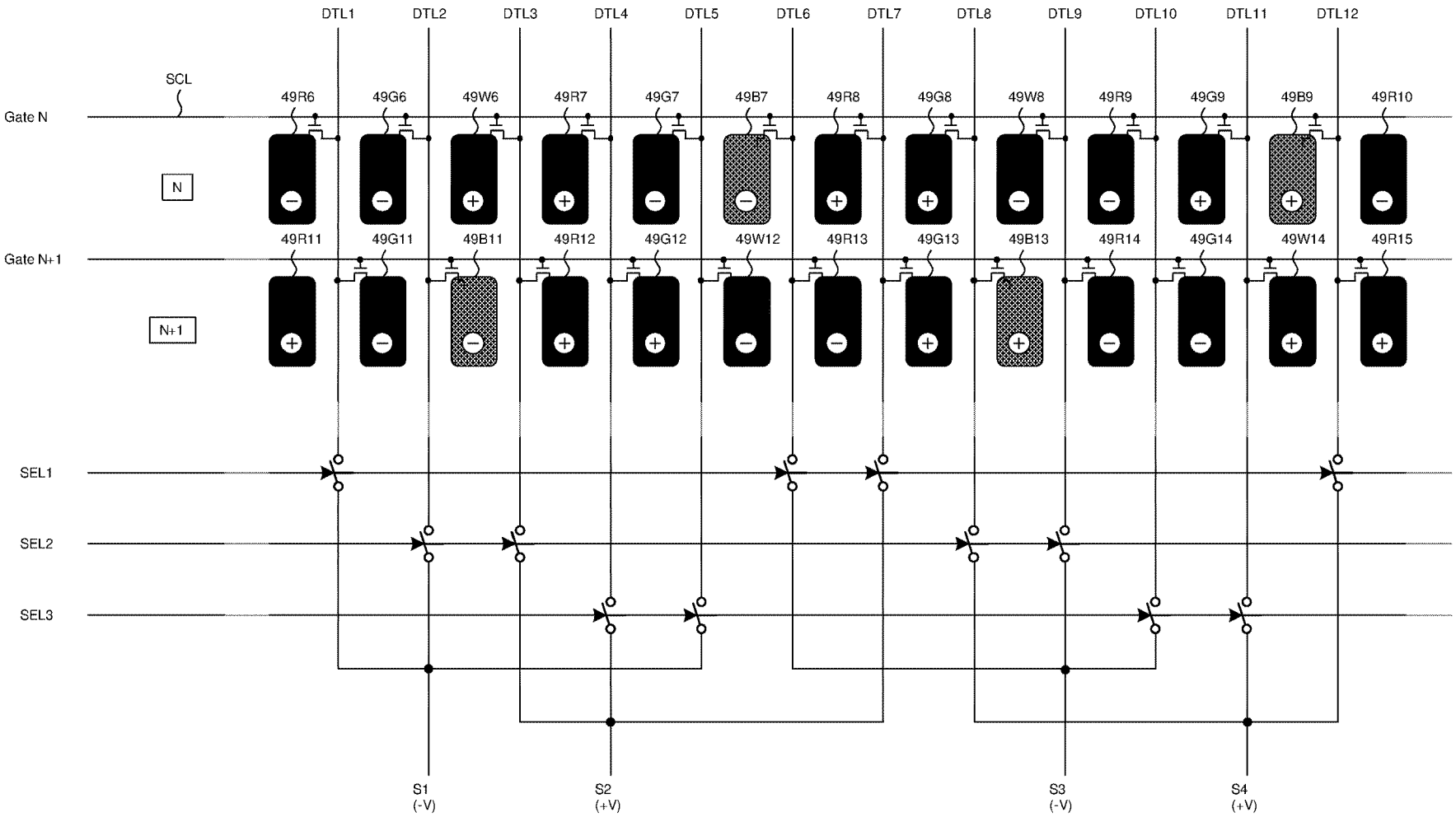
FIG. 51 is a diagram illustrating a state of the Nth row and the N+1th row when the window display illustrated in FIG. 4 is made in the third primary color (blue) in the fifth modification illustrated in FIG. 46.

FIG. 47 is a diagram illustrating a state of the Nth row and the N+1th row when the window display illustrated in FIG. 4 is made in the first primary color (red) in the fifth modification illustrated in FIG. 46. FIG. 48 is a table indicating the potential changes of the respective signal lines when the window display illustrated in FIG. 4 is made in the first primary color (red) in the fifth modification illustrated in FIG. 46. FIG. 49 is a diagram illustrating a state of the Nth row and the N+1th row when the window display illustrated in FIG. 4 is made in the second primary color (green) in the fifth modification illustrated in FIG. 46. FIG. 50 is a table indicating the potential changes of the respective signal lines when the window display illustrated in FIG. 4 is made in the second primary color (green) in the fifth modification illustrated in FIG. 46. FIG. 51 is a diagram illustrating a state of the Nth row and the N+1th row when the window display illustrated in FIG. 4 is made in the third primary color (blue) in the fifth modification illustrated in FIG. 46. FIG. 52 is a table indicating the potential changes of the respective signal lines when the window display illustrated in FIG. 4 is made in the third primary color (blue) in the fifth modification illustrated in FIG. 46.

In the fifth modification illustrated in FIG. 46, when each of the sub-pixel columns is sequentially selected, the sum of the potential changes of the signal lines DTL1, DTL6, DTL7, and DTL12 selected by the first selector signal SEL1 is substantially zero (≈0) as illustrated in FIGS. 47 to 52. The sum of the potential changes of the signal lines DTL2, DTL3, DTL8, and DTL9 selected by the second selector signal SEL2 is also substantially zero (≈0). Further, the sum of the potential changes of the signal lines DTL4, DTL5, DTL10, and DTL11 selected by the third selector signal SEL3 is also substantially zero (≈0).

In this manner, also in the fifth modification illustrated in FIG. 46, the sum of the potential changes of the respective signal lines DTL selected by each of the selector signals is substantially zero (≈0) when each of the sub-pixel columns is sequentially selected, thereby preventing the deterioration in display quality caused by the crosstalk.

Sixth Modification

Figure 53:
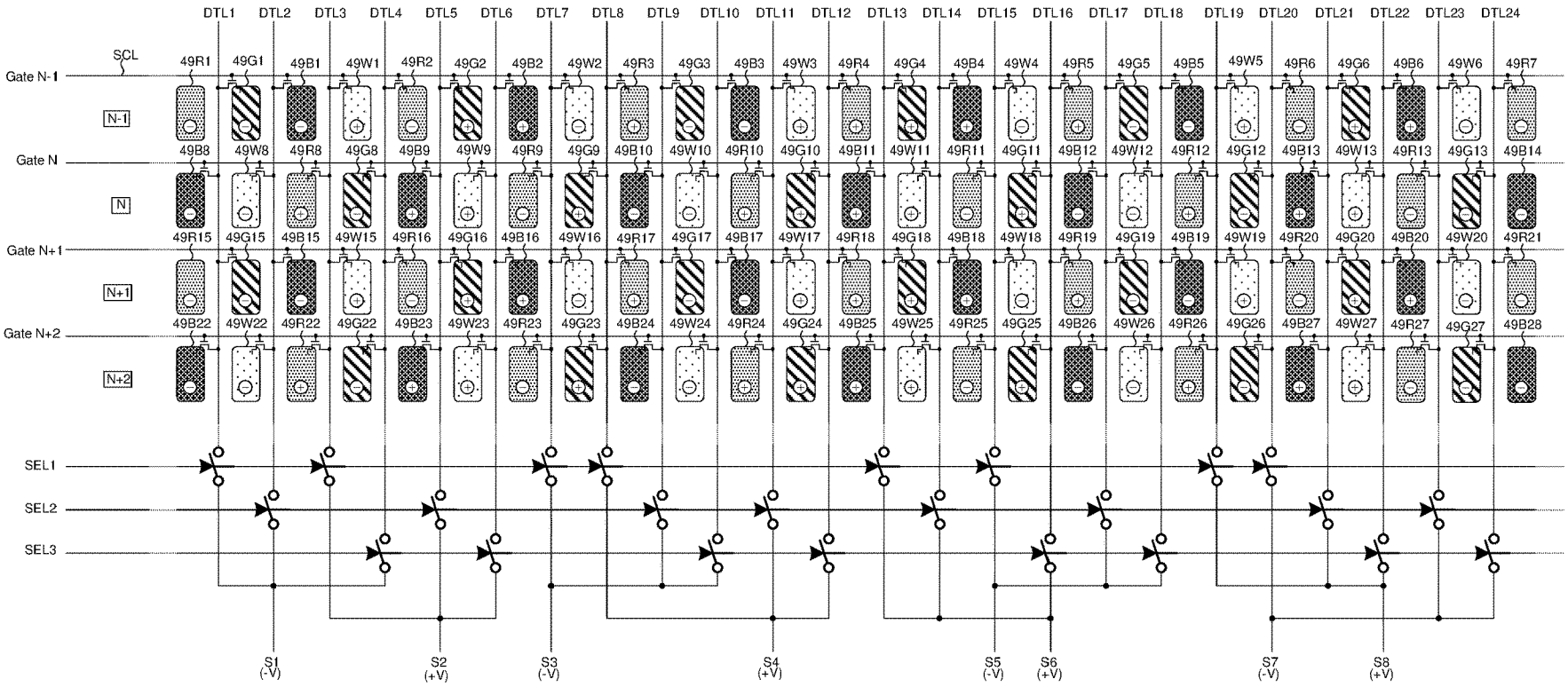
FIG. 53 is a schematic diagram illustrating a sixth modification of the pixel array and the internal configuration of the signal output circuit in the display device according to the embodiment.

FIG. 53 is a schematic diagram illustrating a sixth modification of the pixel array and the internal configuration of the signal output circuit in the display device according to the embodiment. Similarly to the fourth modification illustrated in FIG. 39 and the fifth modification illustrated in FIG. 46, the sixth modification illustrated in FIG. 53 represents a configuration example including the first sub-pixel for displaying the first primary color (e.g., red), the second sub-pixel for displaying the second primary color (e.g., green), the third sub-pixel for displaying the third primary color (e.g., blue), and the fourth sub-pixel for displaying the fourth color (specifically, white). The frameworks of the signal output circuit 41, the scan circuit 42, and the image display panel 30 are also not depicted in the example illustrated in FIG. 53.

In the sixth modification illustrated in FIG. 53, the first sub-pixel (red), the second sub-pixel (green), the third sub-pixel (blue), and the fourth sub-pixel (white) are sequentially arrayed in this order in each sub-pixel row. These sub-pixels are arranged in the Y direction such that each of the first sub-pixel (red), the second sub-pixel (green), the third sub-pixel (blue), and the fourth sub-pixel (white) belonging to the even-numbered sub-pixel row is shifted in the X direction by two sub-pixels with respect to a corresponding sub-pixel belonging to the odd-numbered row.

Similarly to the first modification illustrated in FIG. 23, the third modification illustrated in FIG. 36, and the fourth modification illustrated in FIG. 39, in the sixth modification illustrated in FIG. 53, each signal line DTL is coupled alternately in the Y direction to one sub-pixel 49 belonging to the first sub-pixel column and another sub-pixel 49 belonging to the second sub-pixel column adjacent to the first sub-pixel column. Specifically, an example is illustrated in which, in the N−1th (where N is an integer of two or greater) and N+1th sub-pixel rows, each signal line DTL is coupled to a part of the sub-pixels 49 belonging to a sub-pixel column on the right side in FIG. 53 of the signal line DTL, and, in the Nth and N+2th sub-pixel rows, each signal line DTL is coupled to a part of the sub-pixels 49 belonging to a sub-pixel column on the left side in FIG. 53 of the signal line DTL.

In the sixth modification illustrated in FIG. 53, each of the first selector signal SEL1, the second selector signal SEL2, and the third selector signal SEL3 selects a pair of the signal lines DTL each supplied with either of the first source signal S1 and the second source signal S2 each having a mutually reverse polarity, a pair of the signal lines DTL each supplied with either of the third source signal S3 and the fourth source signal S4 each having a mutually reverse polarity, a pair of the signal lines DTL each supplied with either of the fifth source signal S5 and the sixth source signal S6 each having a mutually reverse polarity, and a pair of the signal lines DTL each supplied with either of a seventh source signal S7 and an eighth source signal S8 each having a mutually reverse polarity. The magnitude of the potential −V of the first source signal S1 relative to the potential of the common electrode COML is substantially equal to the magnitude of the potential +V of the second source signal S2 relative to the potential of the common electrode COML. The magnitude of the potential −V of the third source signal S3 relative to the potential of the common electrode COML is substantially equal to the magnitude of the potential +V of the fourth source signal S4 relative to the potential of the common electrode COML. The magnitude of the potential −V of the fifth source signal S5 relative to the potential of the common electrode COML is substantially equal to the magnitude of the potential +V of the sixth source signal S6 relative to the potential of the common electrode COML. The magnitude of the potential −V of the seventh source signal S7 relative to the potential of the common electrode COML is substantially equal to the magnitude of the potential +V of the eighth source signal S8 relative to the potential of the common electrode COML. In this example, to display the single-colored window image 30W illustrated in FIG. 4, the magnitude of the potential −V of the first source signal S1 relative to the potential of the common electrode COML, the magnitude of the potential +V of the second source signal S2 relative to the potential of the common electrode COML, the magnitude of the potential −V of the third source signal S3 relative to the potential of the common electrode COML, the magnitude of the potential +V of the fourth source signal S4 relative to the potential of the common electrode COML, the magnitude of the potential −V of the fifth source signal S5 relative to the potential of the common electrode COML, the magnitude of the potential +V of the sixth source signal S6 relative to the potential of the common electrode COML, the magnitude of the potential −V of the seventh source signal S7 relative to the potential of the common electrode COML, and the magnitude of the potential +V of the eighth source signal S8 relative to the potential of the common electrode COML are substantially equal to one another.

Specifically, the signal line DTL1 is supplied with the first source signal S1 having the negative (−) polarity selected by the first selector signal SEL1.

The signal line DTL2 is supplied with the first source signal S1 having the negative (−) polarity selected by the second selector signal SEL2.

The signal line DTL3 is supplied with the second source signal S2 having the positive (+) polarity selected by the first selector signal SEL1.

The signal line DTL4 is supplied with the first source signal S1 having the negative (−) polarity selected by the third selector signal SEL3.

The signal line DTL5 is supplied with the second source signal S2 having the positive (+) polarity selected by the second selector signal SEL2.

The signal line DTL6 is supplied with the second source signal S2 having the positive (+) polarity selected by the third selector signal SEL3.

The signal line DTL7 is supplied with the third source signal S3 having the negative (−) polarity selected by the first selector signal SEL1.

The signal line DTL8 is supplied with the fourth source signal S4 having the positive (+) polarity selected by the first selector signal SEL1.

The signal line DTL9 is supplied with the third source signal S3 having the negative (−) polarity selected by the second selector signal SEL2.

The signal line DTL10 is supplied with the third source signal S3 having the negative (−) polarity selected by the third selector signal SEL3.

The signal line DTL11 is supplied with the fourth source signal S4 having the positive (+) polarity selected by the second selector signal SEL2.

The signal line DTL12 is supplied with the fourth source signal S4 having the positive (+) polarity selected by the third selector signal SEL3.

The signal line DTL13 is supplied with the sixth source signal S6 having the positive (+) polarity selected by the first selector signal SEL1.

The signal line DTL14 is supplied with the sixth source signal S6 having the positive (+) polarity selected by the second selector signal SEL2.

The signal line DTL15 is supplied with the fifth source signal S5 having the negative (−) polarity selected by the first selector signal SEL1.

The signal line DTL16 is supplied with the sixth source signal S6 having the positive (+) polarity selected by the third selector signal SEL3.

The signal line DTL17 is supplied with the fifth source signal S5 having the negative (−) polarity selected by the second selector signal SEL2.

The signal line DTL18 is supplied with the fifth source signal S5 having the negative (−) polarity selected by the third selector signal SEL3.

The signal line DTL19 is supplied with the eighth source signal S8 having the positive (+) polarity selected by the first selector signal SEL1.

The signal line DTL20 is supplied with the seventh source signal S7 having the negative (−) polarity selected by the first selector signal SEL1.

The signal line DTL21 is supplied with the eighth source signal S8 having the positive (+) polarity selected by the second selector signal SEL2.

The signal line DTL22 is supplied with the eighth source signal S8 having the positive (+) polarity selected by the third selector signal SEL3.

The signal line DTL23 is supplied with the seventh source signal S7 having the negative (−) polarity selected by the second selector signal SEL2.

The signal line DTL24 is supplied with the seventh source signal S7 having the negative (−) polarity selected by the third selector signal SEL3.

Figure 54:
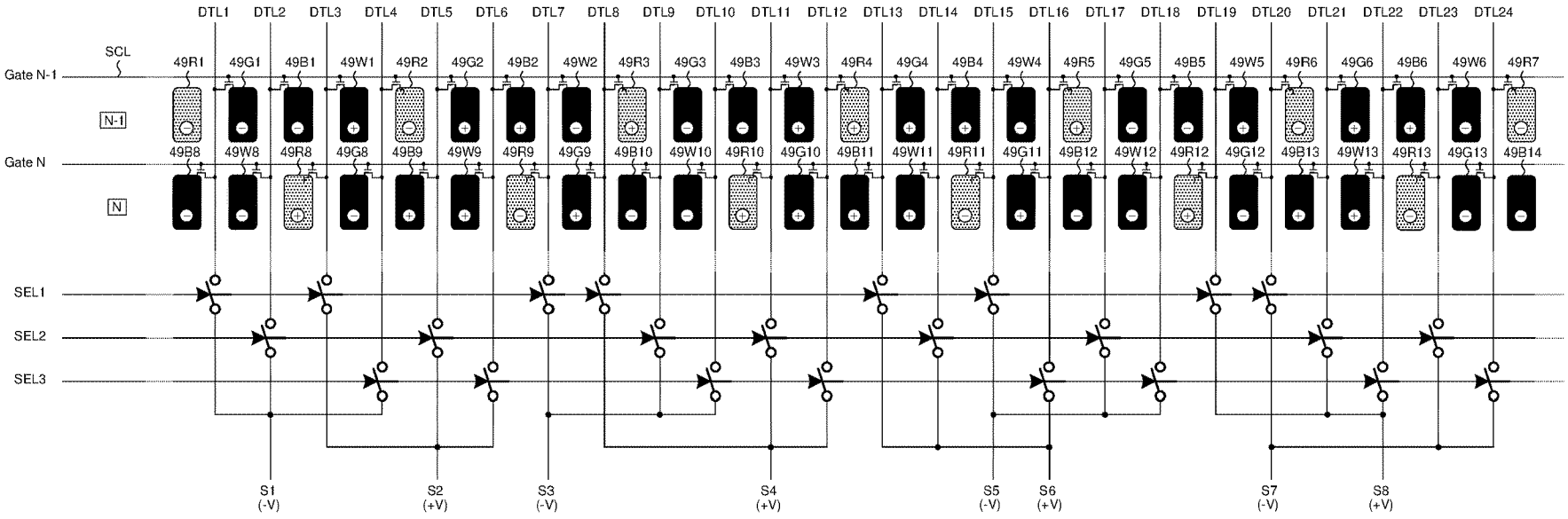
FIG. 54 is a diagram illustrating a state of the N−1th row and the Nth row when the window display illustrated in FIG. 4 is made in the first primary color (red) in the sixth modification illustrated in FIG. 53.
Figure 56:
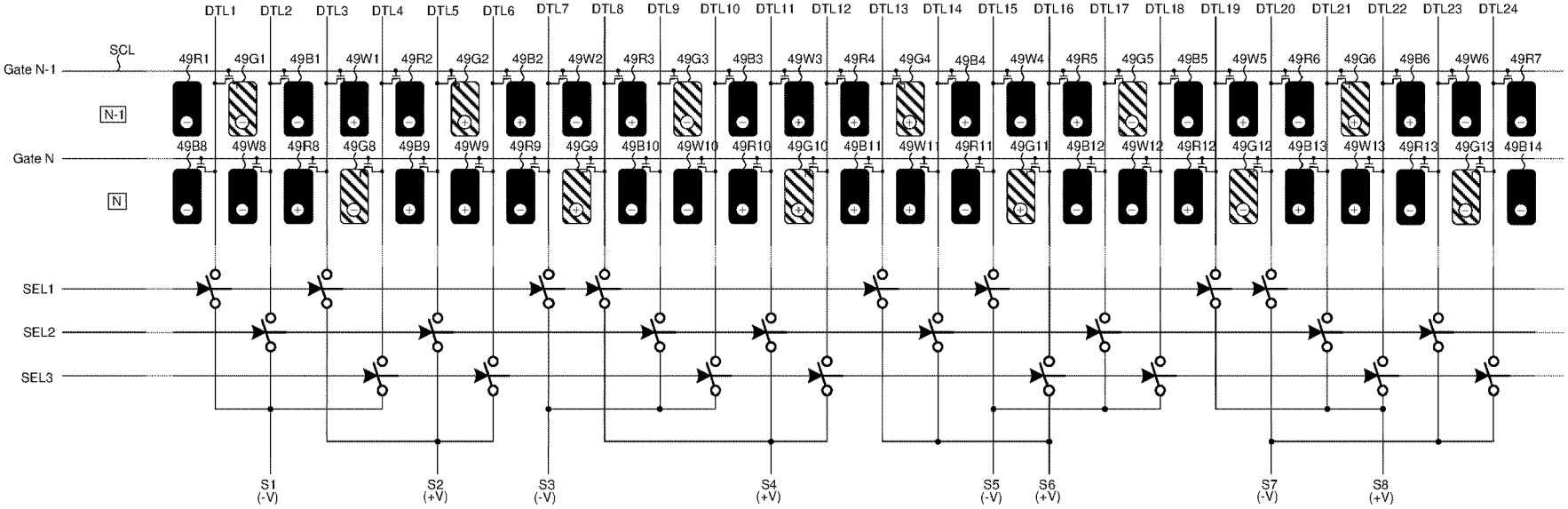
FIG. 56 is a diagram illustrating a state of the N−1th row and the Nth row when the window display illustrated in FIG. 4 is made in the second primary color (green) in the sixth modification illustrated in FIG. 53.
Figure 58:
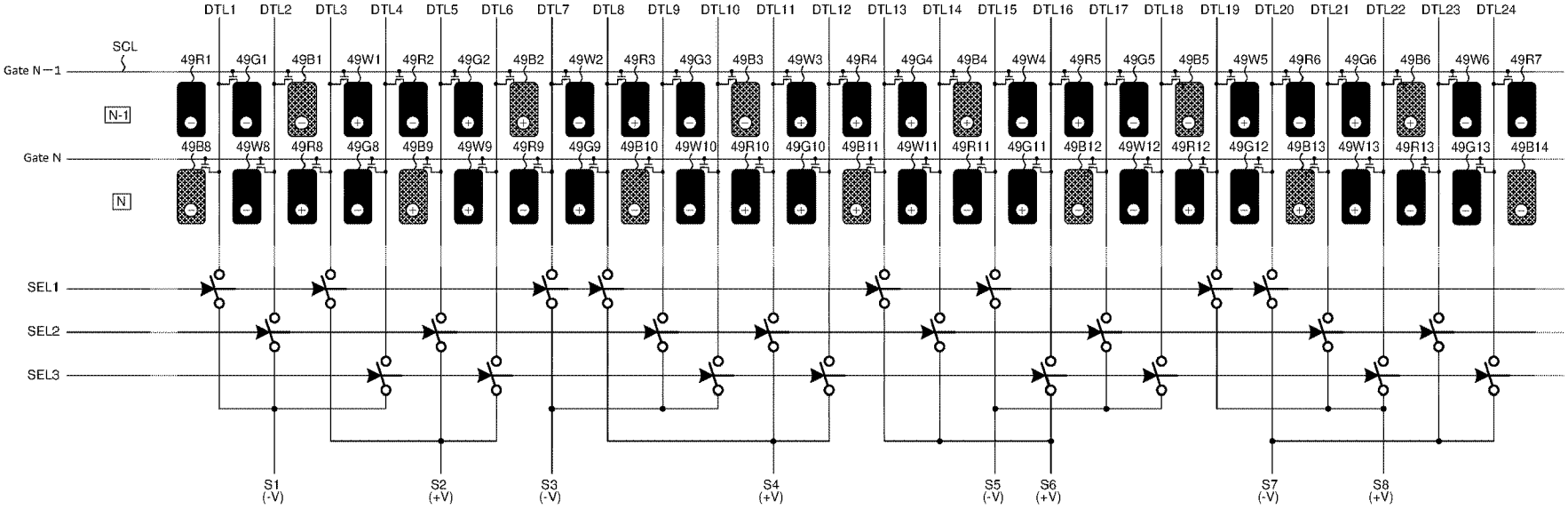
FIG. 58 is a diagram illustrating a state of the N−1th row and the Nth row when the window display illustrated in FIG. 4 is made in the third primary color (blue) in the sixth modification illustrated in FIG. 53.

FIG. 54 is a diagram illustrating a state of the N−1th row and the Nth row when the window display illustrated in FIG. 4 is made in the first primary color (red) in the sixth modification illustrated in FIG. 53. FIG. 55 is a table indicating the potential changes of the respective signal lines when the window display illustrated in FIG. 4 is made in the first primary color (red) in the sixth modification illustrated in FIG. 53. FIG. 56 is a diagram illustrating a state of the N−1th row and the Nth row when the window display illustrated in FIG. 4 is made in the second primary color (green) in the sixth modification illustrated in FIG. 53. FIG. 57 is a table indicating the potential changes of the respective signal lines when the window display illustrated in FIG. 4 is made in the second primary color (green) in the sixth modification illustrated in FIG. 53. FIG. 58 is a diagram illustrating a state of the N−1th row and the Nth row when the window display illustrated in FIG. 4 is made in the third primary color (blue) in the sixth modification illustrated in FIG. 53. FIG. 59 is a table indicating the potential changes of the respective signal lines when the window display illustrated in FIG. 4 is made in the third primary color (blue) in the sixth modification illustrated in FIG. 53.

In the sixth modification illustrated in FIG. 53, when each of the sub-pixel columns is sequentially selected, the sum of the potential changes of the signal lines DTL1, DTL3, DTL7, DTL8, DTL13, DTL15, DTL19, and DTL20 selected by the first selector signal SEL1 is substantially zero (≈0) as illustrated in FIGS. 54 to 59. The sum of the potential changes of the signal lines DTL2, DTL5, DTL9, DTL11, DTL14, DTL17, DTL21, and DTL23 selected by the second selector signal SEL2 is also substantially zero (≈0). Further, the sum of the potential changes of the signal lines DTL4, DTL6, DTL10, DTL12, DTL16, DTL18, DTL22, and DTL24 selected by the third selector signal SEL3 is also substantially zero (≈0).

In this manner, also in the sixth modification illustrated in FIG. 53, the sum of the potential changes of the respective signal lines DTL selected by each of the selector signals is substantially zero (≈0) when each of the sub-pixel columns is sequentially selected, thereby preventing the deterioration in display quality caused by the crosstalk.

Seventh Modification

Figure 60:
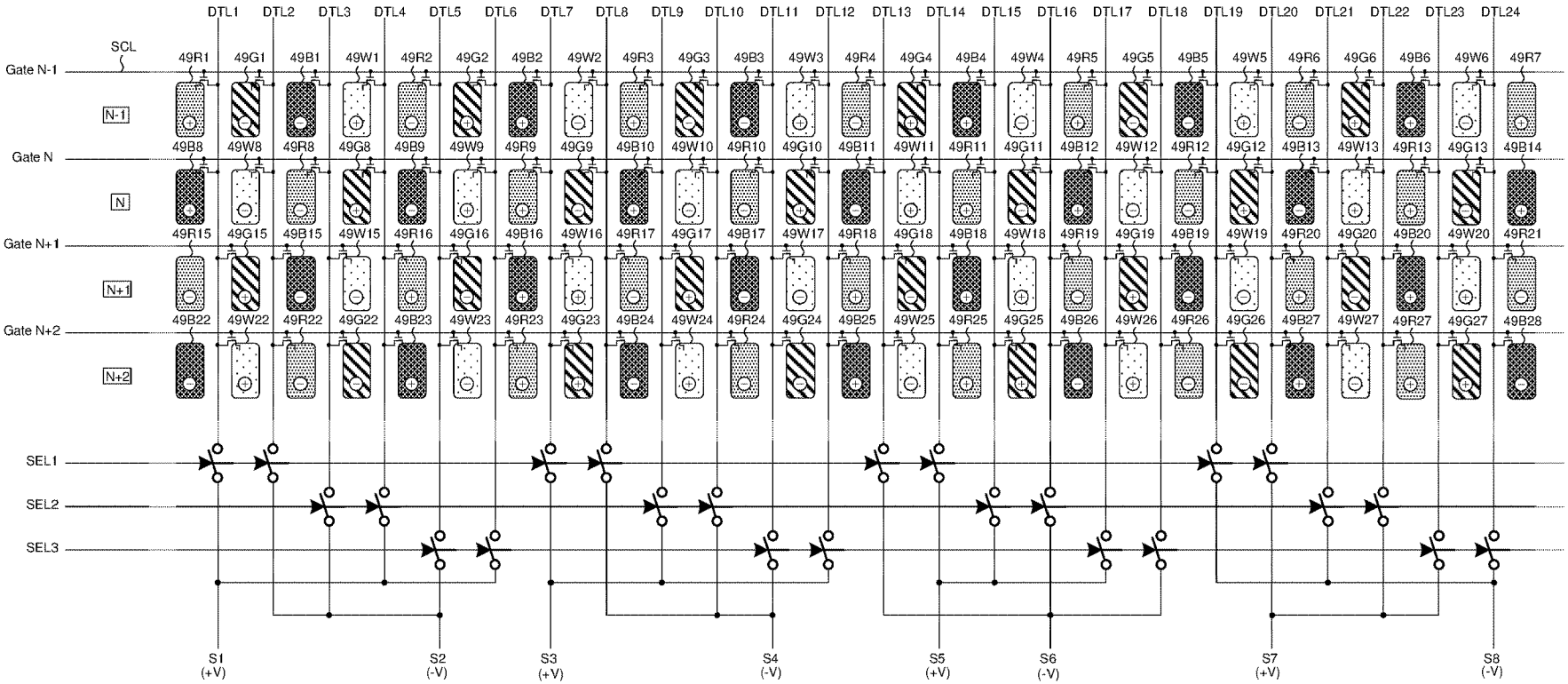
FIG. 60 is a schematic diagram illustrating a seventh modification of the pixel array and the internal configuration of the signal output circuit in the display device according to the embodiment.

FIG. 60 is a schematic diagram illustrating a seventh modification of the pixel array and the internal configuration of the signal output circuit in the display device according to the embodiment. Similarly to the fourth modification illustrated in FIG. 39, the fifth modification illustrated in FIG. 46, and the sixth modification illustrated in FIG. 53, the seventh modification illustrated in FIG. 60 represents a configuration example including the first sub-pixel for displaying the first primary color (e.g., red), the second sub-pixel for displaying the second primary color (e.g., green), the third sub-pixel for displaying the third primary color (e.g., blue), and the fourth sub-pixel for displaying the fourth color (specifically, white). The frameworks of the signal output circuit 41, the scan circuit 42, and the image display panel 30 are also not depicted in the example illustrated in FIG. 60.

Similarly to the sixth modification illustrated in FIG. 53, in the seventh modification illustrated in FIG. 60, the first sub-pixel (red), the second sub-pixel (green), the third sub-pixel (blue), and the fourth sub-pixel (white) are sequentially arrayed in this order in each sub-pixel row. These sub-pixels are arranged in the Y direction such that each of the first sub-pixel (red), the second sub-pixel (green), the third sub-pixel (blue), and the fourth sub-pixel (white) belonging to the even-numbered sub-pixel row is shifted in the X direction by two sub-pixels with respect to a corresponding sub-pixel belonging to the odd-numbered row.

Similarly to the example illustrated in FIG. 7, the second modification illustrated in FIG. 28, and the fifth modification illustrated in FIG. 46, the seventh modification illustrated in FIG. 60 represents an example in which each signal line DTL is coupled alternately in the Y direction to two consecutive sub-pixels 49 belonging to a first sub-pixel column and two consecutive sub-pixels 49 belonging to a second sub-pixel column adjacent to the first sub-pixel column. Specifically, an example is illustrated in which, in the N−1th (where N is an integer of two or greater) and Nth sub-pixel rows, each signal line DTL is coupled to a part of the sub-pixels 49 belonging to a sub-pixel column on the left side in FIG. 60 of the signal line DTL, and, in the N+1th and N+2th sub-pixel rows, each signal line DTL is coupled to a part of the sub-pixels 49 belonging to a sub-pixel column on the right side in FIG. 60 of the signal line DTL.

In the seventh modification illustrated in FIG. 60, each of the first selector signal SEL1, the second selector signal SEL2, and the third selector signal SEL3 selects a pair of the signal lines DTL each supplied with either of the first source signal S1 and the second source signal S2 each having a mutually reverse polarity, a pair of the signal lines DTL each supplied with either of the third source signal S3 and the fourth source signal S4 each having a mutually reverse polarity, a pair of the signal lines DTL each supplied with either of the fifth source signal S5 and the sixth source signal S6 each having a mutually reverse polarity, and a pair of the signal lines DTL each supplied with either of the seventh source signal S7 and the eighth source signal S8 each having a mutually reverse polarity. The magnitude of the potential +V of the first source signal S1 relative to the potential of the common electrode COML is substantially equal to the magnitude of the potential −V of the second source signal S2 relative to the potential of the common electrode COML. The magnitude of the potential +V of the third source signal S3 relative to the potential of the common electrode COML is substantially equal to the magnitude of the potential −V of the fourth source signal S4 relative to the potential of the common electrode COML. The magnitude of the potential +V of the fifth source signal S5 relative to the potential of the common electrode COML is substantially equal to the magnitude of the potential −V of the sixth source signal S6 relative to the potential of the common electrode COML. The magnitude of the potential +V of the seventh source signal S7 relative to the potential of the common electrode COML is substantially equal to the magnitude of the potential −V of the eighth source signal S8 relative to the potential of the common electrode COML. In this example, to display the single-colored window image 30W illustrated in FIG. 4, the magnitude of the potential +V of the first source signal S1 relative to the potential of the common electrode COML, the magnitude of the potential −V of the second source signal S2 relative to the potential of the common electrode COML, the magnitude of the potential +V of the third source signal S3 relative to the potential of the common electrode COML, the magnitude of the potential −V of the fourth source signal S4 relative to the potential of the common electrode COML, the magnitude of the potential +V of the fifth source signal S5 relative to the potential of the common electrode COML, the magnitude of the potential −V of the sixth source signal S6 relative to the potential of the common electrode COML, the magnitude of the potential +V of the seventh source signal S7 relative to the potential of the common electrode COML, and the magnitude of the potential −V of the eighth source signal S8 relative to the potential of the common electrode COML are substantially equal to one another.

Specifically, the signal line DTL1 is supplied with the first source signal S1 having the positive (+) polarity selected by the first selector signal SEL1.

The signal line DTL2 is supplied with the second source signal S2 having the negative (−) polarity selected by the first selector signal SEL1.

The signal line DTL3 is supplied with the second source signal S2 having the negative (−) polarity selected by the second selector signal SEL2.

The signal line DTL4 is supplied with the first source signal S1 having the positive (+) polarity selected by the second selector signal SEL2.

The signal line DTL5 is supplied with the second source signal S2 having the negative (−) polarity selected by the third selector signal SEL3.

The signal line DTL6 is supplied with the first source signal S1 having the positive (+) polarity selected by the third selector signal SEL3.

The signal line DTL7 is supplied with the third source signal S3 having the positive (+) polarity selected by the first selector signal SEL1.

The signal line DTL8 is supplied with the fourth source signal S4 having the negative (−) polarity selected by the first selector signal SEL1.

The signal line DTL9 is supplied with the third source signal S3 having the positive (+) polarity selected by the second selector signal SEL2.

The signal line DTL10 is supplied with the fourth source signal S4 having the negative (−) polarity selected by the second selector signal SEL2.

The signal line DTL11 is supplied with the fourth source signal S4 having the negative (−) polarity selected by the third selector signal SEL3.

The signal line DTL12 is supplied with the third source signal S3 having the positive (+) polarity selected by the third selector signal SEL3.

The signal line DTL13 is supplied with the sixth source signal S6 having the negative (−) polarity selected by the first selector signal SEL1.

The signal line DTL14 is supplied with the fifth source signal S5 having the positive (+) polarity selected by the first selector signal SEL1.

The signal line DTL15 is supplied with the fifth source signal S5 having the positive (+) polarity selected by the second selector signal SEL2.

The signal line DTL16 is supplied with the fifth source signal S5 having the negative (−) polarity selected by the second selector signal SEL2.

The signal line DTL17 is supplied with the fifth source signal S5 having the positive (+) polarity selected by the third selector signal SEL3.

The signal line DTL18 is supplied with the sixth source signal S6 having the negative (−) polarity selected by the third selector signal SEL3.

The signal line DTL19 is supplied with the eighth source signal S8 having the negative (−) polarity selected by the first selector signal SEL1.

The signal line DTL20 is supplied with the seventh source signal S7 having the positive (+) polarity selected by the first selector signal SEL1.

The signal line DTL21 is supplied with the eighth source signal S8 having the negative (−) polarity selected by the second selector signal SEL2.

The signal line DTL22 is supplied with the seventh source signal S7 having the positive (+) polarity selected by the second selector signal SEL2.

The signal line DTL23 is supplied with the seventh source signal S7 having the positive (+) polarity selected by the third selector signal SEL3.

The signal line DTL24 is supplied with the eighth source signal S8 having the negative (−) polarity selected by the third selector signal SEL3.

Figure 61:
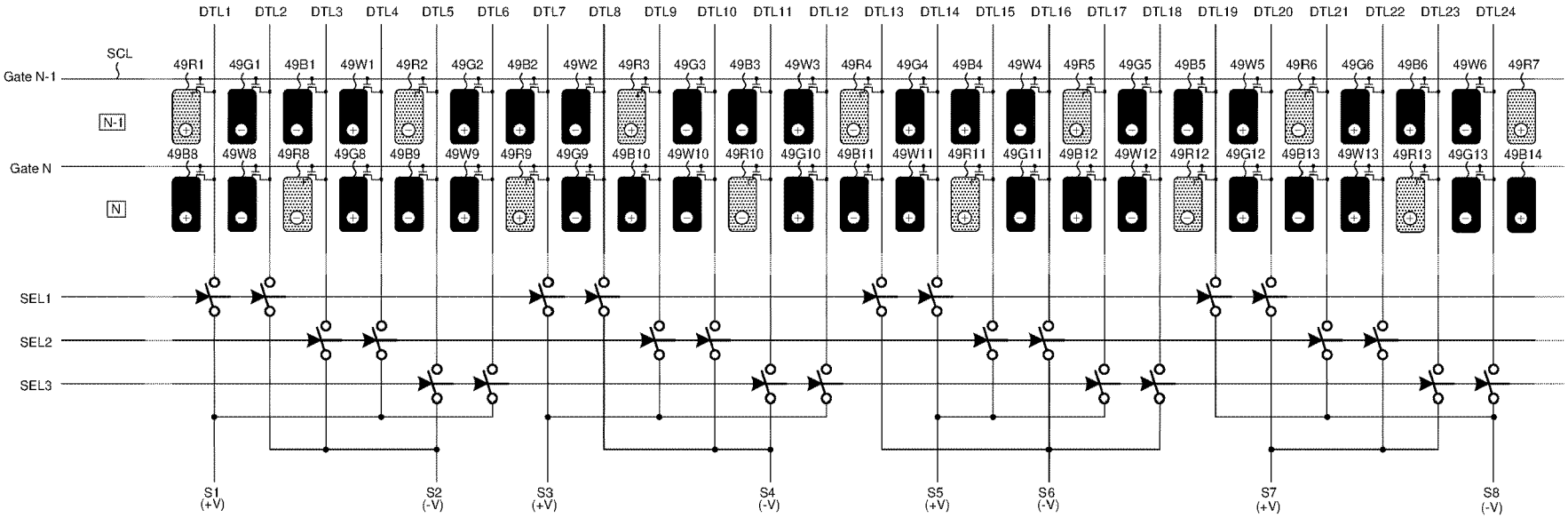
FIG. 61 is a diagram illustrating a state of the N−1th row and the Nth row when the window display illustrated in FIG. 4 is made in the first primary color (red) in the seventh modification illustrated in FIG. 60.
Figure 62:
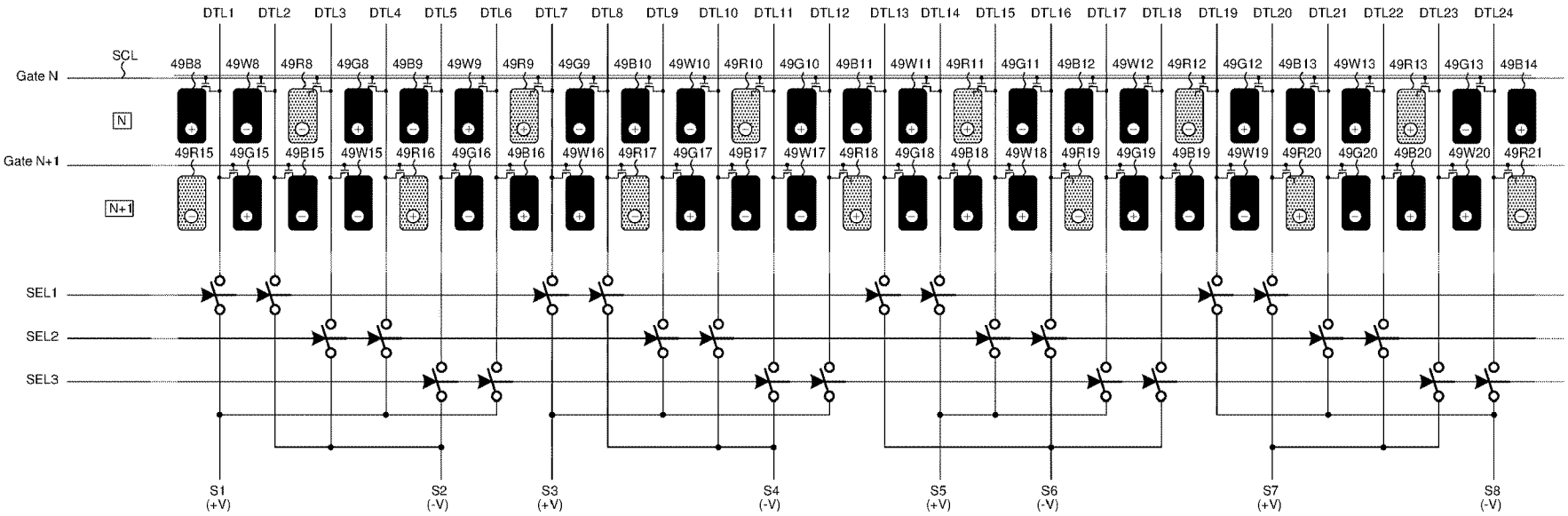
FIG. 62 is a diagram illustrating a state of the Nth row and the N+1th row when the window display illustrated in FIG. 4 is made in the first primary color (red) in the seventh modification illustrated in FIG. 60.
Figure 64:
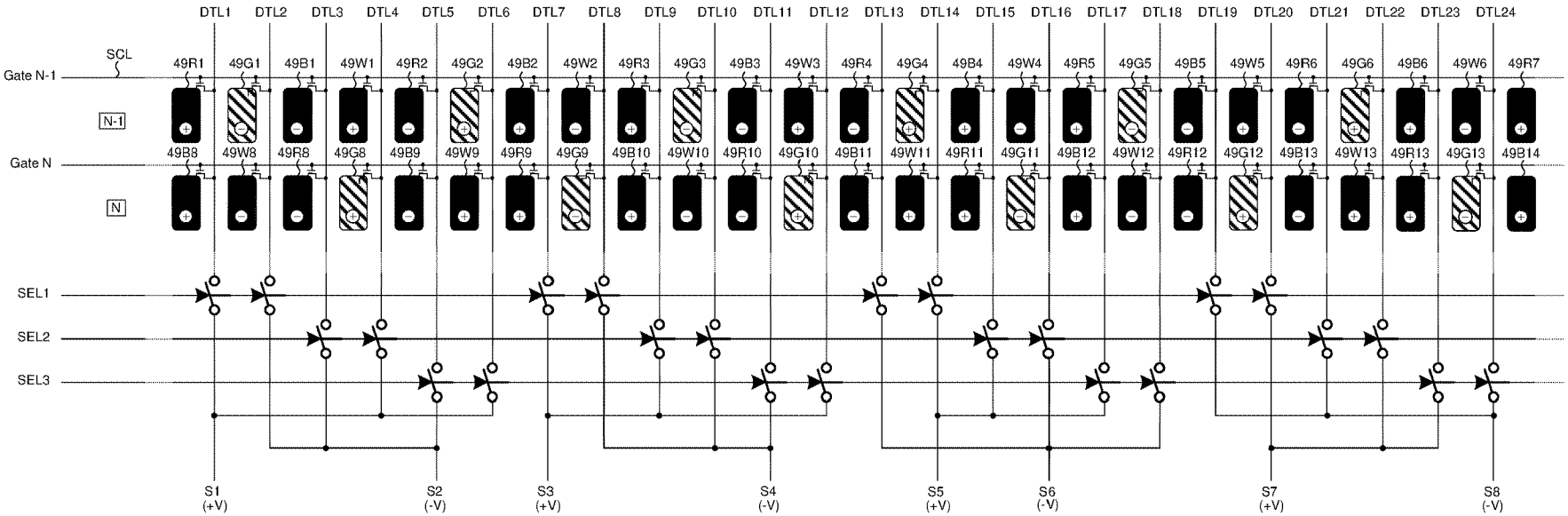
FIG. 64 is a diagram illustrating a state of the N−1th row and the Nth row when the window display illustrated in FIG. 4 is made in the second primary color (green) in the seventh modification illustrated in FIG. 60.
Figure 65:
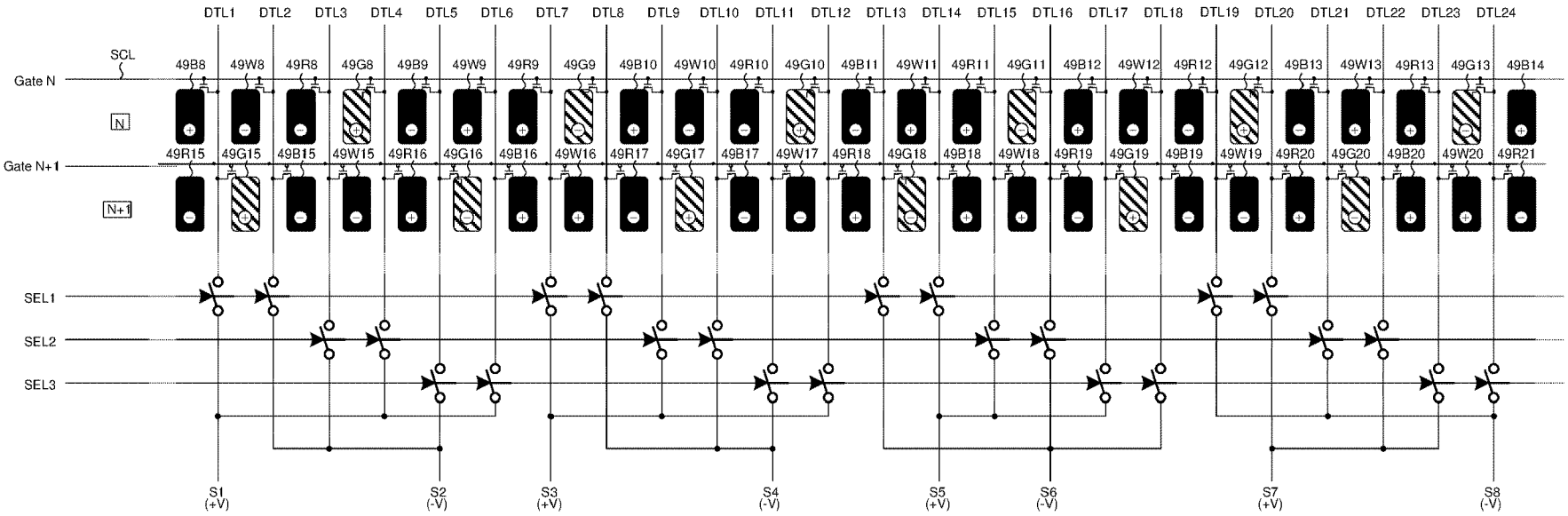
FIG. 65 is a diagram illustrating a state of the Nth row and the N+1th row when the window display illustrated in FIG. 4 is made in the second primary color (green) in the seventh modification illustrated in FIG. 60.
Figure 67:
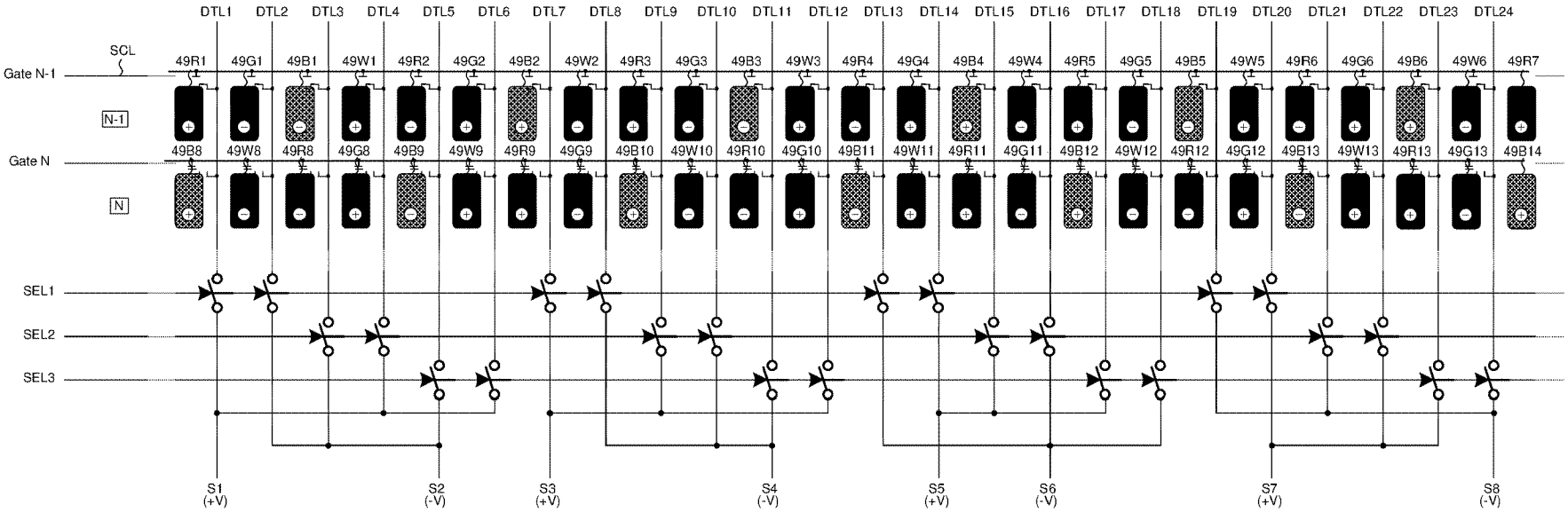
FIG. 67 is a diagram illustrating a state of the N−1th row and the Nth row when the window display illustrated in FIG. 4 is made in the third primary color (blue) in the seventh modification illustrated in FIG. 60.
Figure 68:
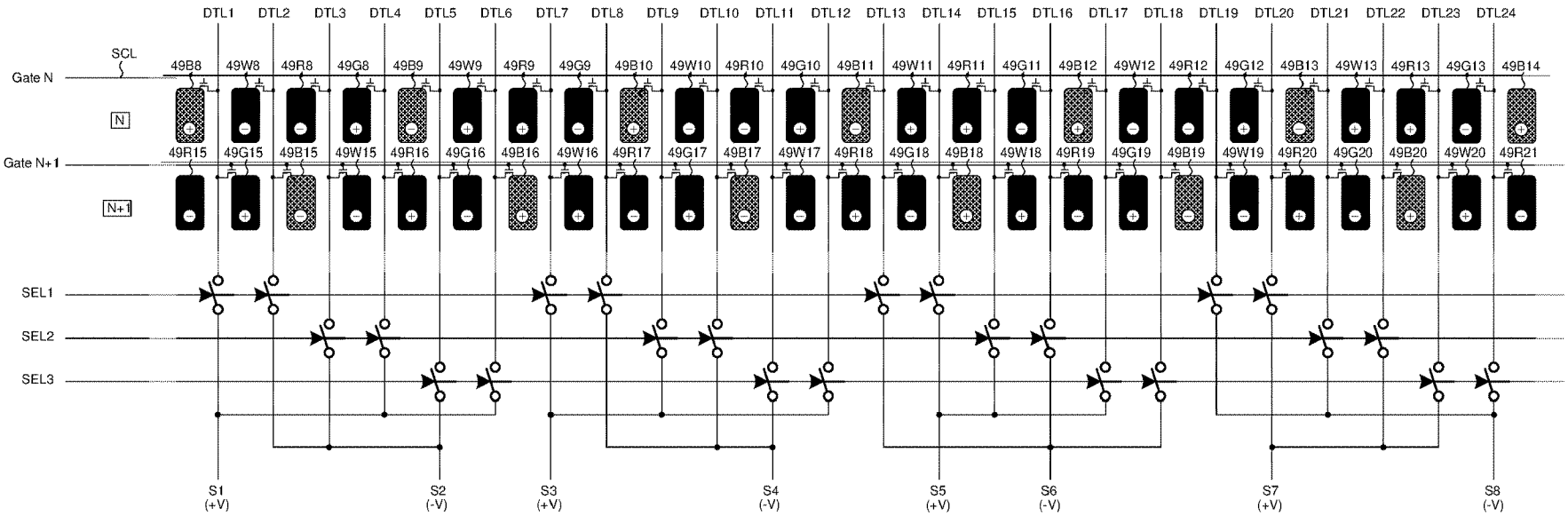
FIG. 68 is a diagram illustrating a state of the Nth row and the N+1th row when the window display illustrated in FIG. 4 is made in the third primary color (blue) in the seventh modification illustrated in FIG. 60.

FIG. 61 is a diagram illustrating a state of the N−1th row and the Nth row when the window display illustrated in FIG. 4 is made in the first primary color (red) in the seventh modification illustrated in FIG. 60. FIG. 62 is a diagram illustrating a state of the Nth row and the N+1th row when the window display illustrated in FIG. 4 is made in the first primary color (red) in the seventh modification illustrated in FIG. 60. FIG. 63 is a table indicating the potential changes of the respective signal lines when the window display illustrated in FIG. 4 is made in the first primary color (red) in the seventh modification illustrated in FIG. 60. FIG. 64 is a diagram illustrating a state of the N−1th row and the Nth row when the window display illustrated in FIG. 4 is made in the second primary color (green) in the seventh modification illustrated in FIG. 60. FIG. 65 is a diagram illustrating a state of the Nth row and the N+1th row when the window display illustrated in FIG. 4 is made in the second primary color (green) in the seventh modification illustrated in FIG. 60. FIG. 66 is a table indicating the potential changes of the respective signal lines when the window display illustrated in FIG. 4 is made in the second primary color (green) in the seventh modification illustrated in FIG. 60. FIG. 67 is a diagram illustrating a state of the N−1th row and the Nth row when the window display illustrated in FIG. 4 is made in the third primary color (blue) in the seventh modification illustrated in FIG. 60. FIG. 68 is a diagram illustrating a state of the Nth row and the N+1th row when the window display illustrated in FIG. 4 is made in the third primary color (blue) in the seventh modification illustrated in FIG. 60. FIG. 69 is a table indicating the potential changes of the respective signal lines when the window display illustrated in FIG. 4 is made in the third primary color (blue) in the seventh modification illustrated in FIG. 60.

In the seventh modification illustrated in FIG. 60, when each of the sub-pixel columns is sequentially selected, the sum of the potential changes of the signal lines DTL1, DTL2, DTL7, DTL8, DTL13, DTL14, DTL19, and DTL20 selected by the first selector signal SEL1 is substantially zero (≈0) as illustrated in FIGS. 61 to 69. The sum of the potential changes of the signal lines DTL3, DTL4, DTL9, DTL10, DTL15, DTL16, DTL21, and DTL22 selected by the second selector signal SEL2 is also substantially zero (≈0). Further, the sum of the potential changes of the signal lines DTL5, DTL6, DTL11, DTL12, DTL17, DTL18, DTL23, and DTL24 selected by the third selector signal SEL3 is also substantially zero (≈0).

In this manner, also in the seventh modification illustrated in FIG. 60, the sum of the potential changes of the respective signal lines DTL selected by each of the selector signals is substantially zero (≈0) when each of the sub-pixel columns is sequentially selected, thereby preventing the deterioration in display quality caused by the crosstalk.

The number of colors displayed by the sub-pixels, the number of pixel arrays, and the number of selector signals are not limited to those described above. The display device according to the embodiment only needs to be configured as follows: the sub-pixel rows, in which the sub-pixels 49 for displaying the different colors are periodically arranged in the X-direction (first direction), are regularly arranged in the Y-direction (second direction); each of m (where m is an integer of two or greater) selector signals selects n (where n is an integer of one or greater) pairs of the signal lines DTL each supplied with two signals each having a mutually reverse polarity within a period during which each of the sub-pixel rows is selected by corresponding one of the scan lines SCL; and the sum of the potential changes of the n pairs of the signal lines DTL selected by each of the selector signals is substantially zero (≈0) when each of the sub-pixel columns is sequentially selected by the scan line SCL.

The description above has illustrated the case where the single-colored window image 30W is displayed at the central part of the display region 31 of the image display panel 30. However, the effect of the present embodiment is not limited to this case. The present embodiment can also exhibit the effect when an ordinary moving image or still image is displayed, for example. That is, even when an ordinary moving image or still image is displayed, the sum of the potential changes of the respective signal lines selected by each of the selector signals is substantially zero (≈0), thereby preventing the deterioration in display quality caused by the crosstalk.

As described above, the display device 10 according to the present embodiment includes the image display panel 30 including: the sub-pixel rows, in which the sub-pixels 49 for displaying the different colors are periodically arranged in the X-direction (first direction), are regularly arranged in the Y-direction (second direction); the signal lines DTL provided parallel to the sub-pixel columns in which the sub-pixels 49 are successively arranged in the Y-direction (second direction); and the scan lines SCL that sequentially select each row of the sub-pixel columns. The display device 10 is configured such that each of the m (where m is an integer of two or greater) selector signals (first selector signal SEL1, second selector signal SEL2, and third selector signal SEL3) selects the n (where n is an integer of one or greater) pairs of the signal lines DTL each supplied with two signals each having a mutually reverse polarity within the period during which each of the sub-pixel rows is selected by corresponding one of the scan lines SCL, and the sum of the potential changes of the n pairs of the signal lines DTL selected by each of the selector signals (first selector signal SEL1, second selector signal SEL2, and third selector signal SEL3) is substantially zero when each of the sub-pixel columns is sequentially selected by the scan line SCL.

Specifically, the first sub-pixel (red), the second sub-pixel (green), and the third sub-pixel (blue) are sequentially arrayed in this order in each sub-pixel row; these sub-pixels are arranged in the Y direction (second direction) such that each of the first sub-pixel (red), the second sub-pixel (green), and the third sub-pixel (blue) belonging to the first sub-pixel row is shifted in the X direction (first direction) by one sub-pixel with respect to a corresponding sub-pixel belonging to the second sub-pixel row adjacent to the first sub-pixel row; and each signal line DTL is coupled alternately in the Y direction (second direction) to two consecutive sub-pixels 49 belonging to the first sub-pixel column and two consecutive sub-pixels 49 belonging to the second sub-pixel column adjacent to the first sub-pixel column. Each of the first selector signal SEL1, the second selector signal SEL2, and the third selector signal SEL3 selects a pair of the signal lines each supplied with either of the first source signal S1 and the second source signal S2 each having a mutually reverse polarity.

Alternatively, the first sub-pixel (red), the second sub-pixel (green), and the third sub-pixel (blue) are sequentially arrayed in this order in each sub-pixel row; these sub-pixels are arranged in the Y direction (second direction) such that each of the first sub-pixel (red), the second sub-pixel (green), and the third sub-pixel (blue) belonging to the even-numbered sub-pixel row is shifted in the X direction (first direction) by one sub-pixel with respect to a corresponding sub-pixel belonging to the odd-numbered row; and each signal line DTL is coupled alternately in the Y direction (second direction) to one sub-pixel 49 belonging to the first sub-pixel column and another sub-pixel 49 belonging to the second sub-pixel column adjacent to the first sub-pixel column. Each of the first selector signal SEL1, the second selector signal SEL2, and the third selector signal SEL3 selects a pair of the signal lines each supplied with either of the first source signal S1 and the second source signal S2 each having a mutually reverse polarity.

Alternatively, the first sub-pixel (red), the second sub-pixel (green), and the third sub-pixel (blue) are sequentially arrayed in this order in each sub-pixel; these sub-pixels are arranged in the Y direction (second direction) such that each of the first sub-pixel (red), the second sub-pixel (green), and the third sub-pixel (blue) belonging to the first sub-pixel row is shifted in the X direction (first direction) by one sub-pixel with respect to a corresponding sub-pixel belonging to the second sub-pixel row adjacent to the first sub-pixel row; and each signal line DTL is coupled alternately in the Y direction (second direction) to two consecutive sub-pixels 49 belonging to the first sub-pixel column and two consecutive sub-pixels 49 belonging to the second sub-pixel column adjacent to the first sub-pixel column. Each of the first selector signal SEL1, the second selector signal SEL2, and the third selector signal SEL3 selects a pair of the signal lines each supplied with either of the first source signal S1 and the second source signal S2 each having a mutually reverse polarity, and selects a pair of the signal lines each supplied with either of the third source signal S3 and the fourth source signal S4 each having a mutually reverse polarity.

Alternatively, the first sub-pixel (red), the second sub-pixel (green), and the third sub-pixel (blue) are sequentially arrayed in this order in each sub-pixel row; these sub-pixels are arranged in the Y direction (second direction) such that each of the first sub-pixel (red), the second sub-pixel (green), and the third sub-pixel (blue) belonging to the even-numbered sub-pixel row is shifted in the X direction (first direction) by one sub-pixel with respect to a corresponding sub-pixel belonging to the odd-numbered row; and each signal line DTL is coupled alternately the Y direction (second direction) to one sub-pixel 49 belonging to the first sub-pixel column and another sub-pixel 49 belonging to the second sub-pixel column adjacent to the first sub-pixel column. Each of the first selector signal SEL1, the second selector signal SEL2, and the third selector signal SEL3 selects a pair of the signal lines each supplied with either of the first source signal S1 and the second source signal S2 each having a mutually reverse polarity, selects a pair of the signal lines each supplied with either of the third source signal S3 and the fourth source signal S4 each having a mutually reverse polarity, and selects a pair of the signal lines each supplied with either of the fifth source signal S5 and the sixth source signal S6 each having a mutually reverse polarity.

Alternatively, the first sub-pixel (red), the second sub-pixel (green), the third sub-pixel (blue), the first sub-pixel (red), the second sub-pixel (green), and the fourth sub-pixel (white) are sequentially arrayed in this order in each sub-pixel row; these sub-pixels are arranged in the Y direction (second direction) such that each of the first sub-pixel (red), the second sub-pixel (green), the third sub-pixel (blue), the first sub-pixel (red), the second sub-pixel (green), and the fourth sub-pixel (white) belonging to the even-numbered sub-pixel row is shifted in the X direction (first direction) by three sub-pixels with respect to a corresponding sub-pixel belonging to the odd-numbered row; and each signal line DTL is coupled alternately in the Y direction (second direction) to one sub-pixel 49 belonging to the first sub-pixel column and another sub-pixel 49 belonging to the second sub-pixel column adjacent to the first sub-pixel column. Each of the first selector signal SEL1, the second selector signal SEL2, and the third selector signal SEL3 selects a pair of the signal lines each supplied with either of the first source signal S1 and the second source signal S2 each having a mutually reverse polarity, and selects a pair of the signal lines each supplied with either of the third source signal S3 and the fourth source signal S4 each having a mutually reverse polarity.

Alternatively, the first sub-pixel (red), the second sub-pixel (green), the third sub-pixel (blue), the first sub-pixel (red), the second sub-pixel (green), and the fourth sub-pixel (white) are sequentially arrayed in this order in each sub-pixel row; these sub-pixels are arranged in the Y direction (second direction) such that each of the first sub-pixel (red), the second sub-pixel (green), the third sub-pixel (blue), the first sub-pixel (red), the second sub-pixel (green), and the fourth sub-pixel (white) belonging to the even-numbered sub-pixel row is shifted in the X direction (first direction) by three sub-pixels with respect to a corresponding sub-pixel belonging to the odd-numbered row; and each signal line DTL is coupled alternately in the Y direction (second direction) to two consecutive sub-pixels 49 belonging to the first sub-pixel column and two consecutive sub-pixels 49 belonging to the second sub-pixel column adjacent to the first sub-pixel column. Each of the first selector signal SEL1, the second selector signal SEL2, and the third selector signal SEL3 selects a pair of the signal lines each supplied with either of the first source signal S1 and the second source signal S2 each having a mutually reverse polarity, and selects a pair of the signal lines each supplied with either of the third source signal S3 and the fourth source signal S4 each having a mutually reverse polarity.

Alternatively, the first sub-pixel (red), the second sub-pixel (green), the third sub-pixel (blue), and the fourth sub-pixel (white) are sequentially arrayed in this order in each sub-pixel row; these sub-pixels are arranged in the Y direction (second direction) such that each of the first sub-pixel (red), the second sub-pixel (green), the third sub-pixel (blue), and the fourth sub-pixel (white) belonging to the even-numbered sub-pixel row is shifted in the X direction (first direction) by two sub-pixels with respect to a corresponding sub-pixel belonging to the odd-numbered row; each signal line DTL is coupled alternately in the Y direction (second direction) to one sub-pixel 49 belonging to the first sub-pixel column and another sub-pixel 49 belonging to the second sub-pixel column adjacent to the first sub-pixel column. Each of the first selector signal SEL1, the second selector signal SEL2, and the third selector signal SEL3 selects a pair of the signal lines each supplied with either of the first source signal S1 and the second source signal S2 each having a mutually reverse polarity, selects a pair of the signal lines each supplied with either of the third source signal S3 and the fourth source signal S4 each having a mutually reverse polarity, selects a pair of the signal lines each supplied with either of the fifth source signal S5 and the sixth source signal S6 each having a mutually reverse polarity, and selects a pair of the signal lines each supplied with either of the seventh source signal S7 and the eighth source signal S8 each having a mutually reverse polarity.

Alternatively, the first sub-pixel (red), the second sub-pixel (green), the third sub-pixel (blue), and the fourth sub-pixel (white) are sequentially arrayed in this order in each sub-pixel row; these sub-pixels are arranged in the Y direction (second direction) such that each of the first sub-pixel (red), the second sub-pixel (green), the third sub-pixel (blue), and the fourth sub-pixel (white) belonging to the even-numbered sub-pixel row is shifted in the X direction (first direction) by two sub-pixels with respect to a corresponding sub-pixel belonging to the odd-numbered row; and each signal line DTL is coupled alternately in the Y direction (second direction) to two consecutive sub-pixels 49 belonging to the first sub-pixel column and two consecutive sub-pixels 49 belonging to the second sub-pixel column adjacent to the first sub-pixel column. Each of the first selector signal SEL1, the second selector signal SEL2, and the third selector signal SEL3 selects a pair of the signal lines each supplied with either of the first source signal S1 and the second source signal S2 each having a mutually reverse polarity, selects a pair of the signal lines each supplied with either of the third source signal S3 and the fourth source signal S4 each having a mutually reverse polarity, selects a pair of the signal lines each supplied with either of the fifth source signal S5 and the sixth source signal S6 each having a mutually reverse polarity, and selects a pair of the signal lines each supplied with either of the seventh source signal S7 and the eighth source signal S8 each having a mutually reverse polarity.

With any of the configurations described above, the sum of the potential changes of the respective signal lines selected by each of the selector signals is substantially zero (≈0) when each of the sub-pixel columns is sequentially selected, thereby preventing the deterioration in display quality caused by the crosstalk.

The components of the embodiment described above can be combined as appropriate. The present disclosure can naturally provide other advantageous effects that are provided by the aspects described in the embodiments above and are clearly defined by the description in the present specification or appropriately conceivable by those skilled in the art.

What is claimed is:

1. A display device comprising an image display panel, the image display panel comprising:

a plurality of pixels each including a plurality of sub-pixels to display respective different colors, the plurality of pixels including a first pixel, a second pixel, and a third pixel, and each of the first, second, and third pixels respectively includes a first sub-pixel, a second sub-pixel, and a third sub-pixel;

a plurality of sub-pixel rows, in each of which the sub-pixels are periodically arrayed in a first direction, are regularly arranged in a second direction different from the first direction, wherein the first pixel is directly adjacent the second pixel in the first direction, the second pixel is directly adjacent the third pixel in the first direction, and the respective first, second, and third subpixels are sequentially arrayed in the first direction in the order of the first sub-pixel, the second sub-pixel, and the third sub-pixel;

a plurality of signal lines in parallel to a plurality of sub-pixel columns in which the sub-pixels are successively arranged in the second direction; and a plurality of scan lines that sequentially select each of the sub-pixel rows, wherein each of m (where m is an integer of two or greater) selector signals selects n (where n is an integer of one or greater) pairs of the signal lines, each pair supplied with two signals having mutually reverse polarities, within a period during which each of the sub-pixel rows is selected by a corresponding one of the scan lines, and a sum of potential changes of the n pairs of the signal lines selected by each of the selector signals is substantially zero when each of the sub-pixel rows is sequentially selected by the corresponding scan line, when a selection shifts from one sub-pixel row to another sub-pixel row adjacent to the one sub-pixel row, a potential of the selected signal line changes to a different potential at least between the adjacent sub-pixel rows among the sub-pixel rows, a pair of pixels, among the pixels, directly adjacent to each other in the first direction has a same positional relationship of the sub-pixels to display the respective different colors such that two sub-pixels belonging to each pair of the signal lines supplied with the two signals having mutually reverse polarities are arranged at corresponding positions in the respective pixels, and the pair of pixels is consecutively arranged in the first direction.

2. The display device according to claim 1, wherein the sub-pixels each respectively include a first sub-pixel, a second sub-pixel, and a third sub-pixel, the first sub-pixel, the second sub-pixel, and the third sub-pixel are sequentially arrayed in the order of the first sub-pixel, the second sub-pixel, and the third sub-pixel in each of the sub-pixel rows, and are arranged in the second direction such that each of the first sub-pixel, the second sub-pixel, and the third sub-pixel belonging to a first sub-pixel row is shifted in the first direction by one sub-pixel with respect to a corresponding sub-pixel belonging to a second sub-pixel row adjacent to the first sub-pixel row, each of the signal lines is coupled alternately in the second direction to two consecutive sub-pixels belonging to a first sub-pixel column and two consecutive sub-pixels belonging to a second sub-pixel column adjacent to the first sub-pixel column, the selector signals include a first selector signal, a second selector signal, and a third selector signal, the signals include a first signal and a second signal each having a mutually reverse polarity, and each of the first selector signal, the second selector signal, and the third selector selects a pair of the signal lines each supplied with either of the first signal and the second signal.

3. The display device according to claim 1, wherein the sub-pixels each respectively include a first sub-pixel, a second sub-pixel, and a third sub-pixel, the first sub-pixel, the second sub-pixel, and the third sub-pixel are sequentially arrayed in the order of the first sub-pixel, the second sub-pixel, and the third sub-pixel in each of the sub-pixel rows, and are arranged in the second direction such that each of the first sub-pixel, the second sub-pixel, and the third sub-pixel belonging to an even-numbered sub-pixel row is shifted in the first direction by one sub-pixel with respect to a corresponding sub-pixel belonging to an odd-numbered row, each of the signal lines is coupled alternately in the second direction to one sub-pixel belonging to a first sub-pixel column and another sub-pixel belonging to the second sub-pixel column adjacent to the first sub-pixel column, the selector signals include a first selector signal, a second selector signal, and a third selector signal, the signals include a first signal and a second signal that have polarities different from each other, and each of the first selector signal, the second selector signal, and the third selector selects a pair of the signal lines each supplied with either of the first signal and the second signal.

4. The display device according to claim 1, wherein the sub-pixels each respectively include a first sub-pixel, a second sub-pixel, and a third sub-pixel, the first sub-pixel, the second sub-pixel, and the third sub-pixel are sequentially arrayed in the order of the first sub-pixel, the second sub-pixel, and the third sub-pixel in each of the sub-pixel rows, and are arranged in the second direction such that each of the first sub-pixel, the second sub-pixel, and the third sub-pixel belonging to a first sub-pixel row is shifted in the first direction by one sub-pixel with respect to a corresponding sub-pixel belonging to a second sub-pixel row adjacent to the first sub-pixel row, each of the signal lines is coupled alternately in the second direction to two consecutive sub-pixels belonging to a first sub-pixel column and two consecutive sub-pixels belonging to a second sub-pixel column adjacent to the first sub-pixel column, the selector signals include a first selector signal, a second selector signal, and a third selector signal, the signals include a first signal and a second signal each having a mutually reverse polarity, and a third signal and a fourth signal each having a mutually reverse polarity, and each of the first selector signal, the second selector signal, and the third selector selects a pair of the signal lines each supplied with either of the first signal and the second signal, and selects a pair of the signal lines each supplied with either of the third signal and the fourth signal.

5. The display device according to claim 1, wherein the sub-pixels each respectively include a first sub-pixel, a second sub-pixel, and a third sub-pixel, the first sub-pixel, the second sub-pixel, and the third sub-pixel are sequentially arrayed in the order of the first sub-pixel, the second sub-pixel, and the third sub-pixel in each of the sub-pixel rows, and are arranged in the second direction such that each of the first sub-pixel, the second sub-pixel, and the third sub-pixel belonging to an even-numbered sub-pixel row is shifted in the first direction by one sub-pixel with respect to a corresponding sub-pixel belonging to an odd-numbered row, each of the signal lines is coupled alternately in the second direction to one sub-pixel belonging to a first sub-pixel column and another sub-pixel belonging to a second sub-pixel column adjacent to the first sub-pixel column, the selector signals include a first selector signal, a second selector signal, and a third selector signal, the signals include a first signal and a second signal each having a mutually reverse polarity, a third signal and a fourth signal each having a mutually reverse polarity, and a fifth signal and a sixth signal each having a mutually reverse polarity, and each of the first selector signal, the second selector signal, and the third selector selects a pair of the signal lines each supplied with either of the first signal and the second signal, selects a pair of the signal lines each supplied with either of the third signal and the fourth signal, and selects a pair of the signal lines each supplied with either of the fifth signal and the sixth signal.

* * * * *